US010022986B2

(12) United States Patent
Bae et al.

(10) Patent No.: US 10,022,986 B2
(45) Date of Patent: Jul. 17, 2018

(54) IMAGE FORMING APPARATUS, RECORDING MEDIUM, TERMINAL, SERVER, NOTE PRINTING METHOD, AND STORAGE MEDIUM

(71) Applicant: S-PRINTING SOLUTION CO., LTD., Suwon-si, Gyeonggi-do (KR)

(72) Inventors: Soo Hwan Bae, Yongin-si (KR); Naveen Maheshwari, Suwon-si (KR); Jeong Jin Park, Seongnam-si (KR); Yu Jin Oh, Anyang-si (KR); Eun-Young Cho, Seoul (KR)

(73) Assignee: S-PRINTING SOLUTION CO., LTD., Suwon-si (KR)

( * ) Notice: Subject to any disclaimer, the term of this patent is extended or adjusted under 35 U.S.C. 154(b) by 0 days.

(21) Appl. No.: 15/618,560

(22) Filed: Jun. 9, 2017

(65) Prior Publication Data

US 2017/0274673 A1 Sep. 28, 2017

Related U.S. Application Data

(62) Division of application No. 15/010,071, filed on Jan. 29, 2016, now Pat. No. 9,701,135.
(Continued)

(30) Foreign Application Priority Data

Aug. 31, 2015 (KR) ..... 10-2015-0122965

(51) Int. Cl.
*B41J 11/00* (2006.01)
*B41J 3/407* (2006.01)
*B41J 11/04* (2006.01)

(52) U.S. Cl.
CPC ..... *B41J 11/0005* (2013.01); *B41J 3/4075* (2013.01); *B41J 11/04* (2013.01)

(58) Field of Classification Search
CPC ..... B41J 25/308; B41J 11/20; B41J 3/407
See application file for complete search history.

(56) References Cited

U.S. PATENT DOCUMENTS 6,674,426 B1 1/2004 McGee et al.
8,414,099 B2 4/2013 Nakamaki
(Continued)

FOREIGN PATENT DOCUMENTS

KR 10-2005-0097741 10/2005

OTHER PUBLICATIONS

U.S. Restriction Requirement dated Oct. 6, 2016 from U.S. Appl. No. 15/010,071.
(Continued)

*Primary Examiner* — Lamson Nguyen
(74) *Attorney, Agent, or Firm* — Staas & Halsey LLP

(57) ABSTRACT

A terminal receives contents to be written on a note by a user, a server stores and manages print data generated by a plurality of users and outputs the print data to an image forming apparatus which outputs the print data in the form of an adhesive note. The image forming apparatus includes a de-curl unit for correcting the curl of a recording medium and causes the recording medium on which printing is performed to be popped out through an outlet. The server communicates with a plurality of terminals and includes a control unit which generates a virtual conference space by assigning a storage address to the virtual conference space when a request of generating a virtual conference space and identification information on an image forming apparatus to be used in the virtual conference space from among the plurality of terminals is received.

15 Claims, 69 Drawing Sheets

Related U.S. Application Data

(60) Provisional application No. 62/109,794, filed on Jan. 30, 2015.

(56) References Cited

U.S. PATENT DOCUMENTS

| | | | | |
|---|---|---|---|---|
| 8,560,955 | B2 * | 10/2013 | Jana | G06Q 30/02 715/757 |
| 8,732,236 | B2 * | 5/2014 | Altmaier | H04L 67/104 370/338 |
| 8,827,440 | B2 | 9/2014 | Inokuchi | |
| 9,022,549 | B2 | 5/2015 | Sawada | |

OTHER PUBLICATIONS

U.S. Notice of Allowance dated Mar. 15, 2017 from U.S. Appl. No. 15/010,071.

U.S. Appl. No. 15/010,071, filed Jan. 29, 2016, Soo Hwan Bae, S-Printing Solution Co., Ltd.

* cited by examiner

IMAGE FORMING APPARATUS, RECORDING MEDIUM, TERMINAL, SERVER, NOTE PRINTING METHOD, AND STORAGE MEDIUM

CROSS-REFERENCE TO RELATED APPLICATIONS

This application is a divisional of U.S. patent application Ser. No. 15/010,071, filed on Jan. 29, 2016, which is currently pending and claims the priority benefit of U.S. Provisional Patent Application No. 62/109,794 filed on Jan. 30, 2015 in the United States Patent and Trademark Office and Korean Patent Application No. 10-2015-0122965, filed on Aug. 31, 2015 in the Korean Intellectual Property Office, respectively, the disclosures of all of the above-identified applications being incorporated herein by reference in their entirety.

BACKGROUND

1. Field

Embodiments of the disclosure relate to an image forming apparatus which may output an adhesive note, a recording medium on which printing is performed by the image forming apparatus, a terminal which receives an input of a user, a server which connects the terminal and the image forming apparatus, a note printing method, and a storage medium.

2. Description of the Related Art

In everyday life and school or work performance, an adhesive note which may be repeatedly attached or detached to remember important content is used.

In general, a note is created by directly handwriting the desired content on an adhesive paper. In this case, it is difficult to write contents such as images, tables, graphs, symbols, shapes, and pictures which are difficult to express in writing, on the adhesive note.

On the other hand, image forming apparatuses such as a printer, a facsimile, and a copier print an image on a recording medium through a print head. The image forming apparatuses may be classified into various types such as a dot type, an ink jet type, a laser type, a thermal transfer type, and a thermal type according to a printing method.

A thermal type image forming apparatus may include a thermal head for selectively heating a plurality of heat generating elements, and the thermal head is directly in contact with the thermal recording medium and applies heat thereto, and thereby printing is performed.

The thermal type image forming apparatus needs to use a thermal paper only instead of a plain paper, but does not need ink, toner, and the like and has a simple printing principle, thereby having advantages of being compact in size, portable, and inexpensive.

SUMMARY

Therefore, it is an aspect of the disclosure to provide an image forming apparatus which outputs an adhesive note, a terminal for receiving a content to be written on a note by a user, and a server which stores and manages print data generated by a plurality of users and outputs the print data through the image forming apparatus.

Moreover, it is another aspect of the disclosure to provide an image forming apparatus which has a de-curl unit for correcting the curl of a recording medium. It is still another aspect of the disclosure to provide an image forming apparatus which allows a recording medium on which printing is performed to be popped out (discharged) through an outlet. In addition, it is still another aspect of the disclosure to provide a recording medium which may be used in a thermal type image forming apparatus and has adhesiveness.

Additional aspects of the disclosure will be set forth in part in the description which follows and, in part, will be apparent from the description, or may be learned by practice of the disclosure.

In accordance with an aspect of the disclosure, there is provided a note printing method for printing note information input to a terminal on an adhesive paper, where the note printing method may include displaying a note window for receiving note information from a user, receiving the note information, and transmitting, when the note information is received, the input note information and a print request of the note information to an image forming apparatus connected to the terminal or a server.

The operation of transmitting the input note information and a print request of the note information may include connecting the image forming apparatus and the terminal using a Bluetooth communication and releasing the connection at either when printing of the note information is completed or when a reference time is exceeded, depending on which comes first.

The operation of transmitting the input note information and a print request of the note information may include connecting the image forming apparatus and the terminal using the Bluetooth communication and releasing the connection when a transmission of the note information is completed.

The operation of transmitting the input note information and a print request of the note information may include connecting a master terminal connected to the image forming apparatus using the Bluetooth communication and the terminal through a Wi-Fi communication or a Wi-Fi Direct communication, and transmitting the note information and the print request to the image forming apparatus through the master terminal.

The operation of transmitting the input note information and a print request of the note information may include connecting the image forming apparatus and the terminal using the Bluetooth communication and releasing the connection when printing of the note information is completed.

The note printing method may further include receiving a selection of a user for a size of the paper and transmitting the selection of a user to the image forming apparatus.

The note printing method may further include receiving a selection of a user for a relationship between a position of an adhesive applied to the paper and a printing position of the note information and transmitting the selection of a user to the image forming apparatus.

The note printing method may further include receiving a request of generating a virtual conference space and transmitting the request of generating a virtual conference space to the server.

The operation of receiving a request of generating a virtual conference space may include displaying a list of available image forming apparatuses on a display unit of the terminal, receiving an input for a selection of the image forming apparatus from the user, and displaying a message confirming whether there is a request of generating a virtual conference space using the selected image forming apparatus on the display unit.

The operation of receiving a request of generating a virtual conference space may include displaying a list of conference attendee candidates and a list of available image forming apparatuses on a display unit of the terminal and receiving an input for a selection of a conference attendee among the list of conference attendee candidates and an input for a selection of an image forming apparatus to be used among the list of available image forming apparatuses.

The note printing method may further include receiving note information on another terminal connected to the virtual conference space and receiving an input of a relationship between note information on the terminal and note information on the another terminal.

The note printing method may further include displaying the received note information on a display unit of the terminal.

The note printing method may further include creating a report based on a relationship between note information on the terminal and note information on the another terminal.

The note printing method may further include displaying a screen for creating a report on the terminal.

In accordance with another aspect of the disclosure, there is provided a computer-readable storage medium, which stores at least one program, where the at least one program may include a command to perform displaying a note window for receiving note information on a display unit, receiving an input of the note information through an input unit, and transmitting, when receiving the input of the note information, the input note information and a print request of the note information to an image forming apparatus connected to a terminal and a server which generates a virtual conference space based on identification information on the image forming apparatus.

In accordance with still another aspect of the disclosure, an image forming apparatus may include a printing unit which has a thermal head having a heat generating element and a platen roller which forms a printing nip between the platen roller and the thermal head and supports a recording medium passing through the printing nip, and a de-curl unit which may include a first de-curl roller correcting the curl of the recording medium by giving a curve in an opposite direction to the curl of the recording medium.

The de-curl unit may further include a second de-curl roller which increases a curving amount given by the first de-curl roller.

The platen roller and the second de-curl roller may be provided to be movable with respect to the first de-curl roller.

The platen roller and the second de-curl roller may be provided to be rotatable about a common hinge axis, respectively.

The image forming apparatus may further include a fixed frame, and a rotary frame provided to be rotatable with respect to the fixed frame, in which the platen roller and the second de-curl roller are provided in the rotary frame, and the first de-curl roller is provided in the fixed frame.

The first de-curl roller and the second de-curl roller may be provided to be rotated by a friction force with the recording medium.

The platen roller may rotate in a first direction, the first de-curl roller may rotate in a second direction opposite to the first direction, and the second de-curl roller may rotate in the first direction.

The recording medium may be provided in the image forming apparatus in a state of being wound in a roll form.

The recording medium may include a thermal paper and the image forming apparatus may further include a thermal head which forms an image by applying heat to the thermal paper.

The recording medium may include an adhesive layer and a release layer.

In accordance with still another aspect of the disclosure, an image forming apparatus may include a housing having an outlet, a thermal head which generates heat and performs printing on a recording medium, a platen roller which presses the thermal head, and a discharge guide unit which causes the recording medium to be popped out (discharged) through the outlet.

The discharge guide unit may generate an elastic force by bending the recording medium.

The discharge guide unit may include a guide surface which bends the recording medium while guiding the leading end of the recording medium to the outlet side.

The guide surface may be a curved surface.

The guide surface may be provided to be concave toward the recording medium.

The discharge guide unit may be positioned in a moving direction of the recording medium, and the outlet may be positioned to deviate from the moving direction of the recording medium.

The discharge guide unit may be integrated with the housing.

The housing may include an upper housing and a lower housing, and the discharge guide unit may be integrated with the upper housing.

The image forming apparatus may further include a cutter which cuts the recording medium.

The recording medium may include a thermal paper.

The recording medium may include an adhesive layer and a release layer.

In accordance with still another aspect of the disclosure, a recording medium may include a substrate, a thermal layer provided on a front surface of the substrate, an adhesive layer which has a width smaller than a width of the substrate and is provided on a rear surface of the substrate to be continuous in an entire section between a front end and a rear end in a length direction of the substrate, and a release layer which has a width smaller than a width of the substrate and a width larger than a width of the adhesive layer, and is provided on a front surface of the thermal layer to be continuous in the entire section between the front end and the rear end in the length direction of the substrate.

The adhesive layer may be provided on one side based on a center line in the length direction of the substrate.

The adhesive layer may be provided on both sides based on the center line in the length direction of the substrate.

The recording medium may be provided in an image forming apparatus in a state of being wound in the roll form.

According to an aspect of the disclosure, contents difficult to be directly created by a user may be easily printed on a paper and maintained since a note input through a terminal is printed on an adhesive paper.

According to an aspect of the disclosure, a printed image may be improved in quality and a paper jam phenomenon may be reduced since printing is performed after the curl of a print medium is released or reduced.

According to an aspect of the disclosure, a print medium may be easily mounted onto a de-curl unit since the de-curl unit for correcting the curl of a print medium may be made of a plurality of rollers and some of the rollers are provided to be movable with respect to the other rollers.

According to an aspect of the disclosure, a print medium may be prevented from being stacked since a print medium on which printing is completed is popped out by an image forming apparatus. In particular, print mediums may be stacked and may adhere to each other due to an adhesive layer when using a print medium which has the adhesive layer provided on one side; however, this may be prevented when using the image forming apparatus according to a concept of the disclosure.

According to an aspect of the disclosure, a print medium discharged from the image forming apparatus may be directly attached to a required place since the recording medium has the adhesive layer and an additional liner is not provided on the adhesive layer. A release layer is provided on the opposite side to a side on which the adhesive layer is provided, such that it is possible to prevent both sides of the print medium from adhering to each other in a state of being wound in the roll form.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
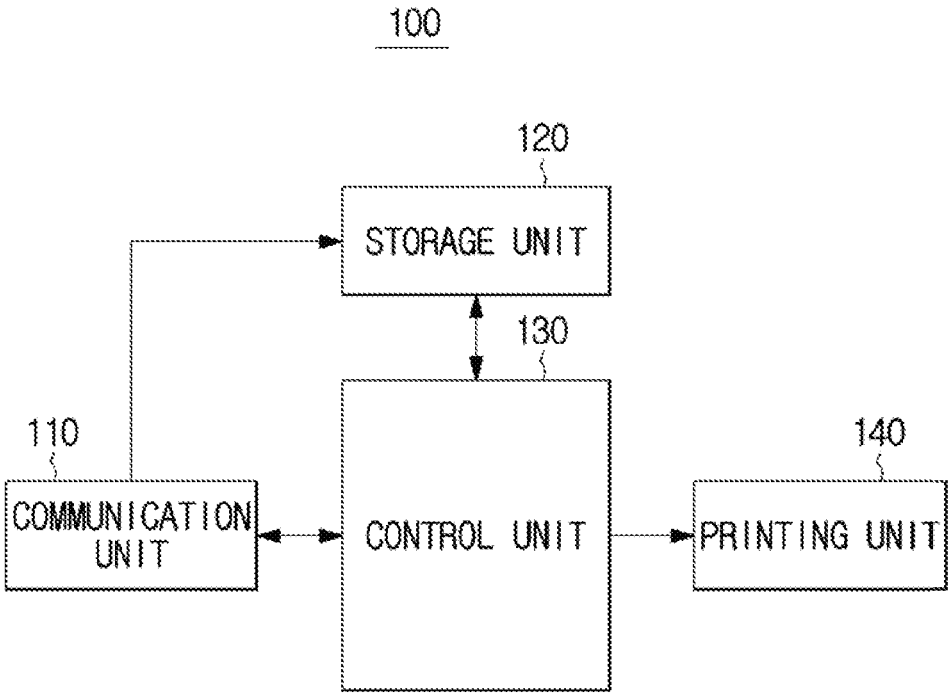
FIG. 1 is a control block diagram of an image forming apparatus in accordance with one embodiment of the disclosure.

Reference will now be made in detail to the embodiments of the disclosure, examples of which are illustrated in the accompanying drawings, wherein like reference numerals refer to like elements throughout.

An image forming apparatus, a server, a note printing method, a storage medium on which a program for performing the note printing method is recorded, and an adhesive recording medium in accordance with an aspect of the disclosure will be described in detail referring to the accompanying drawings.

FIG. 1 is a control block diagram of an image forming apparatus in accordance with an embodiment of the disclosure.

An image forming apparatus 100 in accordance with an embodiment may generate an adhesive note by printing a text or an image on an adhesive paper. For this, the image forming apparatus 100 may include a communication unit 110 which receives print data by communicating with an external device, a storage unit 120 which non-temporarily or temporarily stores the print data, a printing unit 140 which prints the print data on a paper, and a control unit 130 which controls operations of the communication unit 110, the storage unit 120, and the printing unit 140, as illustrated in FIG. 1.

The communication unit 110 may receive print data by communicating with a terminal 200 or a server 300 to be described below, and include an appropriate communication module according to a communication method with the terminal 200 or the server 300.

The storage unit 120 may store the print data received from the terminal 200 or the server 300, and a program and data for executing an operation of controlling the image forming apparatus 100.

The control unit 130 may include a processor which processes data according to a program stored in the storage unit 120 of the image forming apparatus 100.

The image forming apparatus 100 may perform printing not only on an adhesive paper but also on a plain paper without adhesiveness, and include functions of two or more of a printer, a copier, a facsimile, and a scanner. However, in an embodiment to be described below, the image forming apparatus 100 will be described as a printer which prints a text or an image on an adhesive paper and outputs the paper.

Figure 2:
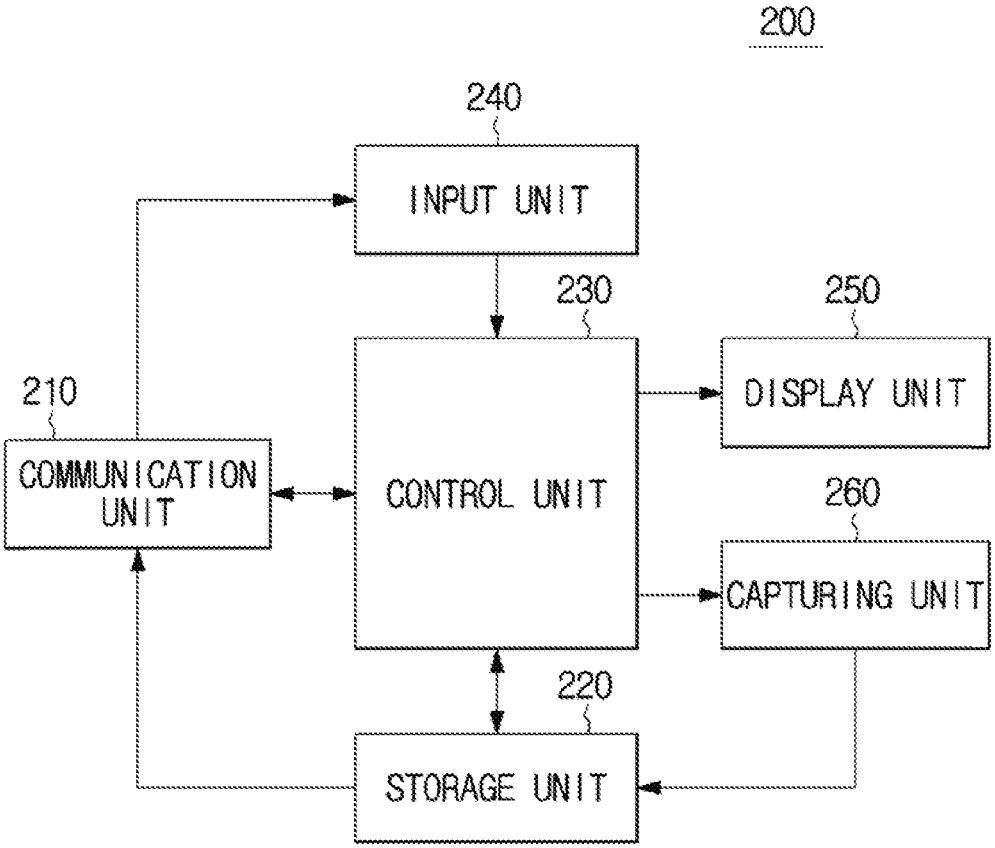
FIG. 2 is a control block diagram of a terminal in accordance with one embodiment of the disclosure.

FIG. 2 is a control block diagram of a terminal in accordance with an embodiment of the disclosure.

The terminal 200 in accordance with an embodiment receives note information from a user. The input note information is transmitted to the image forming apparatus 100 as print data, and the image forming apparatus 100 prints the note information input by a user on a paper P and outputs the paper. In this embodiment, the paper P on which the note information is printed is referred to as a note.

For this, the terminal 200 may include an input unit 240 for receiving note information from a user, a display unit 250 for displaying the input note information, a storage unit 220 for storing the input note information, a communication unit 210 for transmitting the input note information to the image forming apparatus 100, and a control unit 230 for controlling operations of the input unit 240, the display unit 250, the storage unit 220, and the communication unit 210, as illustrated in FIG. 2. The terminal 200 may also include a capturing unit 260 to capture an image of an object which may be stored in the storage unit 220.

The storage unit 220 may store print data input by a user, and a program and data for executing an operation of controlling the terminal 200.

The control unit 230 may include a processor for processing data according to the stored program and the processor may be embodied as a CPU. The CPU may include a single core, a dual core, a triple core, or a quad core. A CPU, a RAM, and a ROM may be connected to one another through an internal bus.

The input unit 240 may be embodied as a type of a keyboard, a mouse, a touch panel, or a hard-key provided in a main body of the terminal.

The display unit 250 may be embodied as a display device such as a liquid crystal display (LCD), a light emitting diode (LED), an organic light emitting diode (OLED), a plasma display panel (PDP), a cathode ray tube (CRT), or the like. Moreover, it is possible to embody the display unit 250 as a touch screen by placing the input unit 240 embodied as a touch panel type at a front surface of a display device in the example.

On the other hand, a program executed in the control unit 230 so that the terminal 200 receives note information from a user may be installed during manufacturing of the terminal 200 or may be installed after manufacturing of the terminal 200. In the latter case, a program executed to receive note information may be recorded in a computer-readable storage medium (e.g., non-transitory computer-readable storage medium). The program is referred to as a note print program for convenience of description in an embodiment to be described below.

The terminal 200 may perform the installation by loading the note print program from the storage medium. In the embodiment, an operation of obtaining a program recorded in an external storage medium for an installation by the terminal is referred to as "loading".

When the storage medium is included in a server which provides an application or a program, the terminal may download a note print program by connecting to the server through the internet. Here, the server which provides a program may be the same as or different from a server 300 to be described below. In addition, when the storage medium is embodied in an auxiliary storage device such as a magnetic disk, an optical disk, a CD-ROM, or a DVD, it is possible to load a program by inserting the auxiliary storage device in the terminal 200.

Figure 3:
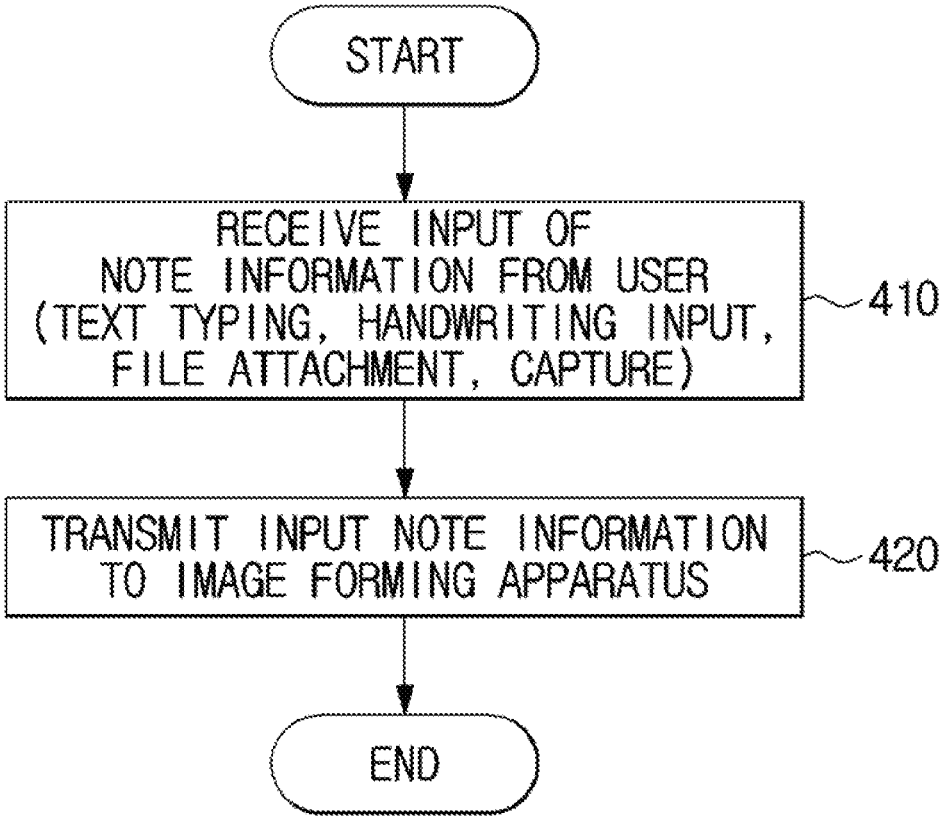
FIG. 3 is a flowchart illustrating a process in which note information input by a user is transmitted to the image forming apparatus.
Figure 4:
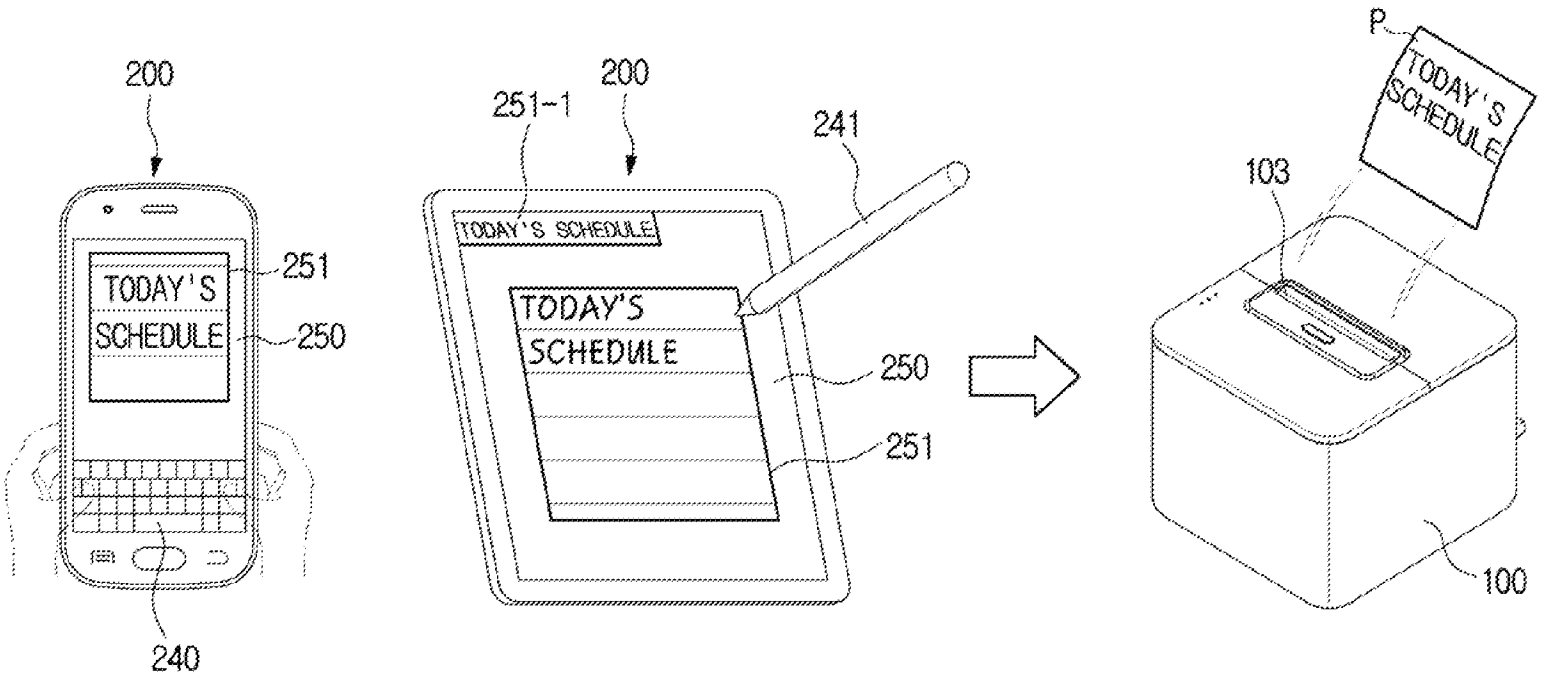
FIG. 4 is a view showing an example in which a user inputs note information using the terminal.

FIG. 3 is a flowchart illustrating a process in which note information input by a user is transmitted to the image forming apparatus, and FIG. 4 is a view showing an example in which a user inputs note information using the terminal.

Referring to FIG. 3, in a note printing method according to an embodiment, the terminal 200 receives an input of note information from a user (410). The input of note information may be made by text typing, handwriting, file attachment, screen capture, and the like.

The input note information is transmitted to the image forming apparatus (420). The image forming apparatus 100 prints and outputs the transmitted note information on an adhesive paper P.

The note printing method may be performed by an operation of at least one of the terminal 200, the image forming apparatus 100, and the server 300, or may be performed by executing a note print program recorded in a storage medium.

Hereinafter, a process in which the terminal 200 receives note information from a user will be described in detail.

A user U may input a text to be printed through the input unit 240. For example, as illustrated in FIG. 4, the user may perform typing using the input unit 240 such as a touch panel. According to a type of the terminal 200, it is possible to use an input unit such as a keyboard or a mouse. A text input by the user U may be displayed on a region 251-1 of the note window 251 displayed on the display unit 250, and the user U may confirm the text input by himself/herself through the note window 251.

In addition, when the terminal 200 may recognize handwriting of a user, a user may input contents such as a text or an image into the note window 251 displayed on the display unit 250 using a writing instrument 241. In this case, the display unit 250 may be embodied as a touch screen, and the writing instrument 241 may be embodied as an electronic pen or a touch pen.

Moreover, the input unit 240 may be embodied as a microphone which receives a user's voice. In this case, the user utters a text to be printed and inputs the text by voice, and the control unit 230 may recognize the input voice according to a voice recognition algorithm. The recognized voice is converted into a text and displayed in the note window 251, and a user deletes a displayed text and re-inputs a voice when the displayed text is not intended.

When a user input is completed, the communication unit 210 of the terminal 200 transmits print data input by a user to the communication unit 110 of the image forming apparatus 100, and the control unit 130 of the image forming apparatus 100 controls so that the printing unit 140 prints the print data of the user on an adhesive paper P. A text input through the terminal 200 by a user is printed on the adhesive paper P and is output through an outlet 103 of the image forming apparatus 100.

Figure 5A:
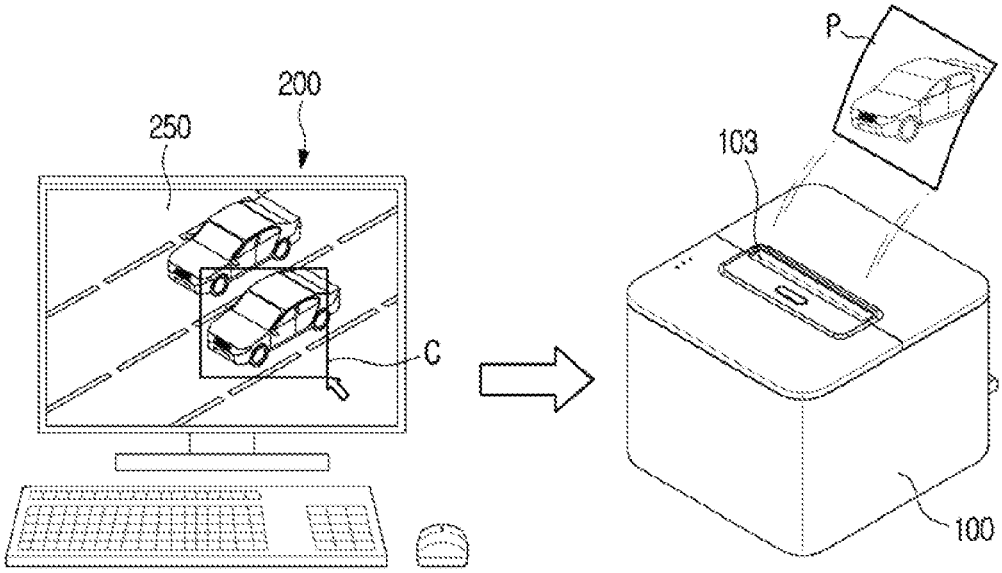
FIGS. 5A and 5B are views showing examples in which a user inputs note information using a terminal.
Figure 5B:
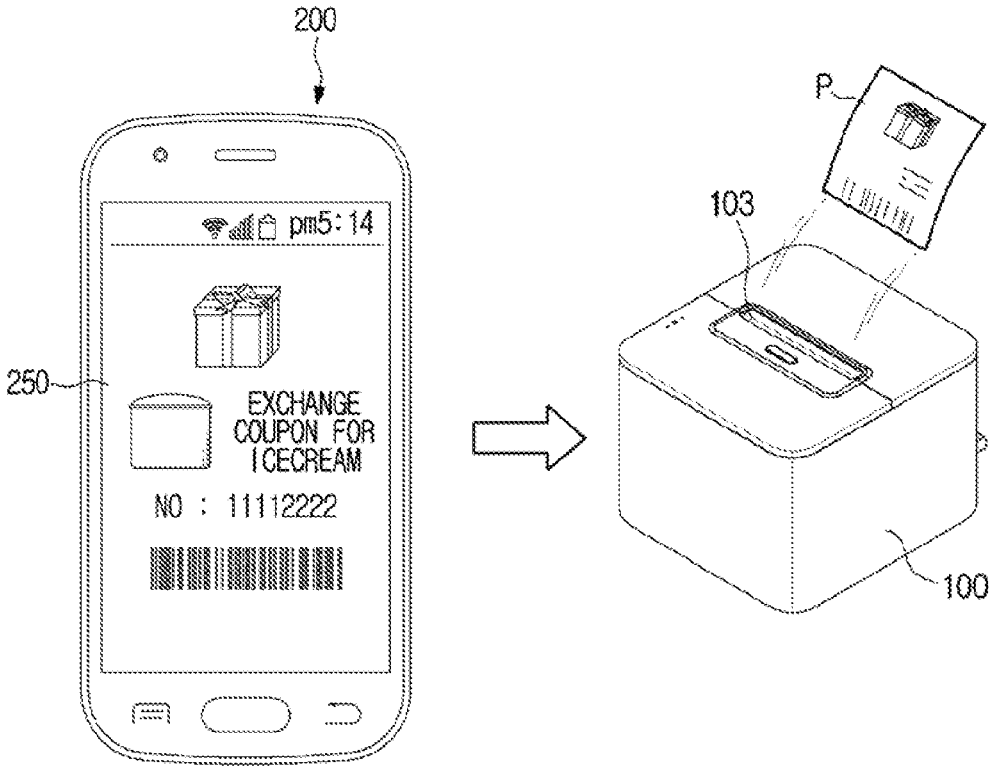

FIGS. 5A and 5B are views showing examples in which a user inputs note information using the terminal.

A user may input note information not only by newly typing or uttering contents to be printed but also by capturing contents such as an image or a text already displayed on the display unit 250.

Specifically, as illustrated in FIG. 5A, when a user sets a region to be printed by operating the input unit 240, the region is captured, the communication unit 210 of the terminal 200 may transmit contents included in a captured region C to the communication unit 110 of the image forming apparatus 100, and the printing unit 140 may print the contents on an adhesive paper P and outputs the paper through the outlet 103.

Alternatively, as illustrated in FIG. 5B, it is possible to capture a full-screen displayed on the display unit 250 and to print the captured full-screen using the image forming apparatus 100.

The use of a capture function, when sending and receiving a coupon on-line as illustrated in FIG. 5B, allows a coupon not only to be sent and received on-line but also to be easily output and attached to a desk of a recipient, thereby creating a feeling of giving and receiving a real gift. When using the coupon, even if a coupon screen is not displayed by operating the terminal 200 at a place of use, it is easy to use a coupon when having the output paper P.

Figure 6:
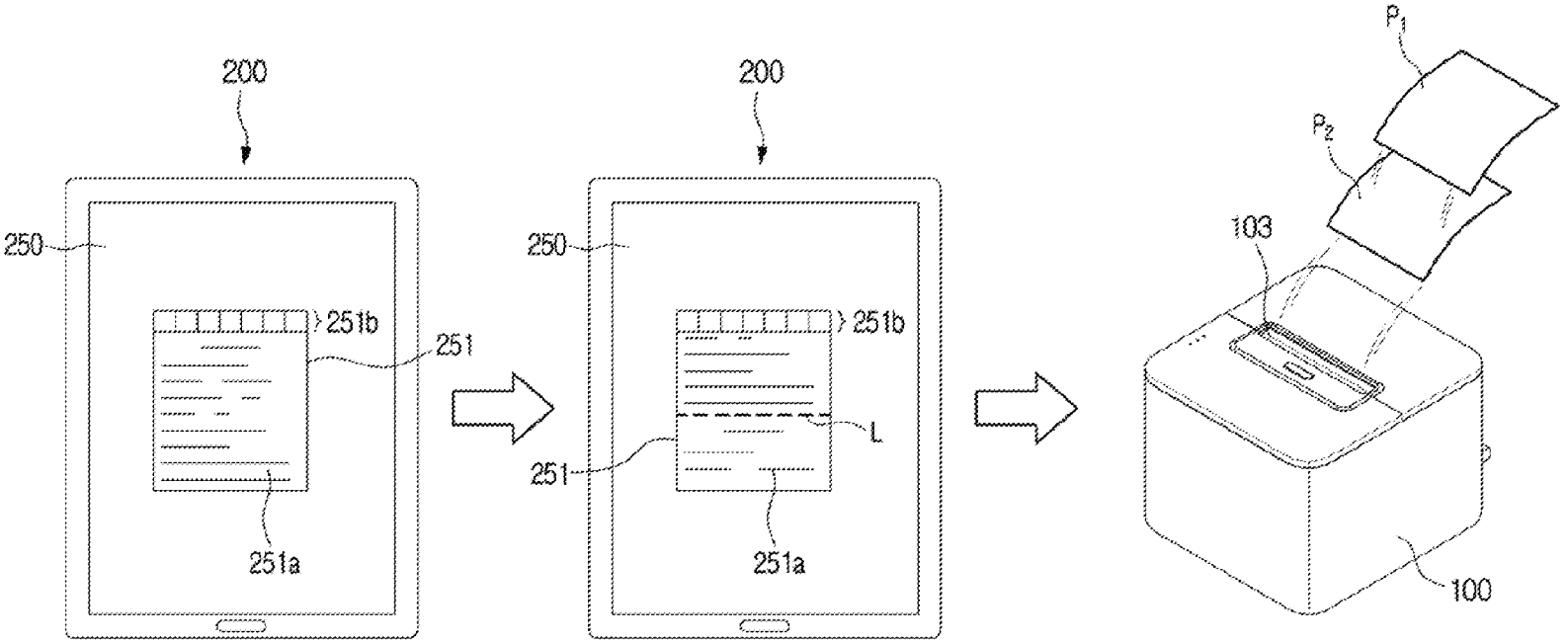
FIG. 6 is a view showing an example that provides feedback on an operation of switching to a next page when a paper size is fixed.

FIG. 6 is a view showing an example that provides feedback on an operation of switching to a next page when a paper size is fixed.

A size of a paper P output through the image forming apparatus 100 may be fixed. When a user creates a note by inputting a text in a note region 251*a* and a length of the input text exceeds a capacity of one page of the paper P, as illustrated in FIG. 6, the control unit 230 may inform a user that a page is switched to a next page by displaying a dotted line L for separating a previous page from a next page in the note region 251*a*.

Alternatively, the control unit 230 may also inform a user that a page is switched to a next page by displaying that a page filled in the note window 251 or the note region 251*a* is turned over to a next page and by displaying the new page.

Figure 7A:
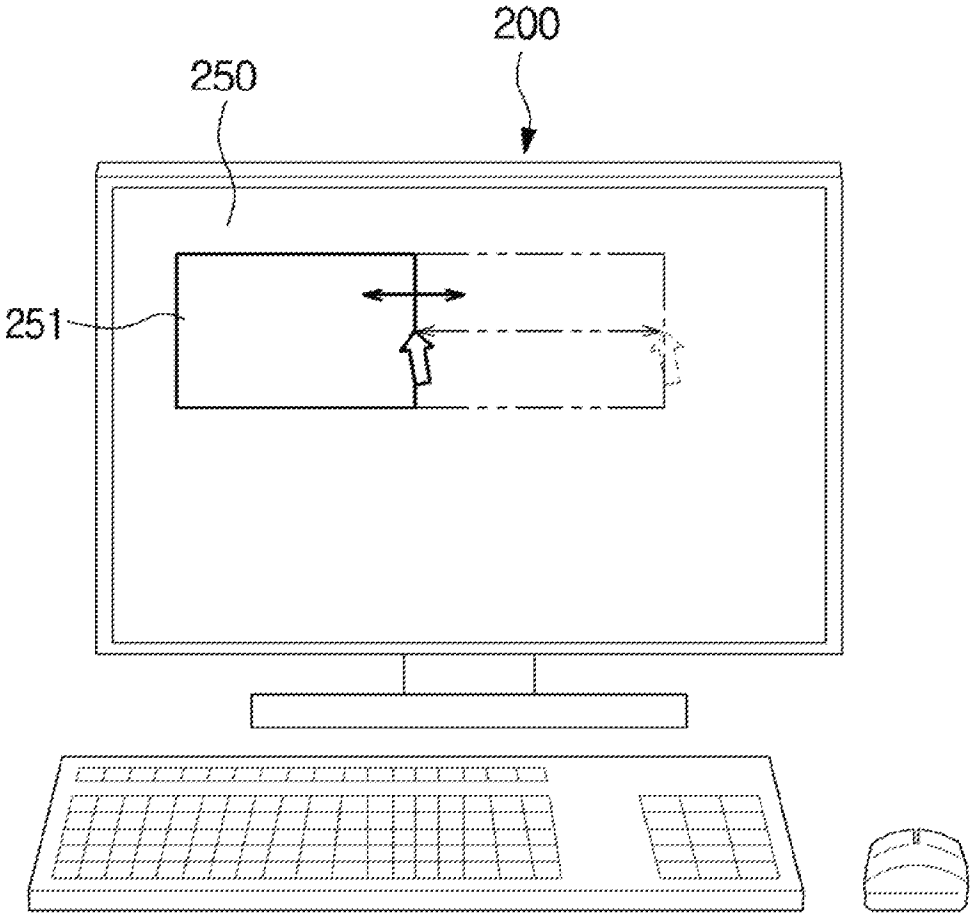
FIGS. 7A and 7B are views showing examples of a screen for receiving a selection of a paper size by a user when a paper size may be adjusted by a user.
Figure 7B:
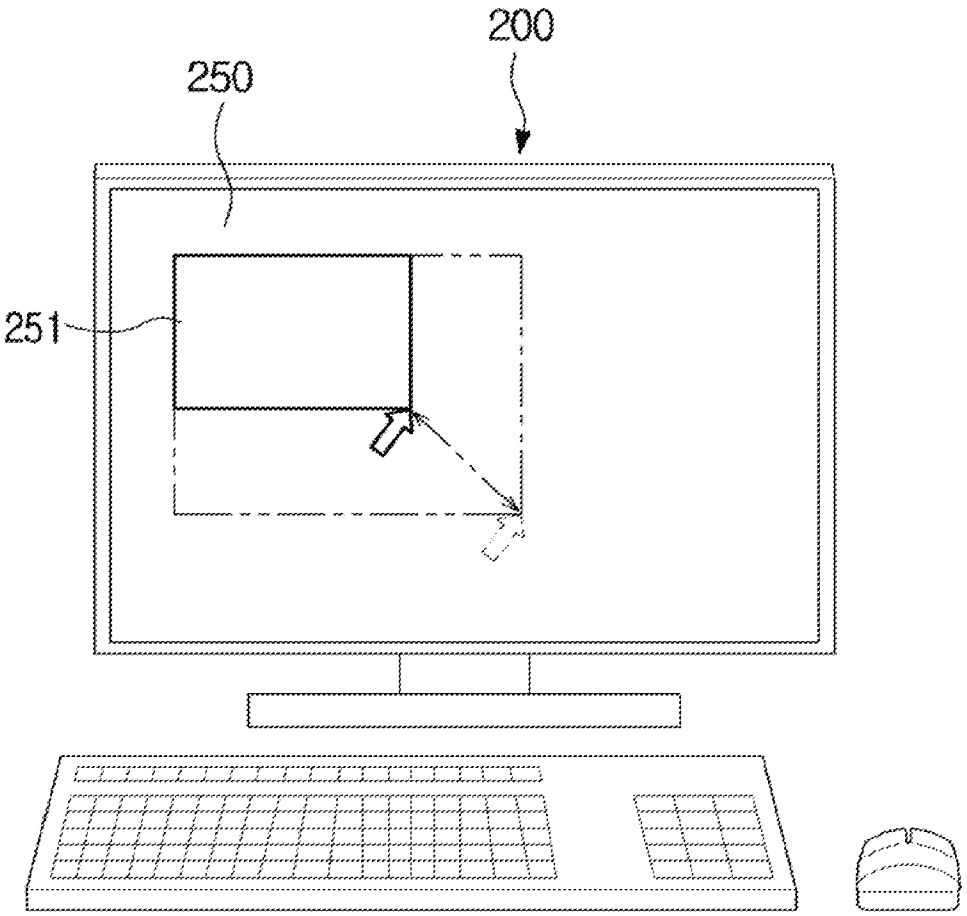
Figure 8:
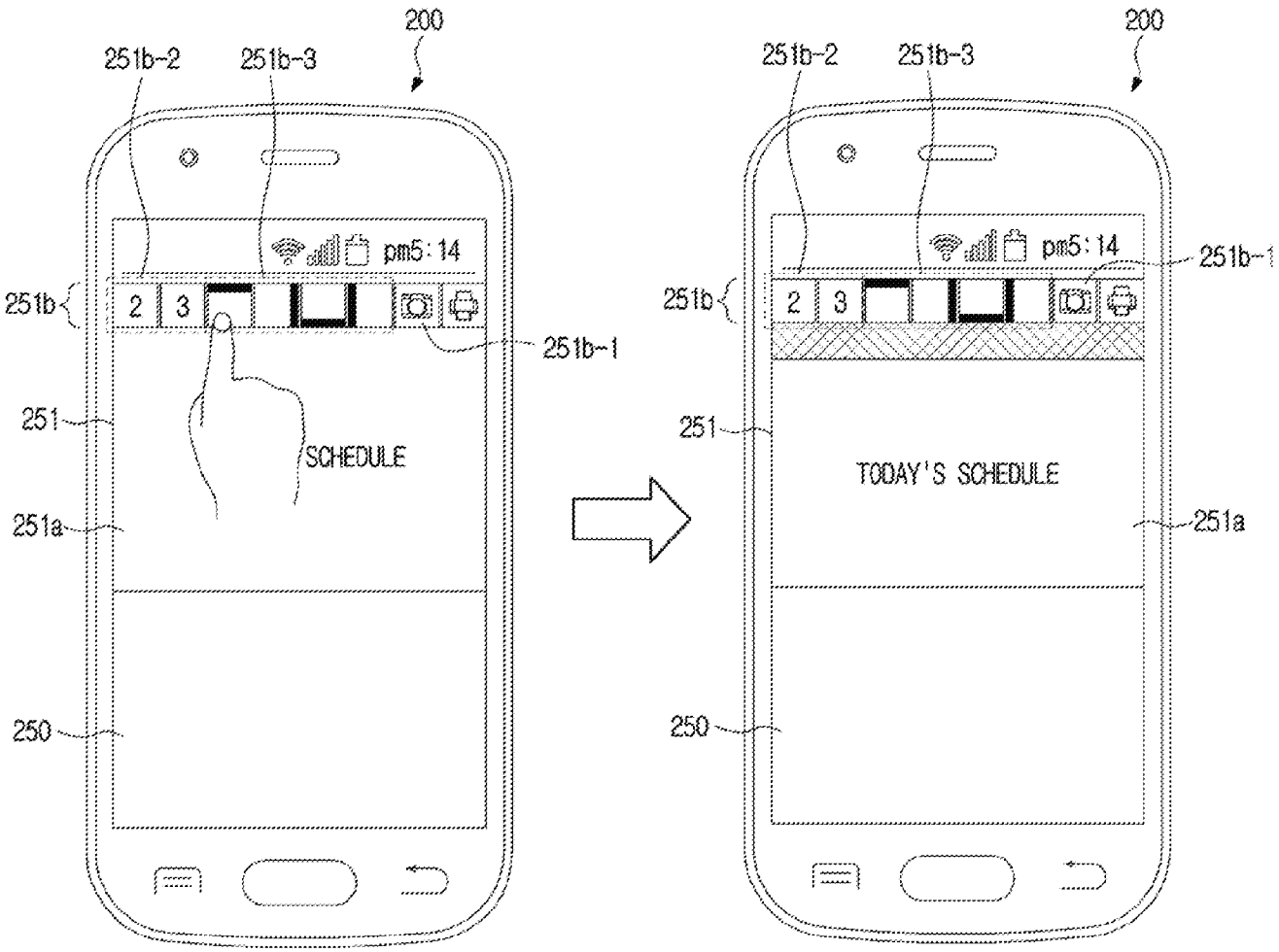
FIGS. 8 and 9 are views respectively showing an example of receiving a selection of a position of an adhesive region.
Figure 9:
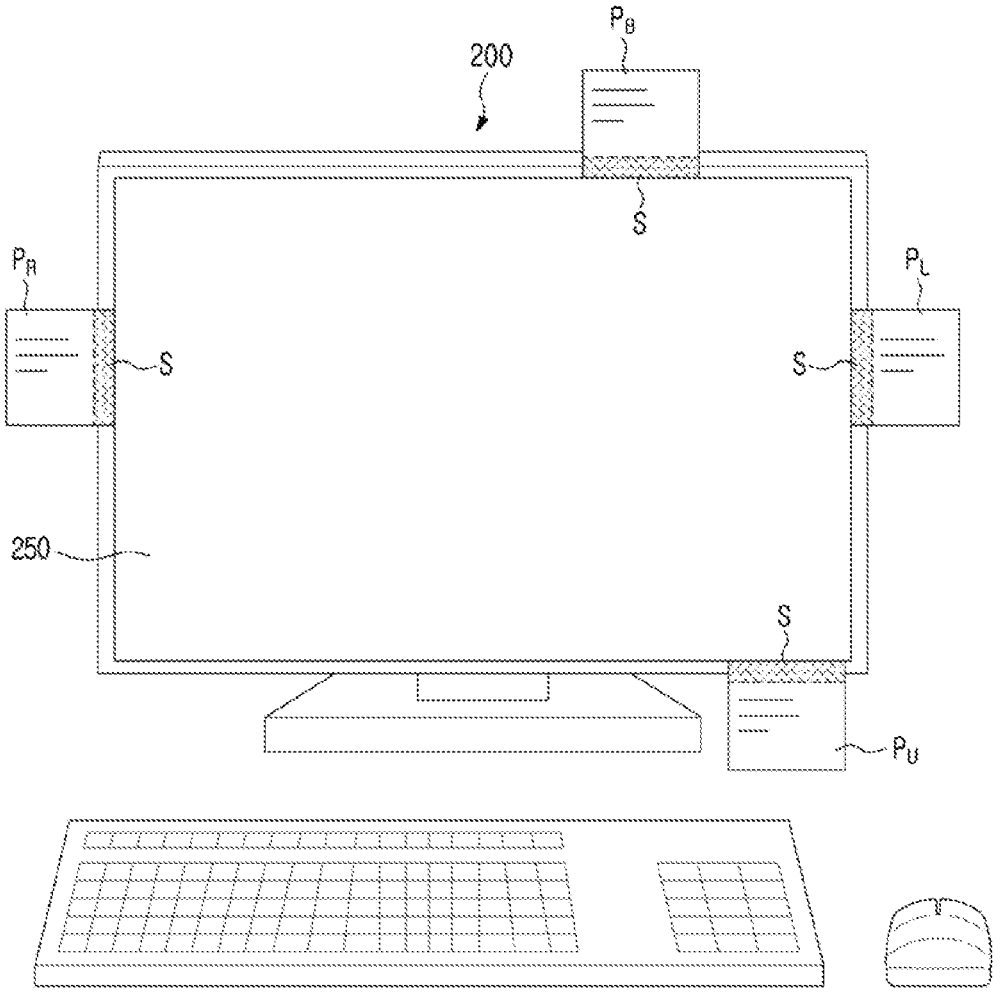

FIGS. 7A and 7B are views showing examples of a screen for receiving a selection of a paper size by a user when a paper size may be adjusted by a user, and FIGS. 8 and 9 are views showing an example of receiving a selection of a position of an adhesive region.

A size of the paper P output through the image forming apparatus 100 may be adjusted by a user. To this end, when a selection of a paper size by a user is input to the terminal 200, the terminal 200 transmits the selection by a user to the image forming apparatus 100. The control unit 130 of the image forming apparatus 100 may control a cutter so as to cut a paper P according to a size selected by a user when cutting the paper P by controlling the cutter.

As illustrated in FIG. 7A, a user may select a length of the paper P by dragging an edge of the note window 251 in a transverse direction (e.g., left to right).

Alternatively, as illustrated in FIG. 7B, a user may select a size of the paper P by dragging a vertex of the note window 251 in a diagonal direction. In this case, the image forming apparatus 100 accommodates a plurality of papers having different widths, and uses a paper having a width of a size selected by a user in printing.

In a case of FIG. 7A, it is possible to provide feedback on a selectable size of the paper P when a user drags the note window 251. A selectable size of the paper P may be determined by a width of the plurality of papers accommodated by the image forming apparatus 100. For example, when a size of the paper P selected by dragging the vertex of the note window 251 by a user is not a size supported in the image forming apparatus 100, that is, when the selected size of the paper P does not correspond to a width of the paper P accommodated by the image forming apparatus 100, the vertex of the note window 251 is moved not to a position at which a user dropped the vertex but to a position corresponding to a selectable size of a paper, and thereby it is possible to provide feedback on the selectable size. When a size selected by a user is close to a selectable size smaller than the selectable size, the vertex of the note window 251 may be moved to a position corresponding to the smaller selectable size, and when a size selected by a user is close to a larger selectable size, the vertex of the note window 251 may be moved to a position corresponding to the larger selectable size.

Alternatively, as illustrated in FIG. 8, a plurality of icons 251*b*-2 for selecting a size of the paper P are included in a tool bar 251*b* and a user selects an icon corresponding to a desired size among the plurality of icons 251*b*-2, and thereby a size of the paper may be selected.

Alternatively, it is also possible to directly receive numerical information on a size of the paper P from a user.

The image forming apparatus 100 may perform printing by adjusting a position of an adhesive region S according to a selection by a user. To be exact, it is possible to adjust a printing direction of contents with respect to the adhesive region S of the paper P. Based on the printing direction of contents, a position of the adhesive region S may be selected to be one of the top, the bottom, the left side, and the right side of the paper P. When the position of the adhesive region S is selected to be the top of the paper P, the printing unit 140 prints contents toward the opposite direction of the adhesive region S, and when the position of the adhesive region S is selected to be the bottom of the paper P, the printing unit 140 prints the contents toward the adhesive region S. When the position of the adhesive region S is selected to be the left side of the paper P, the printing unit 140 places the adhesive region S on the left side and prints the contents in a direction in which the adhesive region S is formed, and when the position of the adhesive region S is selected to be the right side of the paper P, the printing unit 140 places the adhesive region S on the right side and prints the contents in a direction in which the adhesive region S is formed.

As illustrated in FIG. 8, the tool bar 251*b* may include an icon set 251*b*-3 for selecting a position of an adhesive region, and a user may select an icon corresponding to a desired position of the adhesive region among the icon set 251*b*-3. When a user selects a position of the adhesive region, the display unit 250 may provide feedback on the selected position of the adhesive region. For example, the selected position of the adhesive region S may be displayed in the note region 251*a* as illustrated in the right side of FIG. 8.

Information on the selected position of the adhesive region S and print data may be transmitted to the image forming apparatus 100.

The image forming apparatus 100 performs printing on the paper P by adjusting a position of the adhesive region S according to a selection by a user. As in the example of FIG. 9, when the adhesive paper is attached to the display unit 250 to be used, a paper $P_B$ having the adhesive region formed at the bottom may be attached at the top of the display unit 250, a paper $P_U$ having the adhesive region formed at the top may be attached to the bottom of the display unit 250. Moreover, a paper $P_L$ having the adhesive region S formed at the left side may be attached to the right side of the display unit 250, and a paper $P_R$ having the adhesive region S formed at the right side may be attached to the left side of the display unit 250.

In this manner, when performing printing by adjusting a position of the adhesive region S according to a selection of a user, the paper P may be attached to an appropriate position according to user's convenience.

Figure 10:
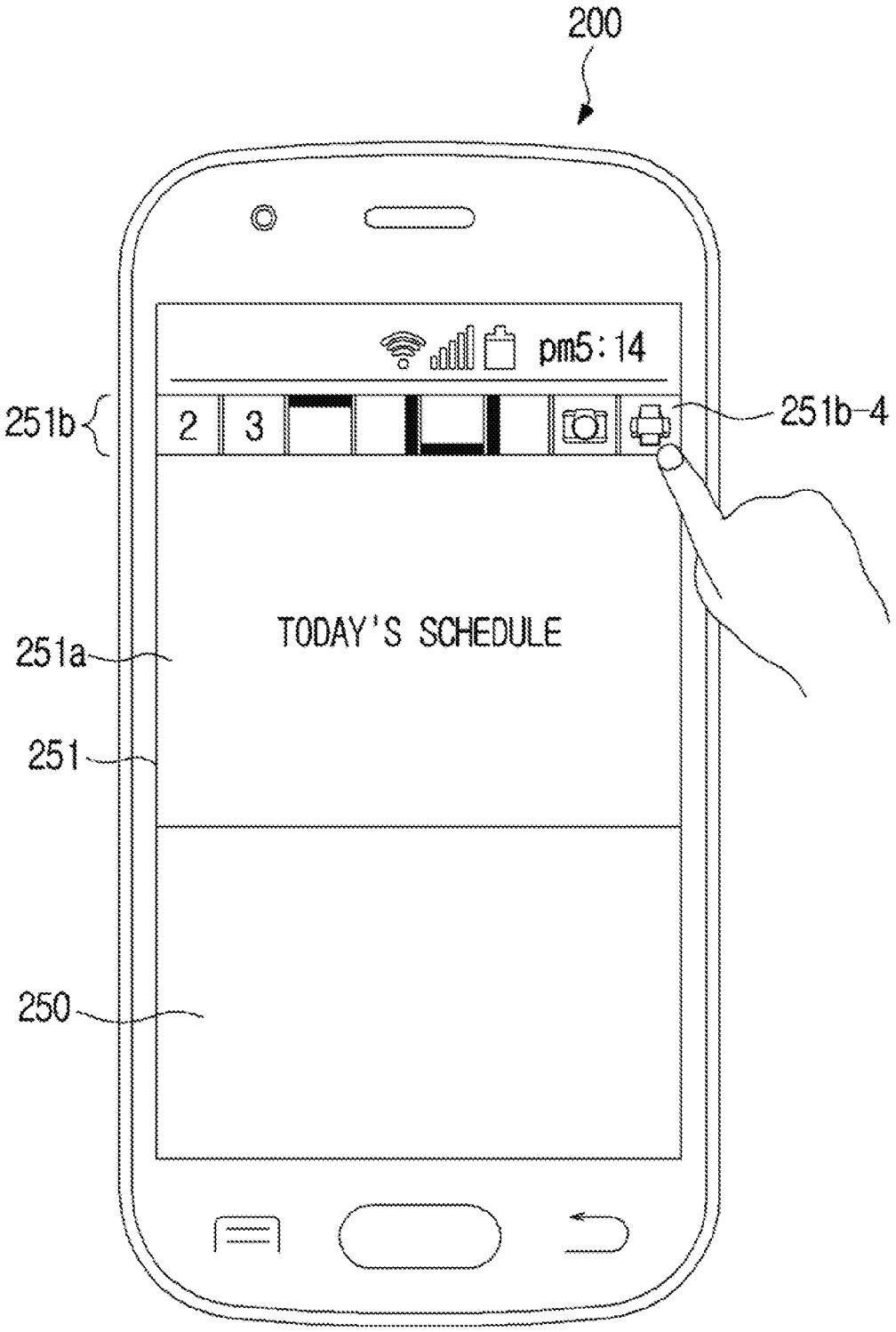
FIGS. 10 and 11 are views respectively showing an example of receiving a print command of a note from a user.
Figure 11:
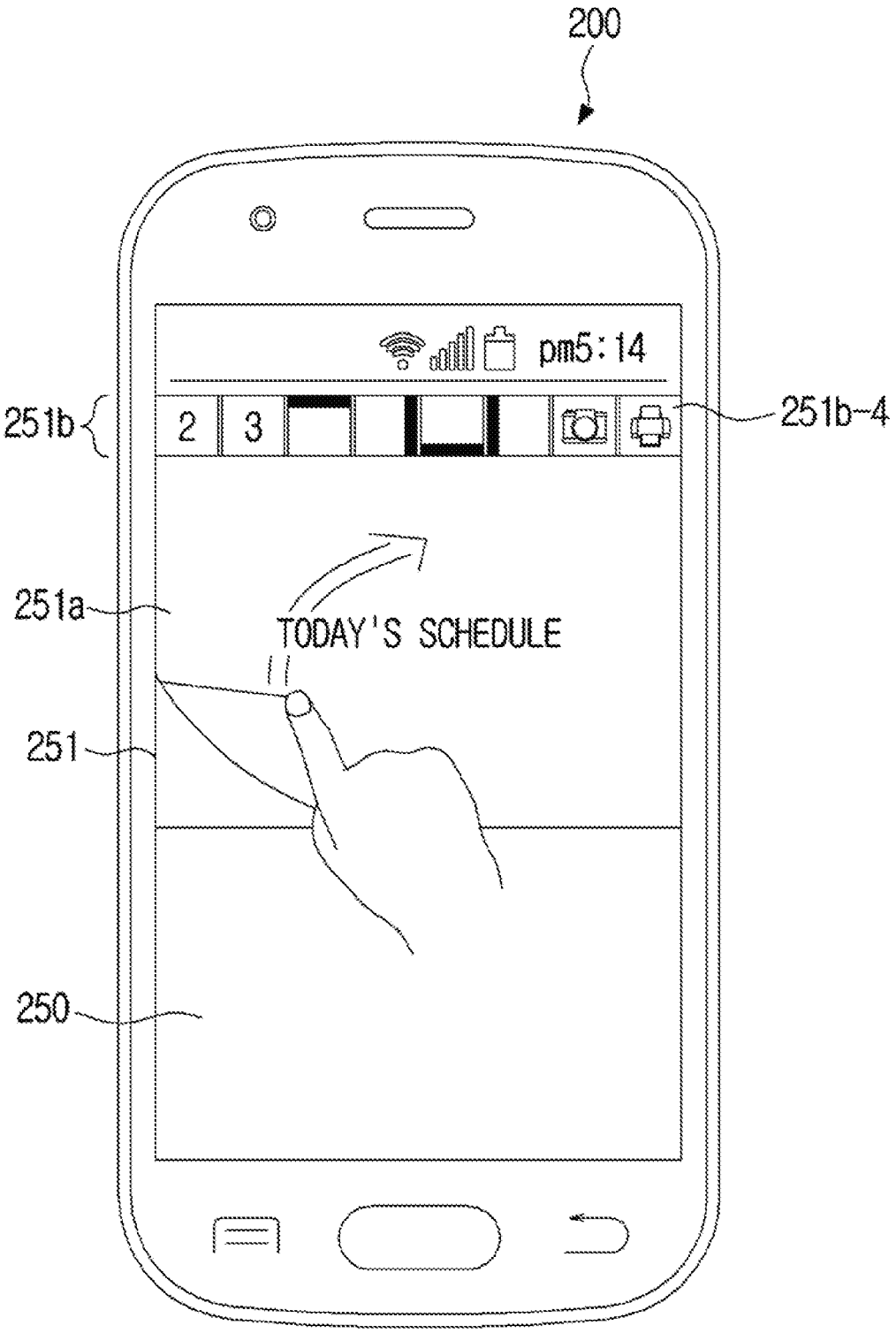

FIGS. 10 and 11 are views respectively showing an example of receiving a print command of a note from a user.

As illustrated in FIG. 10, when a print icon 251*b*-4 is included in the tool bar 251*b* and a user selects the print icon 251*b*-4 to request printing, note information created by a user may be transmitted to the image forming apparatus 100 as print data along with a print command. As described above, it is possible to transmit information on a paper size and a position of the adhesive region selected by a user together.

Alternatively, when the note region 251*a* is touched or a bottom left vertex of the note region 251*a* is touched to be dragged upward or to be swiped as if turning over a page, it is possible to provide a visual effect that a new note region 251*a* is displayed as if a page is turned over while the vertex of the note region 251*a* also moves in a direction of dragging by a user and to transmit print data and a print command to the image forming apparatus 100. At this time, created note information may be automatically stored in the terminal 200 or a server connected to the terminal 200.

Hereinafter, a method of inputting note information using the terminal 200 by a user will be described in more detail.

Figure 12:
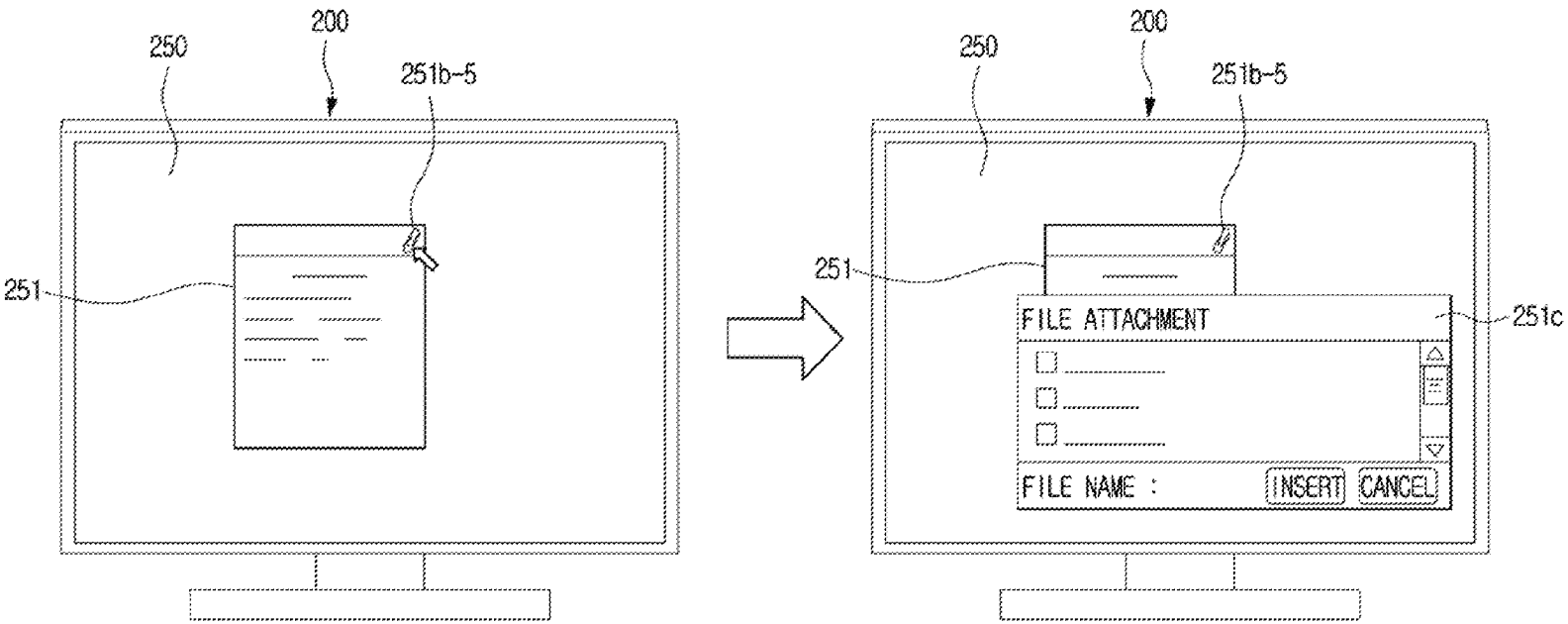
FIGS. 12 and 13 are views respectively showing a method of generating a note by attaching a file stored in the terminal.
Figure 13:
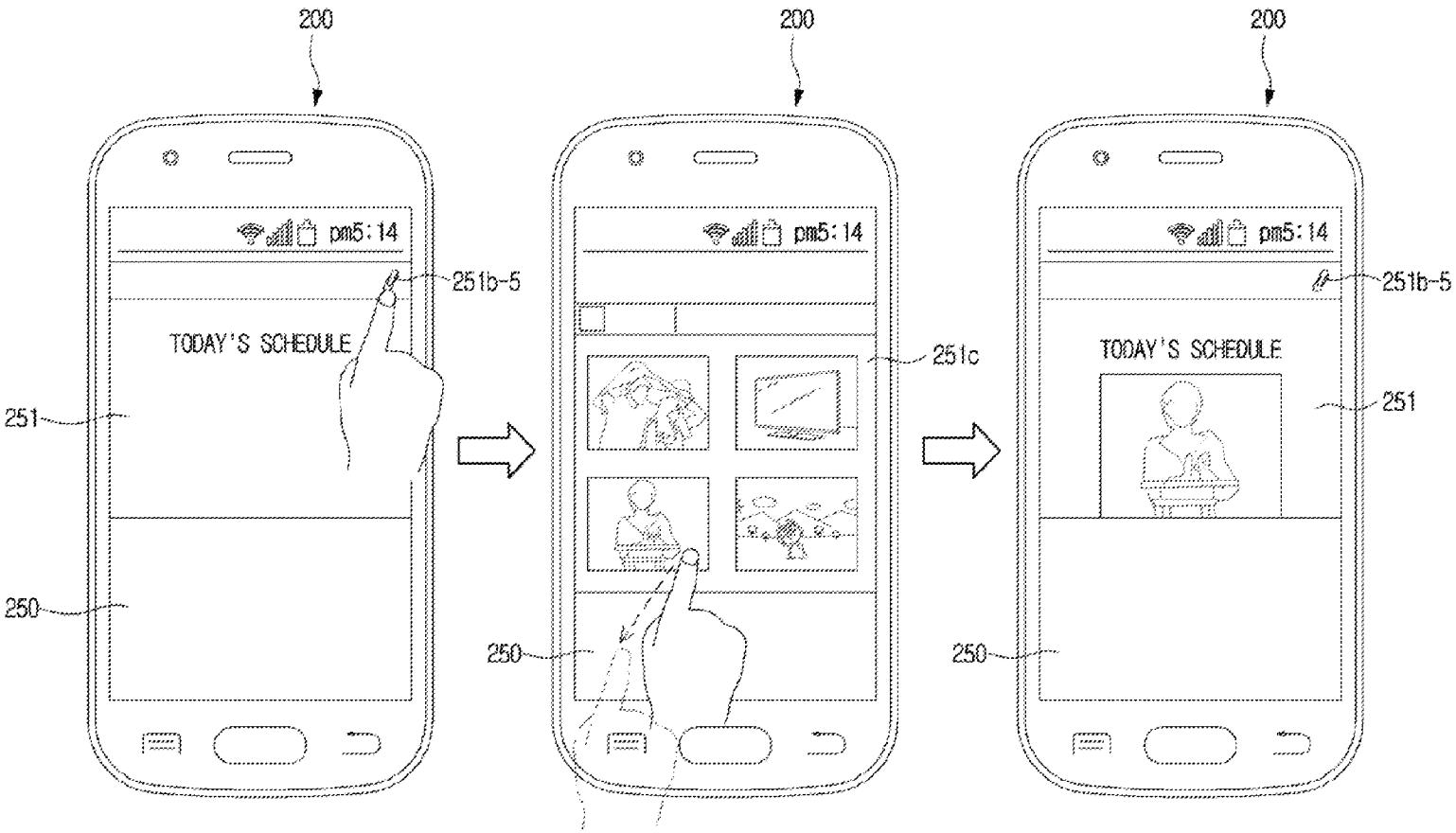

FIGS. 12 and 13 are views respectively showing a method of generating a note by attaching a file stored in the terminal.

An example in FIG. 12 is a case when the terminal 200 is a personal computer. As illustrated in FIG. 12, when an attached icon 251*b*-5 displayed in the note window 251 is clicked and selected, an attached list 251*c* for selecting a file stored in the storage unit 220 of the terminal 200 may be displayed. When a user selects a file to be attached to the note window 251 among files displayed in the attached list 251*c*, the selected file may be attached to the note window 251. The attached file may be an image file or a text file.

An example in FIG. 13 is a case in which the terminal 200 is a mobile device such as a smart phone or a tablet PC. Referring to FIG. 13, the attached icon 251*b*-5 may be displayed on the top of the note window 251. The attached icon 251*b*-5 may be fixed as a component of the tool bar 251*b* as in the example described above, but may be dragged and moved by a user as in the example in FIG. 13. When the attached icon 251*b*-5 on the top is dragged and dropped in the note region 251*a*, a file attachment function may be activated and the attached list 251*c* for selecting a file stored in the terminal 200 may be displayed.

For example, an album folder in which image files captured by a capturing unit 260 of the terminal 200 or received from an external device or external server are stored may be displayed in a thumbnail format which allows users to immediately check an image as illustrated in FIG. 13.

When a user drags a desired file among a list of image files displayed in the thumbnail format and drops the file in the note region 251*a*, the image file may be attached to the note window 251.

Figure 14:
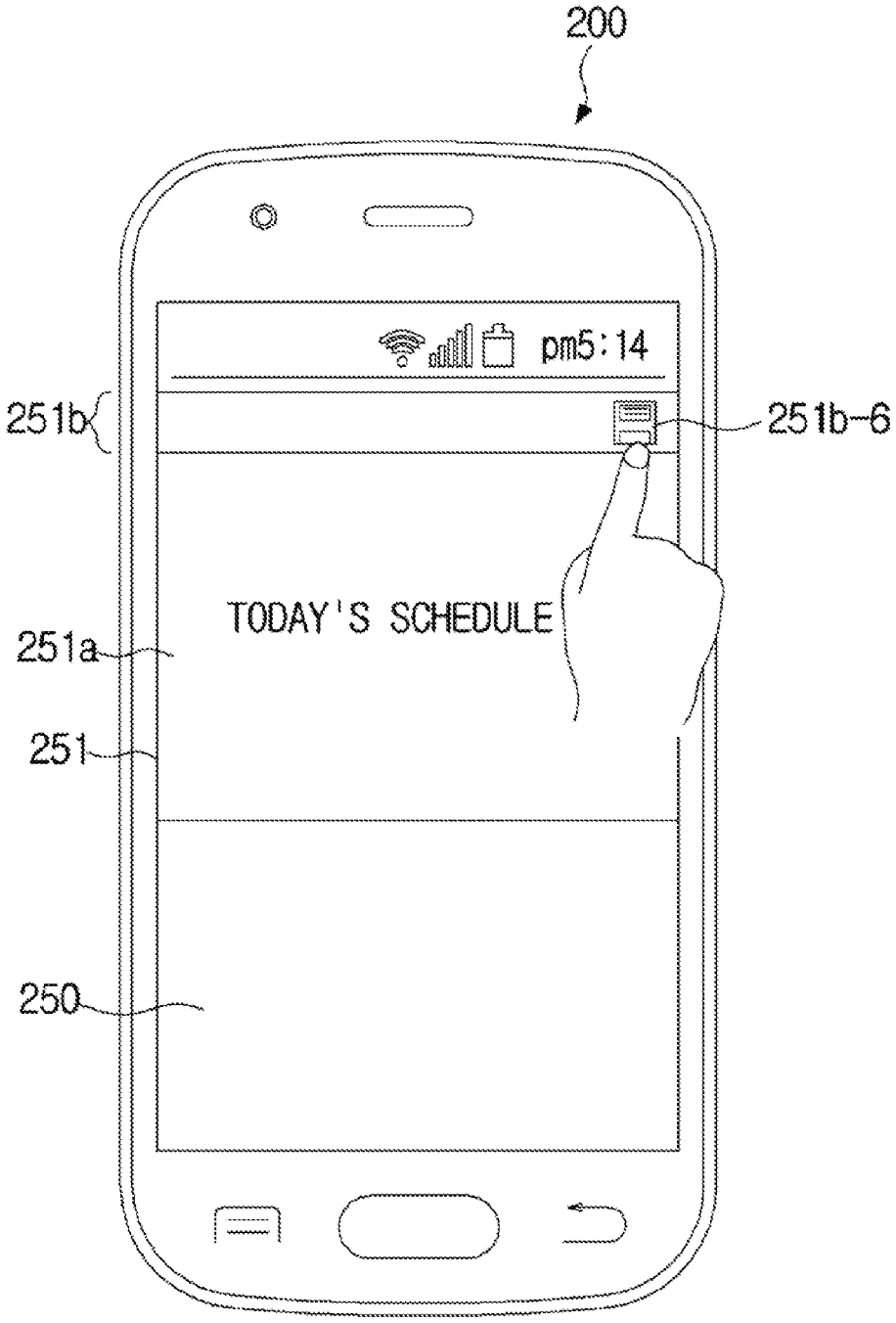
FIG. 14 is a view showing an operation of storing a created note.

FIG. 14 is a view showing an operation of storing a created note.

When a user finishes creating a note, the user may store the created note by selecting a storage icon 251*b*-6 displayed at the top of the note window 251 with a touch or a click as illustrated in FIG. 14. The created note may be stored in the storage unit 220 of the terminal 200 or may be stored in a server connected to the terminal 200 through the internet.

On the other hand, the stored note may be automatically transmitted to the image forming apparatus 100 and a user may separately select a note to be printed among the stored notes. In the latter case, an icon for displaying a note list which is not shown in a drawing but is stored, may be included in the tool bar 251*b*, and the stored note list is displayed when a user selects the icon, and thereby the user may select a note to be printed. When a note to be printed is selected, the selected note may be displayed in the note region 251*a*, and when a user selects a print icon 251*b*-4 in the tool bar 251*b*, the selected note is transmitted to the image forming apparatus 100 and is printed on an adhesive paper P.

Moreover, when the print icon 251*b*-4 is selected or a print command is input by touching or dragging the note region 251*a* after creating a note, the created note may be immediately transmitted to the image forming apparatus 100 without being stored in the terminal 200 or a server, and may also be automatically stored.

Figure 15:
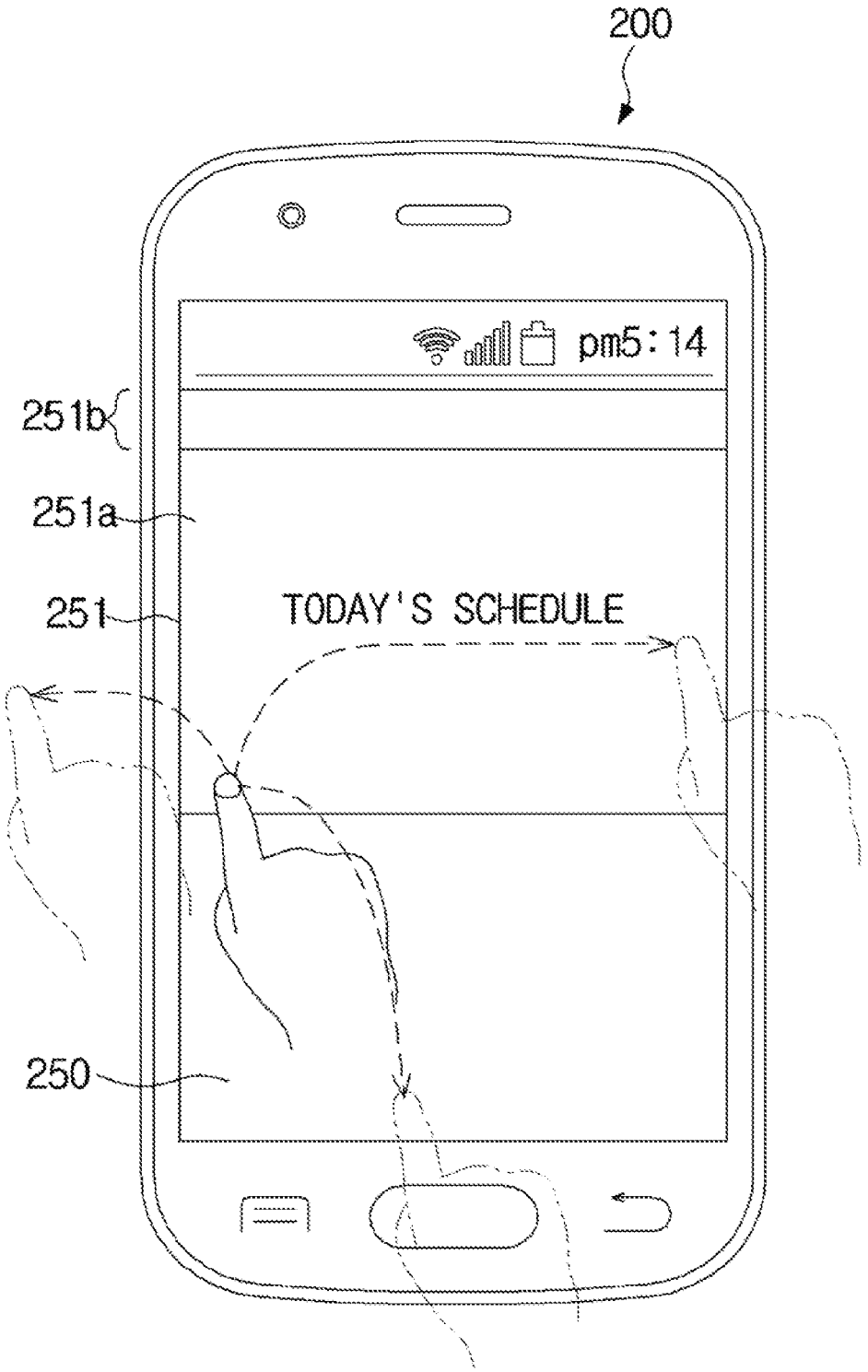
FIG. 15 is a view showing an example in which a touch operation of a user is mapped to a specific function related to a note generation and a note printing.

FIG. 15 is a view showing an example in which a touch operation of a user is mapped to a specific function related to a note creation and a note printing.

As described above, it is possible to map the function related to a note creation and a note printing to an icon included in the tool bar 251*b*, but separately, it is also possible to execute a desired function only with a simple touch operation by mapping a touch operation of a user to a specific function. In this case, the display unit 250 of the terminal 200 is embodied in a touch screen, and the terminal 200 is described as a smart phone including the touch screen in the example of FIG. 15.

As illustrated in FIG. 15, created note information may be only stored when a bottom left vertex of the note region 251*a* is touched and dragged to the right side. That is, it is possible to map an operation of dragging the bottom left vertex of the note region 251*a* to a function of storing note information.

In addition, a stored note list may be displayed when the bottom left vertex of the note region 251*a* is touched and dragged to the left side. That is, it is possible to map an operation of dragging the bottom left vertex of the note region 251*a* to the left side to a function of displaying a note list.

Moreover, the note may be deleted when the bottom left vertex of the note region 251*a* is touched and dragged to the lower side. That is, it is possible to map an operation of dragging the bottom left vertex of the note region 251*a* to the lower side to a function of deleting a note.

FIG. 15 shows an example of receiving a simple touch command and executing a specific function corresponding thereto to improve handling convenience of a user. Icons corresponding to each of functions such as storage of a note, display of a note list, and deletion of a note are included in the tool bar 251*b*, and a user may select a desired operation between an icon selection in the tool bar 251*b* and an input of a touch command.

In addition, it is also possible to display the tool bar 251*b* only when a user wants. For example, the tool bar 251*b* is displayed when dragging the top of the note window 251 in which the tool bar 251*b* is displayed to the left side, and the tool bar 251*b* may disappear when dragging the top of the note window 251 to the right side. Hereinafter, another example will be described referring to FIG. 16.

Figure 16:
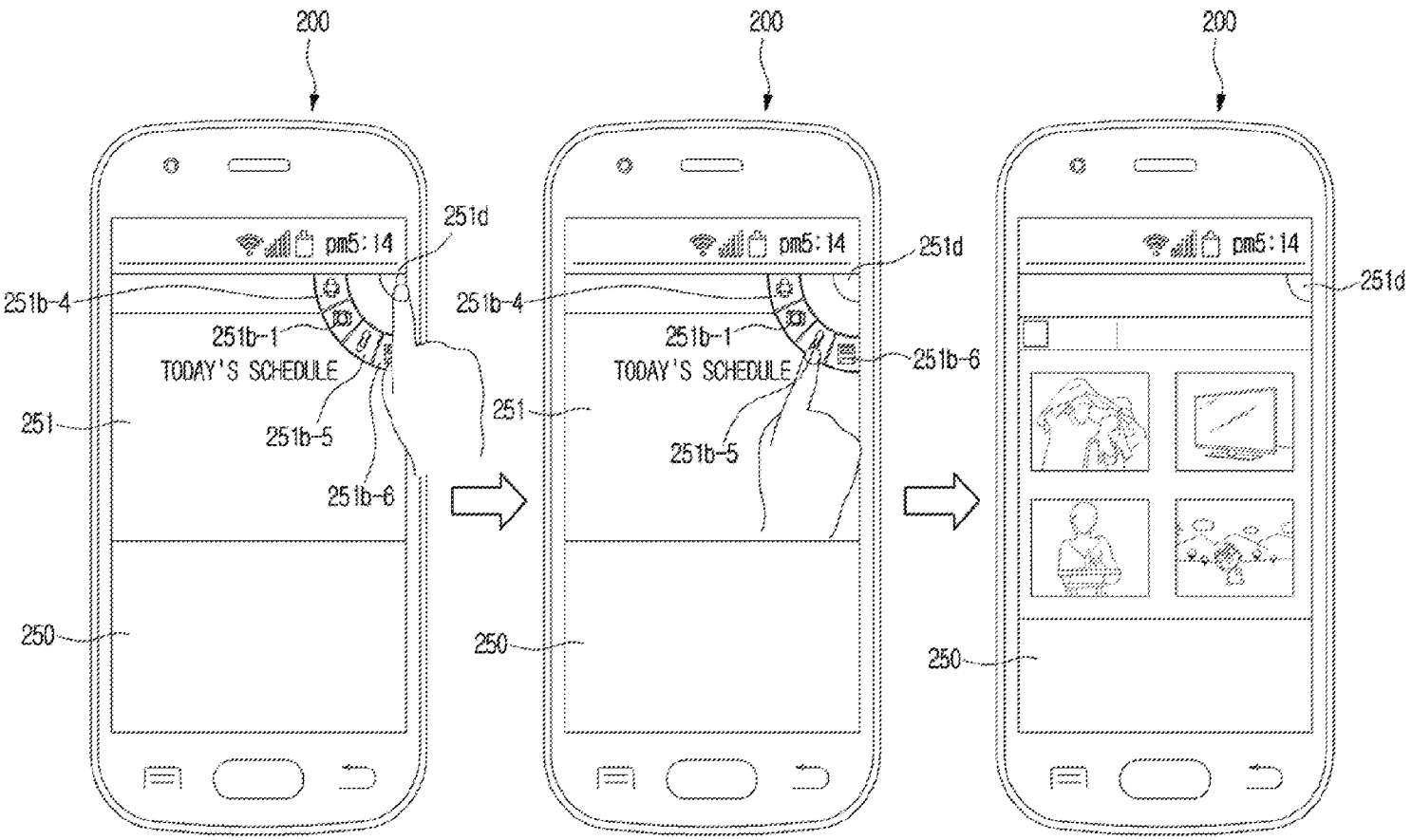
FIG. 16 is a view showing another example of displaying a selectable function list.

FIG. 16 is a view showing another example of displaying a selectable function list.

According to another example, it is possible to display a function selection icon 251*d* for selecting a function on the top right of the note window 251 as illustrated in FIG. 16. When the function selection icon 251*d* is selected, icons corresponding to each of selectable functions are displayed in the vicinity of the function selection icon 251*d*. For example, an attachment icon 251*b*-5, a storage icon 252*b*-6, a print icon 251*b*-4, a capturing icon 251*b*-1, and a deletion icon 251*b*-7 may be displayed. A user may select an icon corresponding to a desired function among the displayed icons, and may execute a file attachment function when selecting the attachment icon 251*b*-5 as in an example of FIG. 16.

In the above description, an example of a screen displayed on the terminal to receive note information from a user is described. Hereinafter, another example of the screen displayed on the terminal 200 will be described in FIG. 17.

Figure 17:
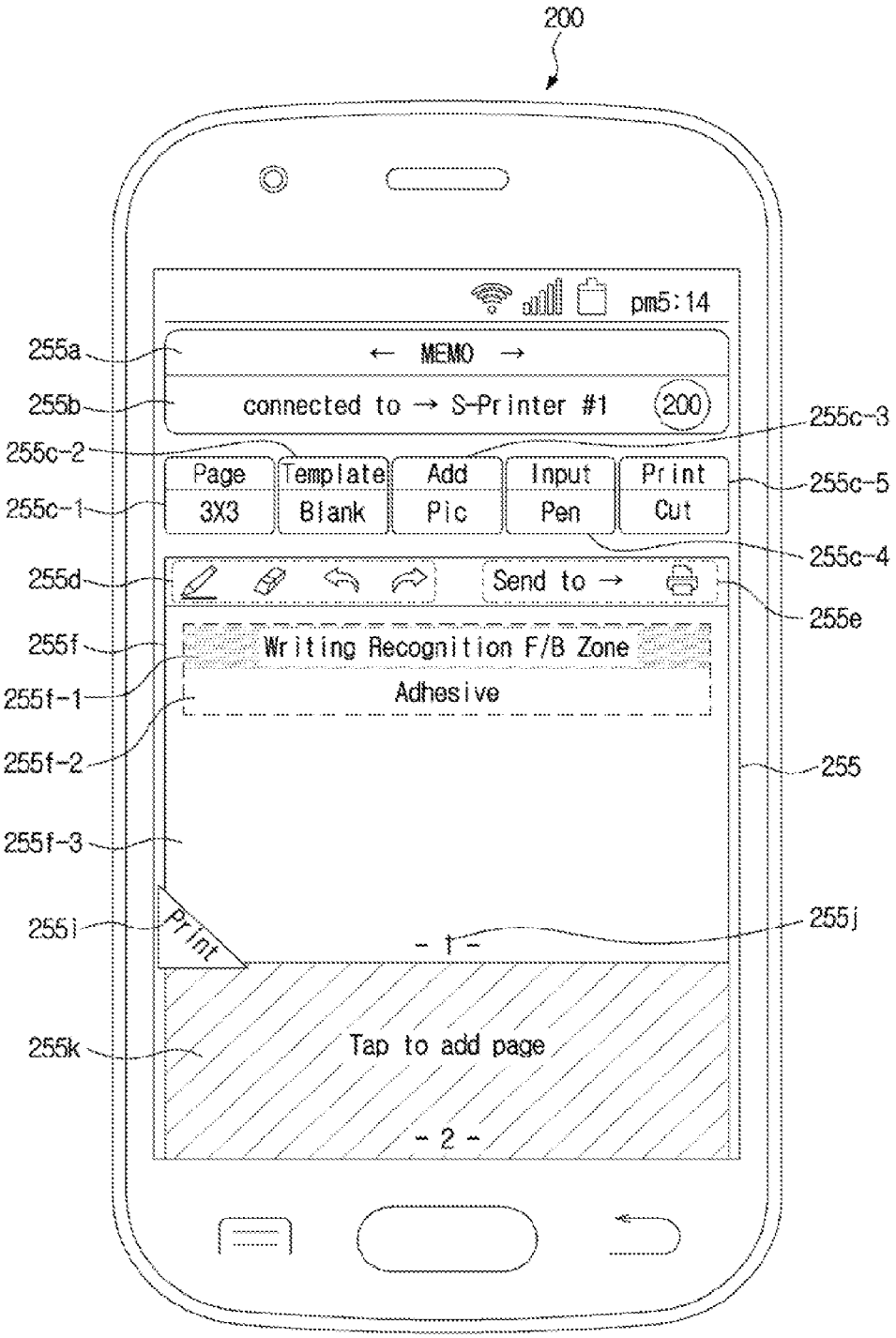
FIG. 17 is a view showing another example of the screen displayed on the terminal.

FIG. 17 is a view showing another example of the screen which allows a user to input note information in a memo mode when the terminal is a smart phone.

When a note print program is installed in the terminal 200 embodied as a smart phone, a memo mode screen 255 may be displayed as illustrated in FIG. 17 to receive note information from a user.

Referring to FIG. 17, a mode display bar 255*a* which may receive a command to change a mode while showing a current mode may be displayed at the top of the memo mode screen 255.

A mode shown in an example of FIG. 17 is a memo mode, such that a text or an image meaning the same as or similar to "memo" will be displayed in the mode display bar 255*a*. The memo mode is a mode distinguished from a conference mode to be described below, and may refer to a mode for creating a personal memo or a private office memo and printing the created memo. In the embodiment, both "memo" and "note" are terms denoting an object such as a text, an image, or a shape input by a user and there is no difference between them; however, "memo" is used instead of "note" so as to be distinguished from the conference mode in the example of FIG. 17.

On the other hand, a switch of a mode may be made by a swipe interaction or a touch operation.

A printer setting bar 255*b* for setting a printer connection may be displayed at the bottom of (below) the mode display bar 255*a*. Image forming apparatus information, that is, printer information, connected to a current terminal 200 may be displayed in the printer setting bar 255*b*, and additionally printer-related information such as a remaining amount of paper or color information of the printer may be further displayed therein. Here, the printer information may be specific information such as a MAC address or an IP address, and may also be a predetermined device name as illustrated in FIG. 17. As long as the printer information is identification information which may be identified by a user, a type of the information is not limited.

A connection method between the image forming apparatus 100 and the terminal 200 may be Bluetooth or Wi-Fi Direct. When the image forming apparatus 100 and the terminal 200 are connected to each other by Bluetooth, connection information may be updated in the terminal 200 whenever the terminal 200 is connected to the image forming apparatus by Bluetooth.

Option selection icons which may be applied to a memo input may be further displayed on the memo mode screen 255.

For example, a page setting icon 255*c*-1 may be displayed. 3×3 refers to a size of 3 inches in width and 3 inches in height; however, this is merely an example, and it is possible to use other units such as cm and mm as a basic unit. For such a unit, one unit may be set as a default value and may be changed to another unit by a user.

A page size may be set to be another size when a user touches the page setting icon 255*c*-1. For example, when the height of a paper is fixed to be 2 inches, a user may select a size such as 0.5×2, 1×2, 2×2, or 3×2, and when the height of a paper is fixed to be 3 inches, the user may select a size such as 0.5×3, 1×3, 2×3, or 4×3.

A size of the note window 251 may be changed according to a paper size selected by a user. The size of a note window 255*f* may be displayed in the same size as a size selected by a user, and a ratio of width to height may be displayed to be the same as each other.

In addition, a template setting icon 255*c*-2 is displayed. A template may refer to a pattern of a note output on a paper. A template may be provided by default, or may be generated by a user.

Template examples provided by default include a blank, a to-do list, a calendar, and the like.

Template examples generated by a user may include a template resulting from a user's editing of a template provided by default, a template newly created by a user, and the like, and the note print program may provide an editing function for a template creation. Accordingly, a tool bar for performing functions of extension/contraction, cutting, inserting, and rotation may be further displayed on the memo mode screen 255.

Either a template provided by default or a template created by a user may be set as a representative template, and a template used in a previous page or the representative template may be loaded when adding a page.

In addition, an attachment icon 255*c*-3 may be displayed. A user may attach an object such as a memo, a barcode, or a shape previously created to the note window 255*f* by selecting the attachment icon 255*c*-3.

Moreover, an input tool setting icon 255*c*-4 may be displayed. A user may select a tool to input a memo to be input to the note window 255*f* by selecting the input tool setting icon 255*c*-4. Examples of an input tool may include a pen, handwriting, a keyboard, a voice, and the like.

A print setting icon 255*c*-5 may be also displayed. For example, a user may cut each of a memo made of a plurality of pages and select whether to print the memo by selecting the print setting icon 255*c*-5.

Moreover, a main tool bar 255*d* used when inputting a memo into the note window 255*f* may be displayed. For example, a user may use tools such as underline, clear (erase), back, and forward by selecting each of icons displayed in the main tool bar 255*d*.

A transmission destination selection icon 255*e* for executing a function of selecting a destination to which a created memo is transmitted may be displayed. For example, a user may transmit a created memo to the image forming apparatus 100 to be printed, transmit the created memo to a schedule management tool, store the created memo in the storage unit 220 of the terminal 200, transmit the created memo to a cloud server, or transmit the created memo to a messenger.

When a created memo is printed on a paper to be output, a position 255*f*-1 of the adhesive region S and a feedback 255*f*-2 on a handwriting recognition result may be displayed at the top of the note window 255*f* which allows a user to input a memo.

A user may input a memo to be created into a note region 255*f*-3 using a set input tool. A current page 255*j* may be displayed at the bottom of the note region 255*f*-3.

A page addition tap region 255*k* is displayed at the lower side of the note region 255*f*-3. When a user touches the page addition tap region 255*k*, a page is turned over to a next page and the user may input a memo into the new page. At this time, a previous page is automatically stored in the storage unit 220.

As described above, when a user touches the vertex of the note window 255*f* and drags it to the upper side or in a diagonal direction or swipes it as if turning over a page, a visual effect as if a page is turned over while the vertex of the note region 251*a* also moves in a user's dragging direction may be provided and a memo may be transmitted to a set destination.

At this time, it is possible to inform a user which point to touch in order to swipe by displaying an execution icon 255*i* at the vertex of the note window 255*f*.

A screen according to the example of FIG. 17 described above is merely an example of a screen displayed on the terminal 200 in which a note print program is installed, and of course, screens of various configurations for receiving note information from a user and transmitting the information to another device such as the image forming apparatus 100 may be displayed in addition to the screen in the example.

Figure 18:
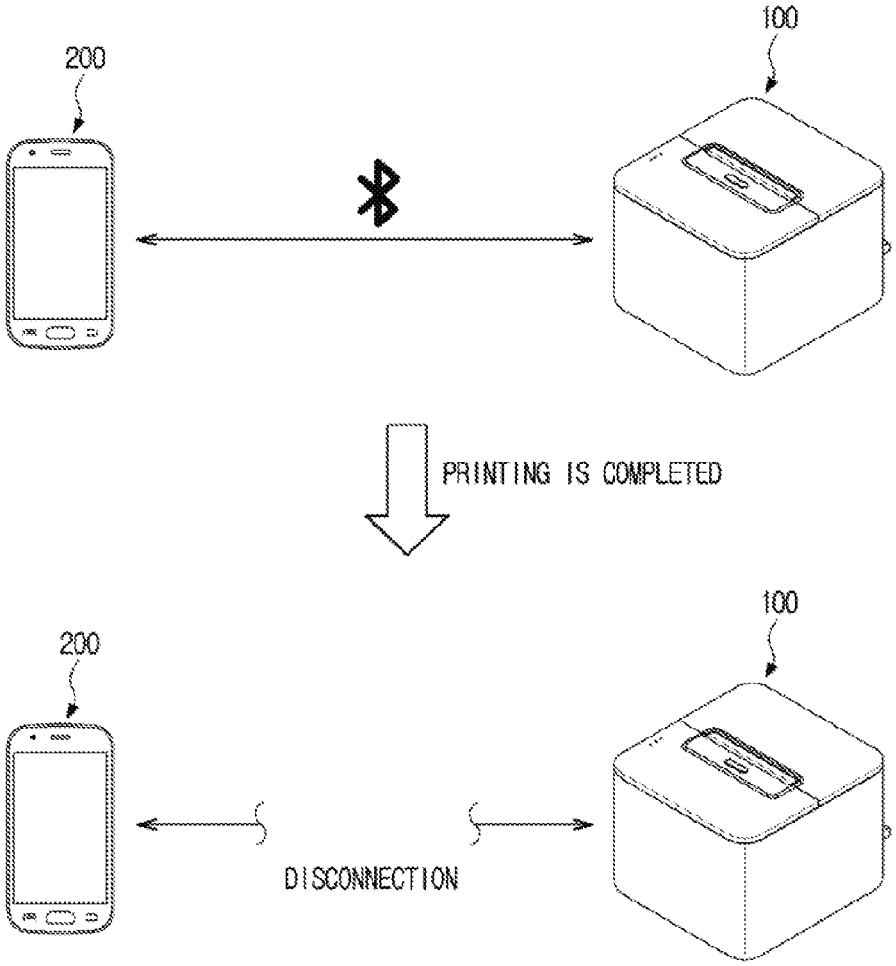
FIGS. 18 and 19 are views respectively showing an example in which the terminal and the image forming apparatus are directly connected to each other.
Figure 19:
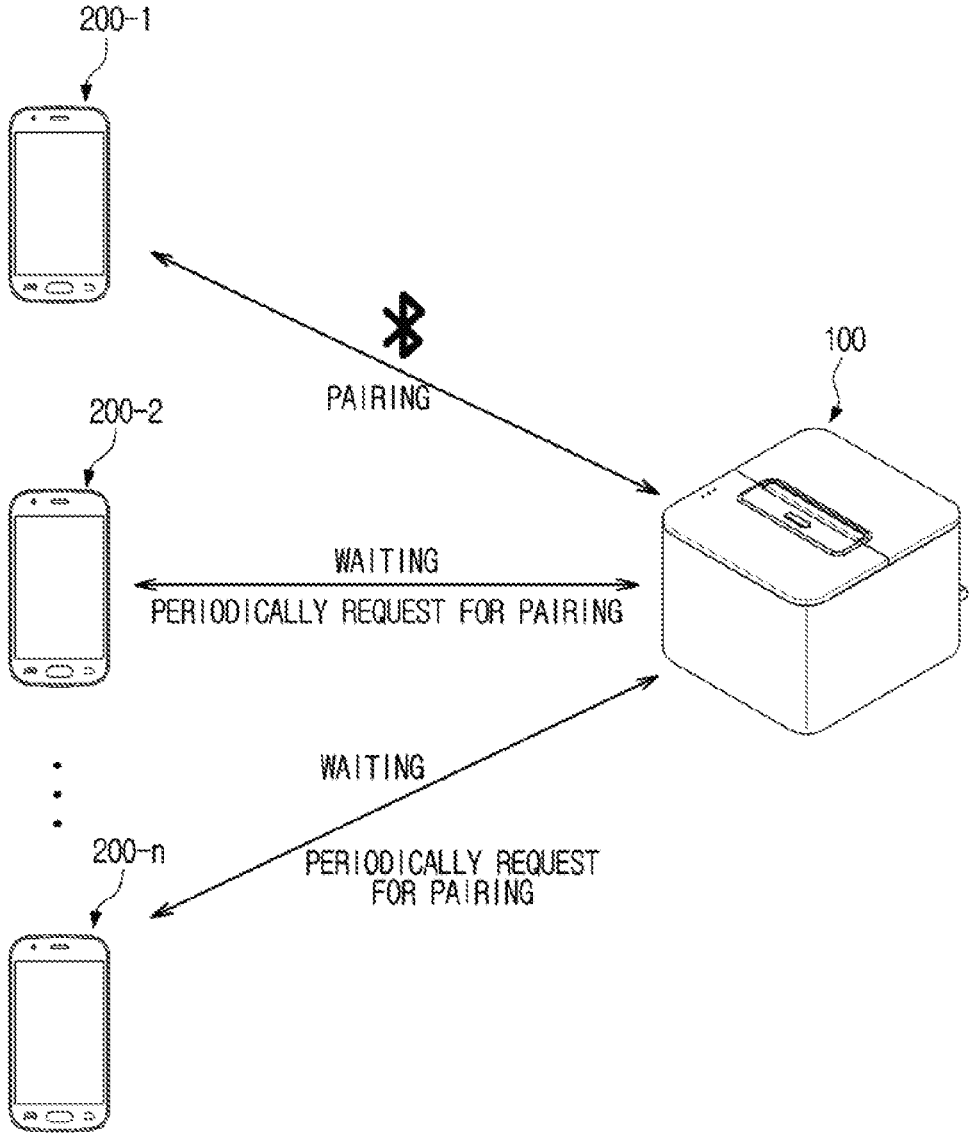

FIGS. 18 and 19 are views of an example in which the terminal and the image forming apparatus are directly connected to each other.

The terminal 200 and the image forming apparatus 100 may be wire-connected through a cable as described above, but may be connected by wireless communication to improve user's convenience. For this, a wireless communication module as described above may be provided in the terminal 200 and the image forming apparatus 100.

Referring to an example of FIG. 18, the terminal 200 and the image forming apparatus 100 are connected to each other through Bluetooth communication. For this, one device of the terminal 200 and the image forming apparatus 100 requests a connection to the other device and the other device approves this request, thereby performing pairing that interconnects two devices.

When one terminal 200 is paired with the image forming apparatus 100 to transmit note information as print data and prints the note information received by the image forming apparatus 100 on an adhesive paper P, a connection between the terminal 200 and the image forming apparatus 100 is automatically released. That is, even if an additional connection release command is not input to the terminal 200 or the image forming apparatus 100, the connection may be automatically released when printing is completed. To this end, the control unit 130 of the image forming apparatus 100 determines whether the printing unit 140 completes printing, and when printing of the note information received from the terminal 200 is determined to be completed, the control unit controls the communication unit 110 so that a connection to the terminal 200 is released. As in the example, pairing in which two devices are connected only during printing, and automatically disconnected when the printing is completed may be referred to as on demand pairing.

In this case, when a plurality of terminals 200 use one image forming apparatus 100, and printing of print data transmitted by the terminal 200 first paired based on time is completed, a next terminal is immediately connected to the image forming apparatus 100 and performs printing. Accordingly, multi-pairing in which a plurality of devices are connected to one device with a time difference is efficiently performed.

When print data are completely transmitted to the image forming apparatus 100 from the terminal 200 even if the printing is not completed, a connection between the terminal and the image forming apparatus may be released, and when a predetermined reference time is exceeded, the connection may be also released. If the connection is released when the print data are completely transmitted or when the predetermined time is exceeded, even if printing of the image forming apparatus 100 is not smoothly completed, the image forming apparatus 100 may be paired with a next terminal 200 and receive note information. The print data may be stored in the storage unit 120, and may be queued and printed in a transmission order.

Determination of whether a transmission of the print data is completed may be performed by the control unit 220 of the terminal 200, or may be performed in the control unit 120 of the image forming apparatus 100. When the control unit 220 of the terminal 200 performs the determination, the control unit may transmit a signal indicating that a transmission of the print data is completed to the image forming apparatus 100. When the communication unit 110 of the image forming apparatus 100 receives the signal, the control unit 120 controls the communication unit 110 to release a connection with the terminal 200.

Whether the reference time is exceeded may be determined by the control unit 120 of the image forming apparatus 100. When the reference time is exceeded after starting a printing of print data received from the terminal 200 or when the reference time is exceeded after a reception of the print data from the terminal 200 is completed, the control unit 120 determines whether the reference time is exceeded and controls the communication unit 110 to release the connection with the terminal 200. Here, the reference time may be set by the control unit 120 in consideration of an average printing time of the printing unit 140 and a volume of the print data received from the terminal 200.

On the other hand, as illustrated in FIG. 19, when a plurality of terminals 200-1, 200-2, . . . , 200-*n* request pairing to one image forming apparatus 100, a terminal 200-1 which firstly requested pairing is paired with the image forming apparatus 100, and the rest of terminals 200-2, . . . , 200-*n* which failed to pair with the image forming apparatus 100 periodically request pairing to the image forming apparatus 100 until paired. When a connection between the terminal 200-1 previously paired and the image forming apparatus 100 is released, an immediately following terminal 200-2 which requested pairing may be paired.

Examples in FIGS. 18 and 19 are about a case where the terminal 200 to transmit print data and the image forming apparatus 100 are directly connected. In addition to the method using the Bluetooth communication described above, an example in which the terminal 200 and the image forming apparatus 100 are connected using other wireless communications such as Wi-Fi Direct or Wi-Fi communication via an access point is possible.

Figure 20:
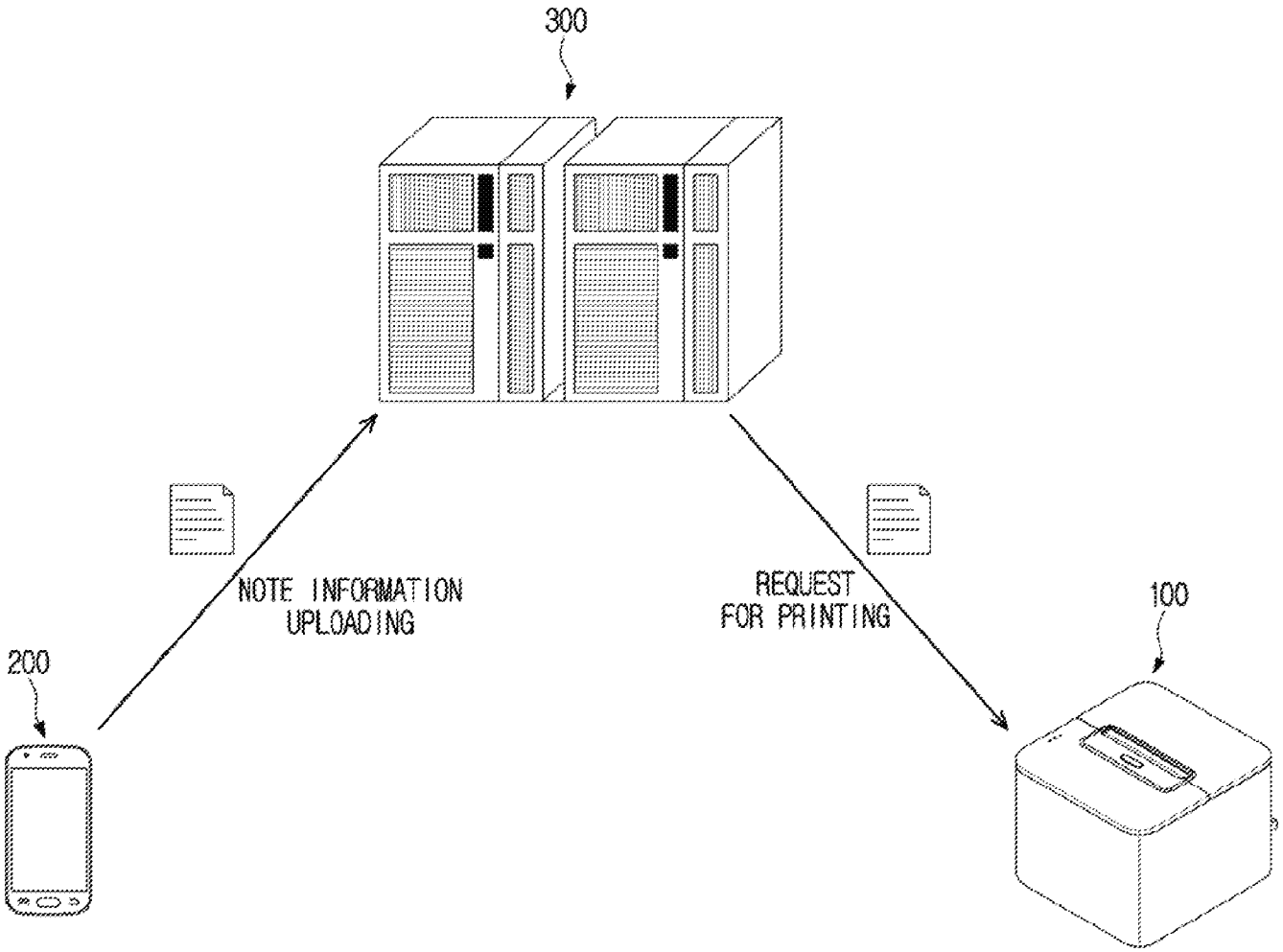
FIG. 20 is a view showing an example in which the terminal and the image forming apparatus are connected to each other through a server.
Figure 21:
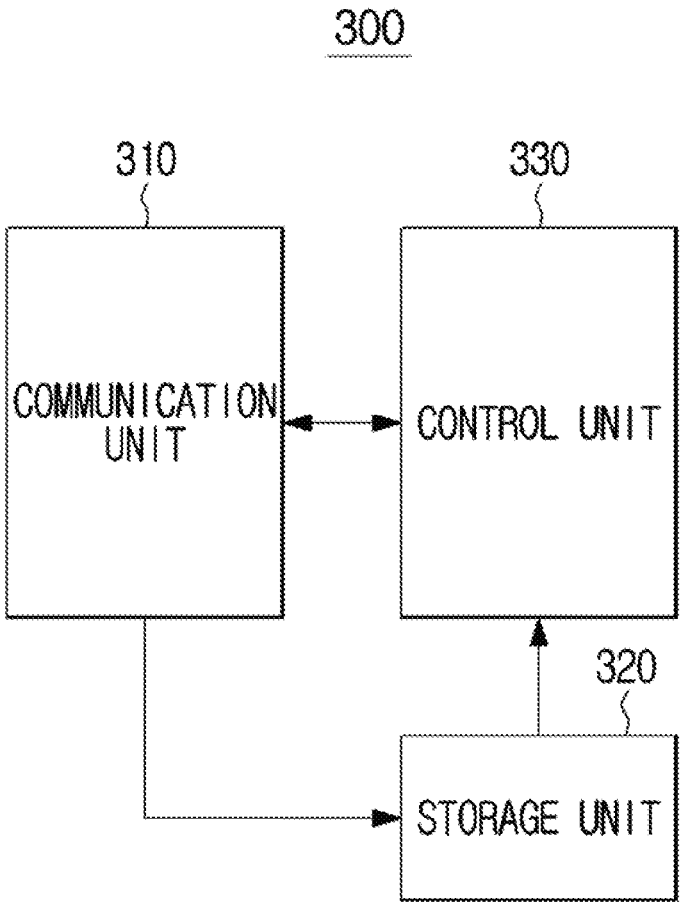
FIG. 21 is a control block diagram of the server.

FIG. 20 is a view showing an example in which the terminal and the image forming apparatus are connected to each other through a server, and FIG. 21 is a control block diagram of the server.

As illustrated in FIG. 20, when the terminal 200 uploads print data to the server 300, the server 300 may request a printing while transmitting the uploaded print data to the image forming apparatus 100. In this case, once the terminal 200 requests a printing while uploading the print data to the server 300, the server 300 may manage all subsequent processes for the printing.

Referring to FIG. 21, the server 300 may include a communication unit 310 which communicates with the terminal 200 and the image forming apparatus 100 to transmit or receive data, a storage unit 320 which stores data received from the terminal 200, and a control unit 330 which entirely controls the server 300.

A network used to perform a communication between the communication unit 310 of the server 300 and the communication unit 210 of the terminal 200, and a network between the communication unit 310 of the server 300 and the communication unit 110 of the image forming apparatus 100 may be the wired internet or the wireless internet, may be a wired public network, a wireless mobile communication network, or a core network integrated with the mobile internet, or may be an open system computer network which provides a TCP/IP protocol and various services in an upper layer, that is, Hyper Text Transfer Protocol (HTTP), Telnet, File Transfer Protocol (FTP), Domain Name System (DNS), Simple Mail Transfer Protocol (SMTP), and the like. A communication method of the communication unit 310 is not limited.

The storage unit 320 may store print data, that is, note information, transmitted from the terminal 200, and a program and data for executing an operation of controlling the server 300.

When the terminal 200 uploads the print data to the server 300, the terminal 200 may transmit information on the image forming apparatus 100 to request printing together with the print data. For example, identification information on the image forming apparatus 100 may be transmitted at the same time, and the identification information on the image forming apparatus 100 may be a Media Access Control (MAC) address or an Internet Protocol (IP) address. Moreover, it is possible to allow a user to select a desired image forming apparatus 100 by providing a list of image forming apparatuses 100 pre-registered in the server 300 to the terminal 200.

Figure 22:
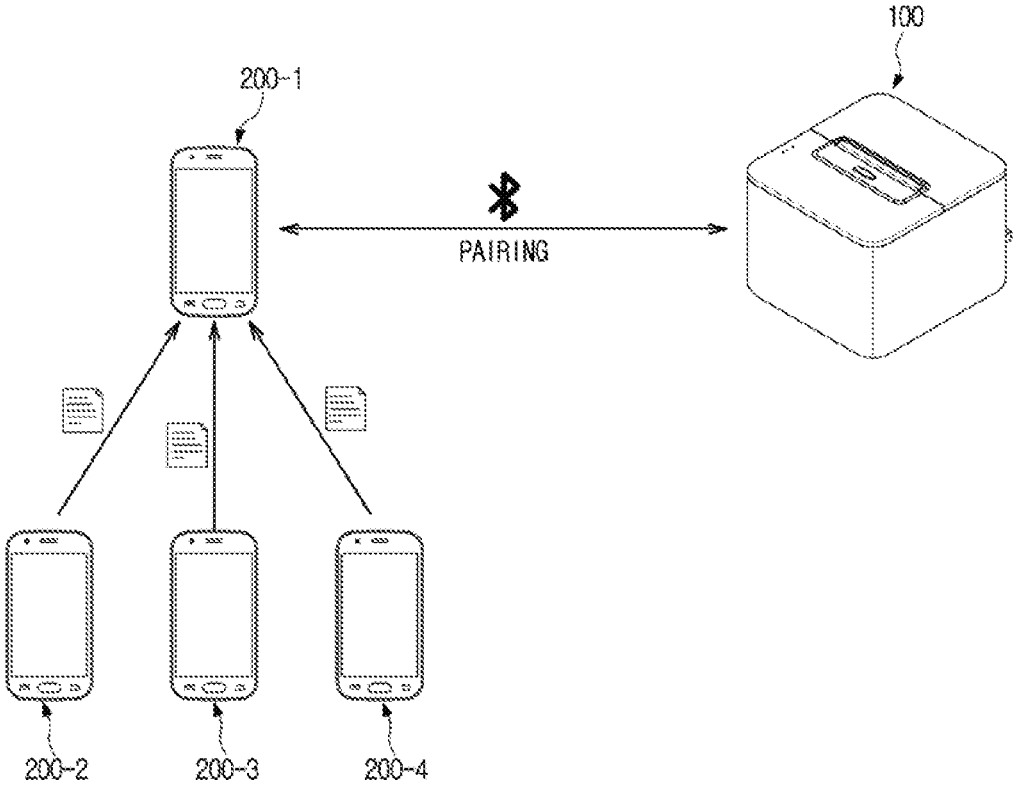
FIG. 22 is a view showing an example in which the terminal functions as the server.

FIG. 22 is a view showing an example in which the terminal functions as the server.

As illustrated in FIG. 22, one terminal 200-1 may function as a master terminal, and the rest of the terminals 200-2, 200-3, and 200-4 transmitting print data to the same image forming apparatus 100 may function as client terminals. In this case, the master terminal 200-1 may collect the print data from the client terminals 200-2, 200-3, and 200-4, and sequentially transmit the collected print data to the image forming apparatus 100. In this case, the master terminal 200-1 and the image forming apparatus 100 may be connected to each other through Bluetooth communication, and the client terminals 200-2, 200-3, and 200-4 may be connected to the master terminal 200-1 by Wi-Fi Direct at the same time.

The print data received from the client terminals 200-2, 200-3, and 200-4 are stored in the storage unit 220 of the master terminal 200-1. Moreover, the print data created by the master terminal 200-1 may be stored therein. The master terminal 200-1 requests printing in an order of receiving the print data from the client terminals 200-2, 200-3, and 200-4, in an order in which the client terminals are connected to the master terminal 200-1, or in an arbitrary order. Moreover, the master terminal may request printing of its own print data first, last, or in an arbitrary order.

Figure 23:
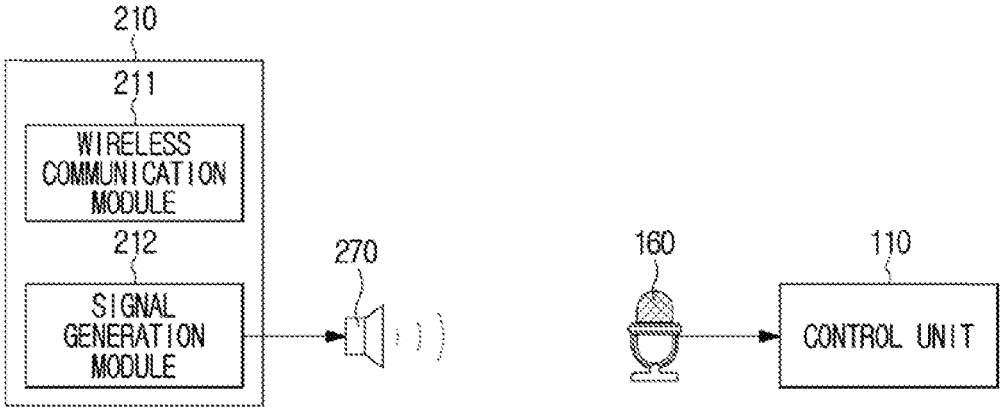
FIG. 23 is a view showing an example in which the terminal and the image forming apparatus transmit or receive print data to or from each other using an ultrasonic signal.

FIG. 23 is a view showing an example in which the terminal and the image forming apparatus transmit or receive print data to or from each other using an ultrasonic signal.

Referring to an example of FIG. 23, the communication unit 210 of the terminal 200 may include a wireless communication module 211 for performing a communication according to the communication method described in FIG. 3 and a signal generation module 212 for generating an ultrasonic signal loaded with print data.

The signal generation module 212 generates a signal to be transmitted to the image forming apparatus 100 by loading an ultrasonic signal having a frequency in a non-audible bandwidth of about 17 KHz to 19 KHz with print data, and outputs the generated signal through a speaker 270 provided in the terminal 200.

The image forming apparatus 100 may include a microphone 160 for receiving a sound signal, and a signal input through the microphone 160 may be transmitted to the control unit 110 of the image forming apparatus 100. A signal conversion module for converting the ultrasonic signal into an electric signal to extract the print data is included in the control unit 110.

Hereinafter, based on operations of the terminal 200, the image forming apparatus 100, and the server 300 so far described, specific applications thereof will be described.

Figure 24:
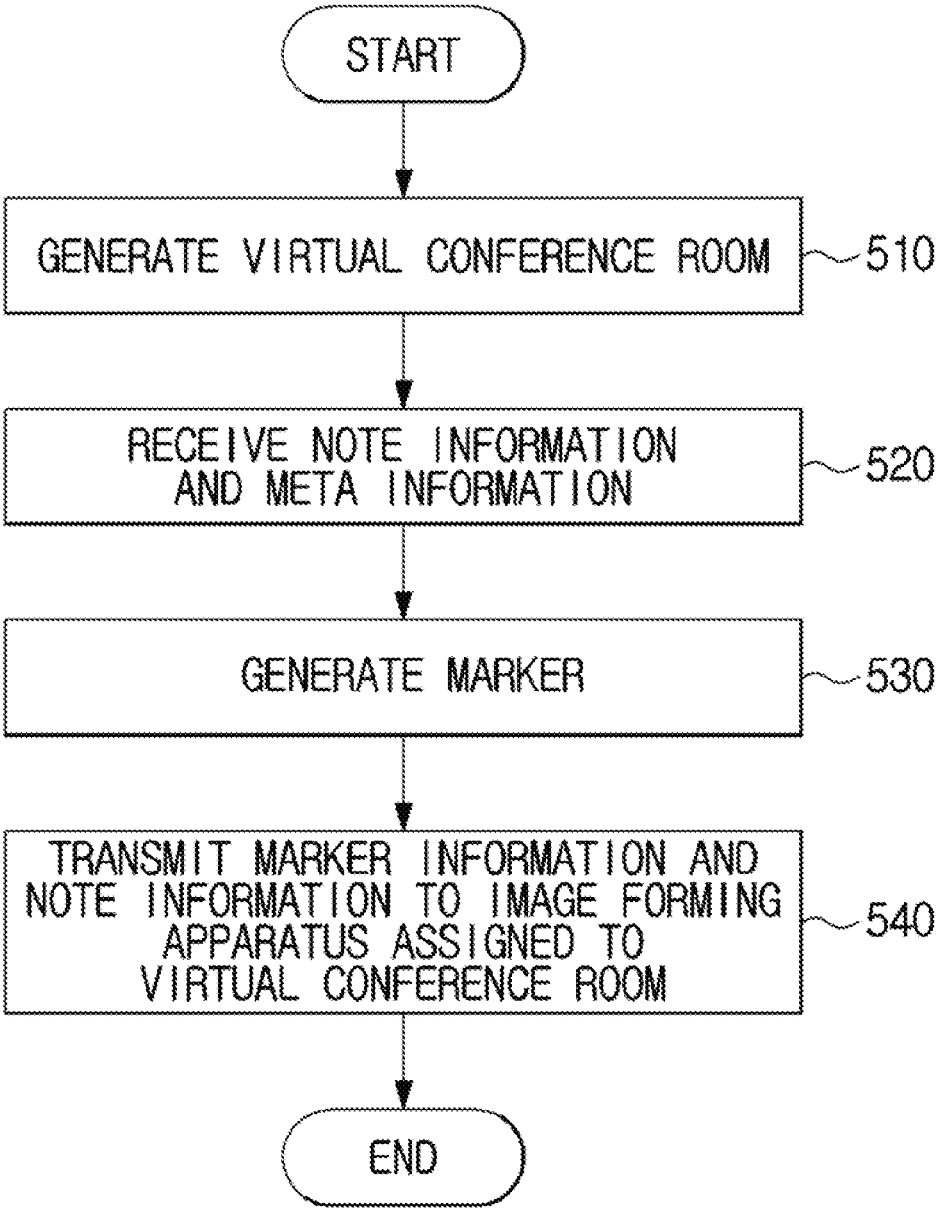
FIG. 24 is a flowchart on a method of proceeding with a conference using the image forming apparatus.
Figure 25:
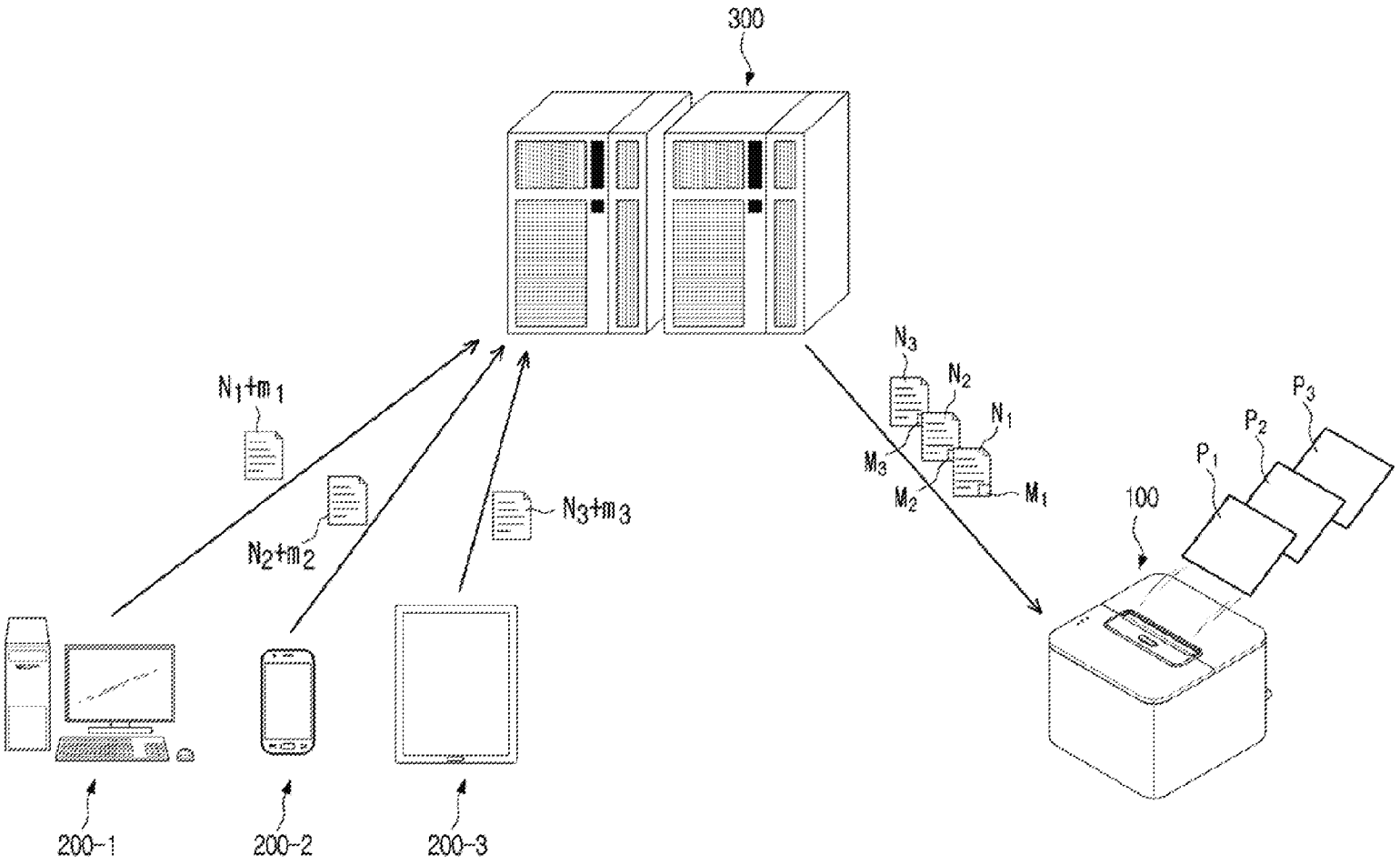
FIG. 25 is a view showing an example in which a plurality of terminals transmit print data to proceed with a conference using the image forming apparatus.

FIG. 24 is a flowchart on a method of proceeding with a conference using the image forming apparatus, and FIG. 25 is a view showing an example in which a plurality of terminals transmit print data to proceed with a conference using the image forming apparatus.

Referring to FIGS. 24 and 25, the server 300 first generates a virtual conference room (510), and the communication unit 310 receives note information $N_1$, $N_2$, and $N_3$ and meta information $m_1$, $m_2$, and $m_3$ from terminals 200-1, 200-2, and 200-3 of a user attending a conference (520). The note information is information on contents to be printed, that is, original information such as a text or an attached image input by a user for creating a note, and the meta information is attribute information such as time consumed to create a note. The received note information and meta information may be stored in a database assigned to the virtual conference room.

The control unit 330 generates a marker such as a QR code and a bar code indicating a storage position of the note information (530), and the communication unit 310 transmits the marker $M_1$, $M_2$, and $M_3$ and the note information $N_1$, $N_2$, and $N_3$ to the image forming apparatus 100 assigned to the virtual conference room (540).

The image forming apparatus 100 outputs the note information N1, N2, and N3 and the marker M1, M2, and M3 onto an adhesive paper P and allows a plurality of users to use them during a conference.

Figure 26:
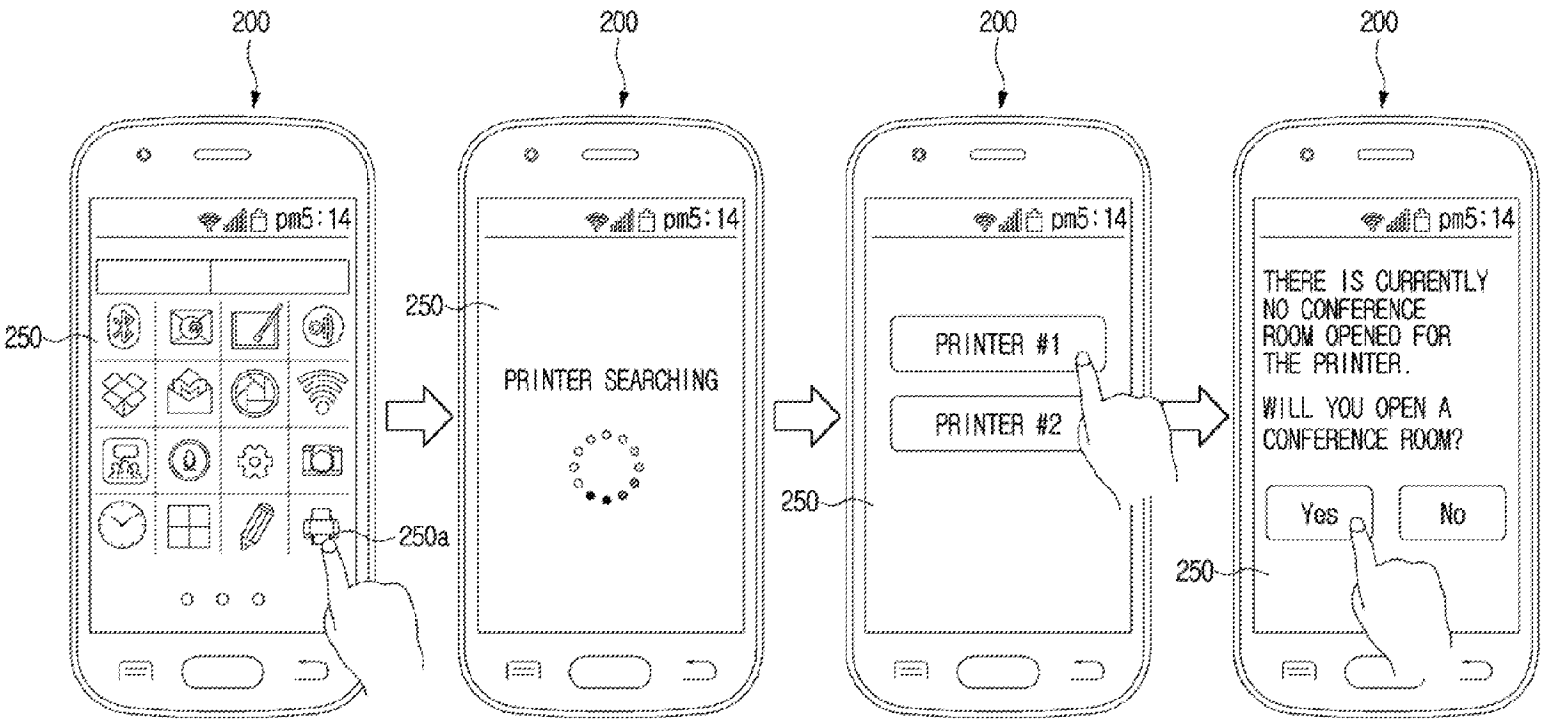
FIGS. 26 to 29 are views respectively showing operations for the server to generate a virtual conference room.
Figure 27:
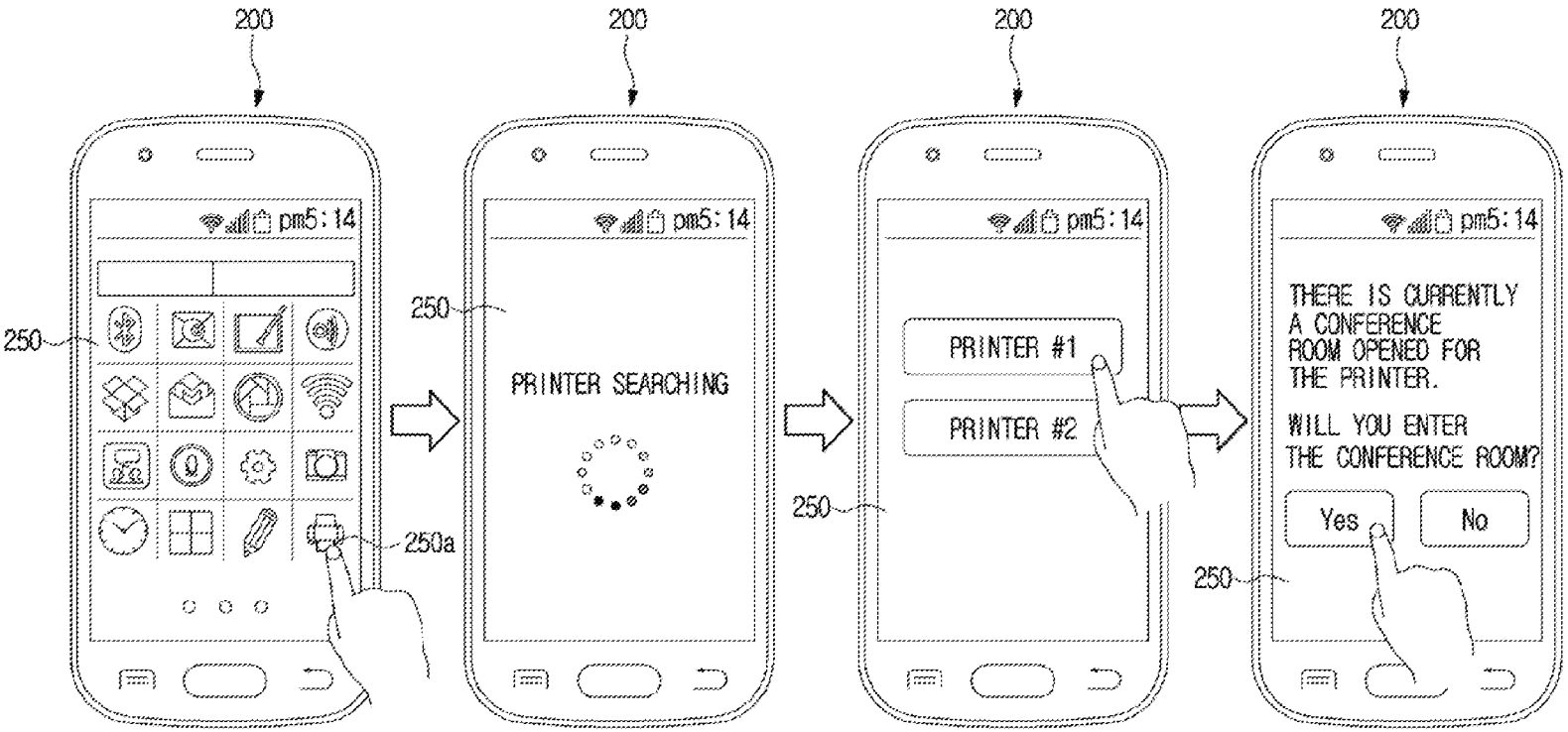

FIGS. 26 to 27 are views respectively showing operations for the server to generate a virtual conference room.

FIG. 26 is a view showing an example in which a host user who organizes a conference generates a virtual conference room using his/her own terminal 200. In the example, a smart phone is used as the terminal 200 and the image forming apparatus 100 is set to be a printer. Accordingly, a program in the example refers to an application.

Referring to FIG. 26, when a host user selects an icon 250*a* for executing a note print program installed in the terminal 200, the note print program is executed and the terminal 200 is connected to the server 300.

First, the terminal 200 searches for a printer to be used for printing. The display unit 250 displays a list of the searched printers, and when the host user selects a printer to be used in a conference among printers displayed in the list, the display unit 250 may display a message indicating there is no conference room assigned to the selected printer and a message asking whether to open a new conference room. When the host user selects a Yes button, a new conference room assigned to the selected printer is opened, and when the host user selects a No button, the note window 251 for creating a note may be displayed as described above.

On the other hand, it is possible to select a plurality of printers assigned to a conference room. At this time, the plurality of printers are embodied to respectively output a paper of different colors, and when the terminal 200 of a conference attendee is mapped to the plurality of printers according to specific criteria, notes may be distinguished to some extent only with the color of a paper output from each printer.

FIG. 27 is a view showing an example in which a guest user attending the conference enters a virtual conference room through his/her own terminal 200.

Referring to FIG. 27, when a guest user selects an icon 250*a* for executing a note print program installed in the terminal 200, the note print program is executed and the terminal 200 is connected to the server 300.

First, the terminal 200 searches for a printer to be used in printing. The display unit 250 displays a list of the searched printers, and when a guest user selects a printer to be connected among printers displayed in the list, the display unit 250 may display a message indicating there is a conference room assigned to the selected printer and a message confirming whether to enter the conference room. In this case, the host user may notify the guest user of a printer assigned to a conference room, thereby causing the guest user to select the printer. When the guest user selects a Yes button, the guest user may enter the new conference room previously opened by the host user. However, even if the guest user selects a No button, the note window 251 is not displayed and the guest user may return to a screen on which the list of printers is displayed. In this case, it is possible to prevent note information not related to the conference from being transmitted to the printer assigned to the virtual conference room.

Figure 28:
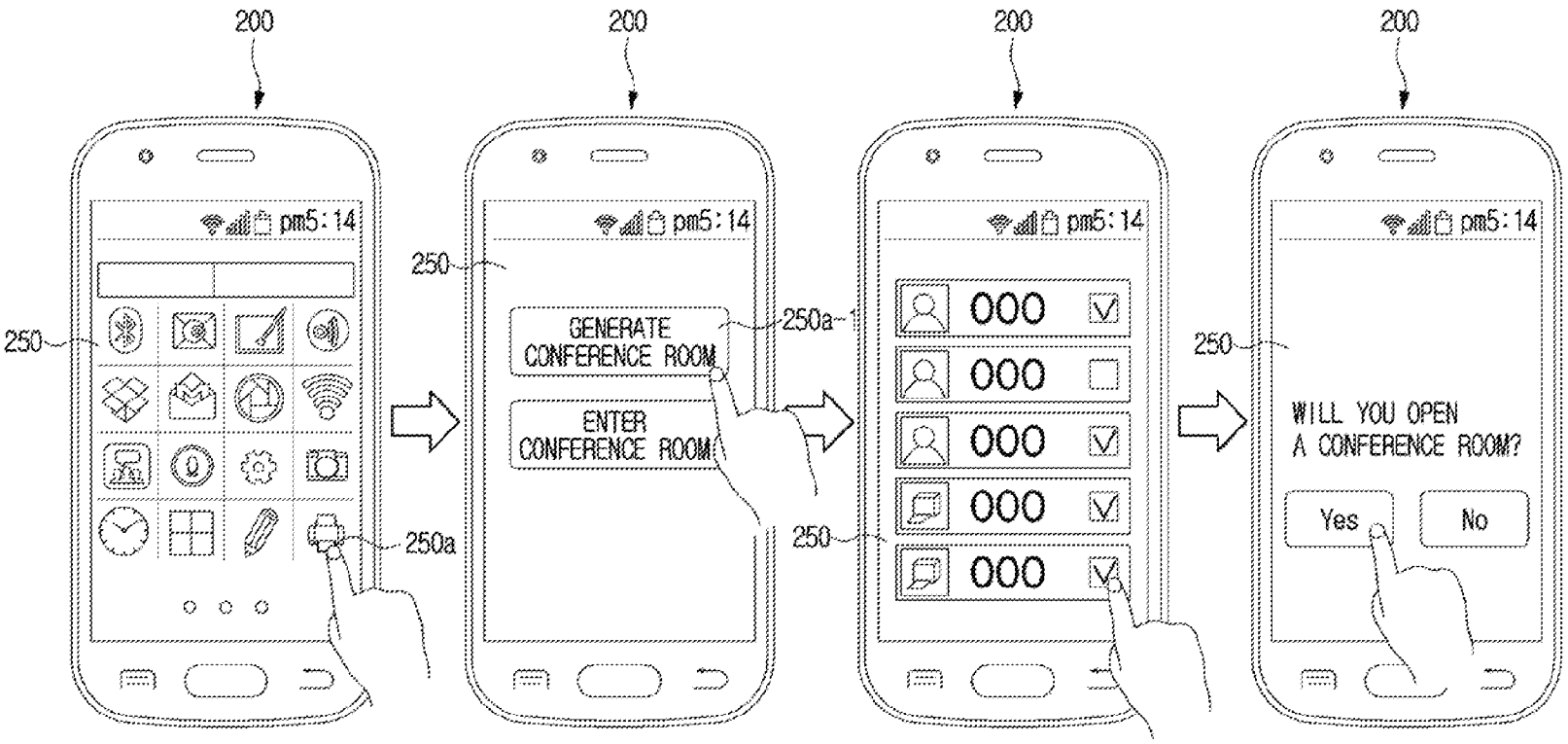

FIG. 28 is a view showing another example in which a host user who organizes a conference generates a virtual conference room using his/her own terminal 200.

As illustrated in FIG. 28, when the host user selects an icon 250*a* for executing a note print program installed in the terminal 200, the note print program is executed and the terminal 200 is connected to the server 300.

The display unit 250 may display a conference room opening button 250*a*-1 and a conference room entering button 250*a*-2. When the host user selects the conference room opening button 250*a*-1, the terminal may 200 automatically search for a printer to be used, and may display a list of conference attendee candidates and a list of available printers on the display unit 250. At this time, the note print program may be linked to a chat application or a contacts storage program installed in the terminal 200, and a list obtained from the chat application or the contact storage program may be displayed as the list of conference attendee candidates. Alternatively, the note print program may separately receive the list of conference attendee candidates and manage it.

When the host user selects a conference attendee and a printer, the display unit 250 may display a message confirming whether to open a conference room, and when the host user selects a Yes button, a virtual conference room is opened in the server 300.

Figure 29:
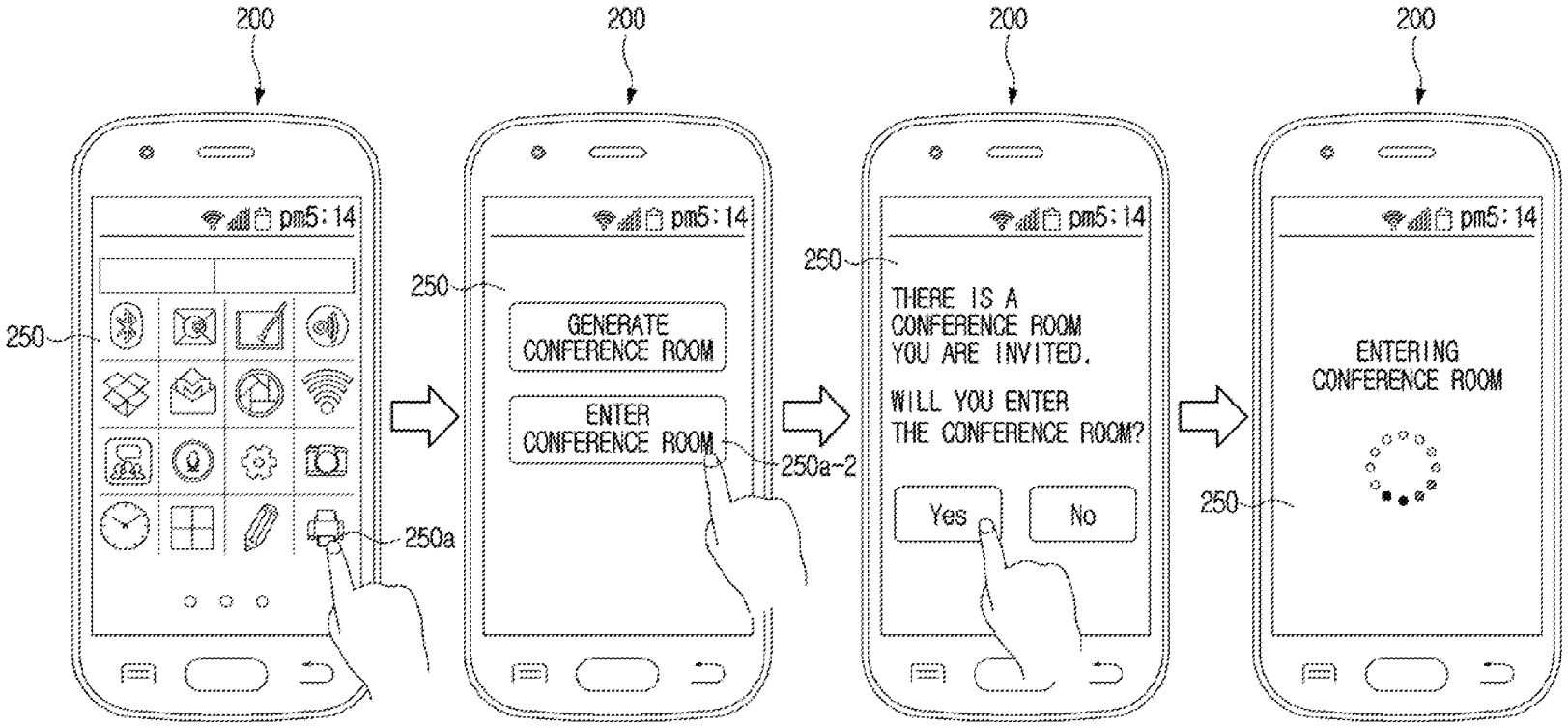

FIG. 29 is a view showing another example in which a guest user enters a virtual conference room using his/her own terminal 200.

As illustrated in FIG. 29, when the guest user selects an icon 250*a* for executing a note print program installed in the terminal 200, the note print program is executed and the terminal 200 is connected to the server 300.

The display unit 250 may display the conference opening button 250*a*-1 and the conference room entering button 250*a*-2. When the guest user selects the conference room entering button 250*a*-2, the server 300 determines whether the guest user is invited by a host user, and when invited, the server 300 may display a message indicating there is a conference room to which the guest user is invited and a message confirming whether to enter the conference room on the display unit 250. When the guest user selects a Yes button, the guest user may enter the new conference room previously opened by the host user.

On the other hand, the host user and the guest user entering the virtual conference room may upload note information created respectively using their own terminal 200 to the server 300. A method of creating a note may be in accordance with examples described above. In order to upload the created note information to the server 300, the note window 251 for creating a note or a search box for searching for a note already created and uploading the note may be displayed on the display unit 250 after entering the virtual conference room. Alternatively, when a user creates a note in the note window 251 by executing a note print program and inputs a storage command by selecting a storage icon 251*b*-6 or performing a specific touch operation before entering the conference room, it is possible to immediately store created note information in the storage unit 320 of the server 300. When the note information is stored or uploaded, meta information regarding the note information may be stored or uploaded together.

Figure 30:
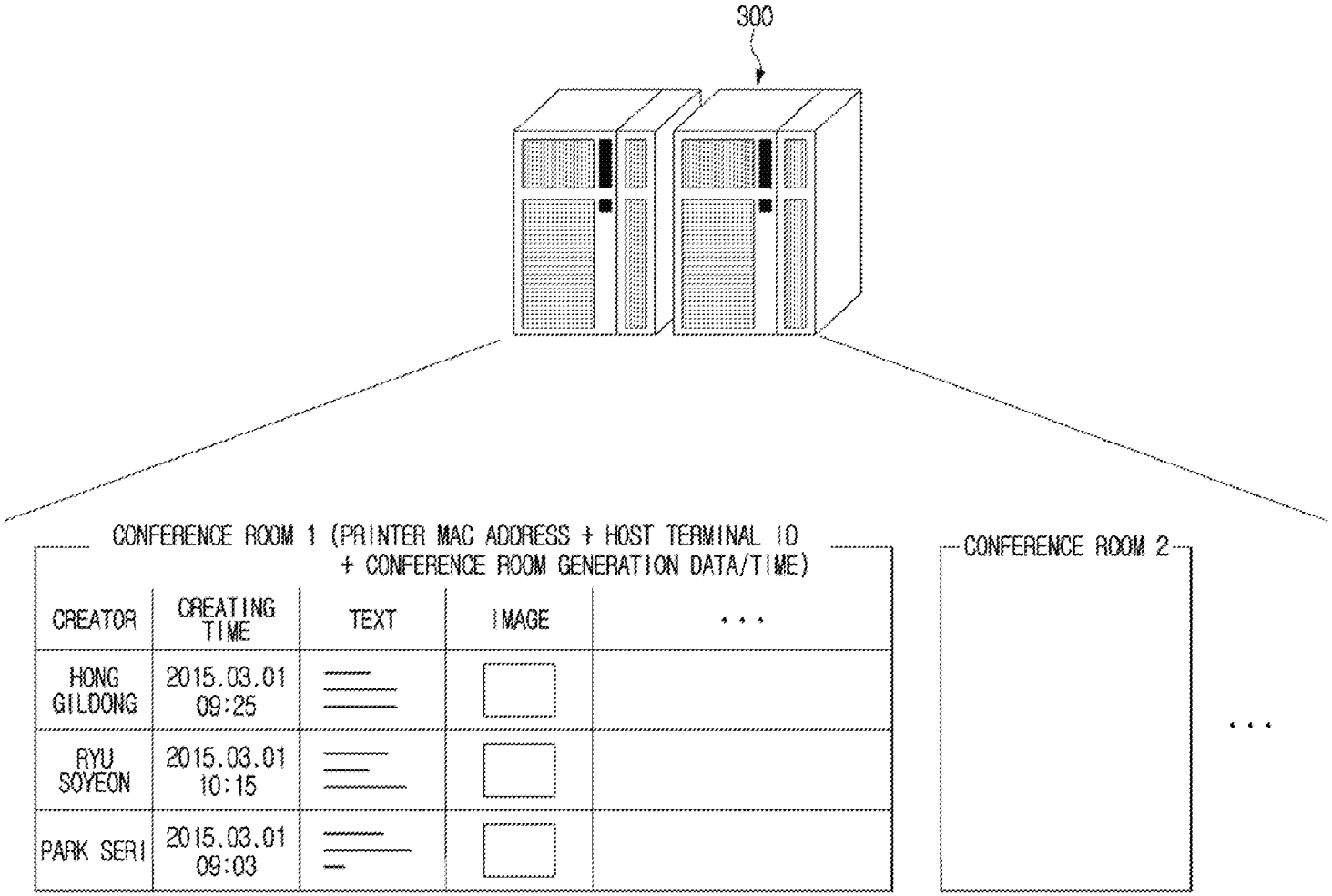
FIG. 30 is a view showing an example of information stored in a database assigned to a virtual conference room.

FIG. 30 is a view showing an example of information stored in a database assigned to a virtual conference room.

Referring to FIG. 30, a certain storage space of the storage unit 320 may be assigned to a virtual conference room. Accordingly, pieces of information related to a conference room may be stored in the storage unit 320 and managed.

For example, an address of a storage space assigned to the virtual conference room may be determined by identification information on a host terminal, identification information on a selected printer, and a conference room generation data and time. That is, virtual conference rooms having a difference in at least one of the pieces of information become separate conference rooms, and different storage spaces are assigned thereto.

Note information and meta information uploaded by conference attendees may be stored in a storage space assigned to a virtual conference room.

The note information refers to original information on a note created by a user, and the original information may include at least one of a text and an image according to contents included in a created note. In addition, the note information may be uploaded to the server 300 in a state of being converted in a format readable by the printer 100, may be converted in the server 300, and may be converted by the printer 100. For example, the terminal 200, the server 300, or the printer 100 converts the note information into a bit map. When the note information may include an image, the note information may be converted into a bit map such as GIF, JPEG, PNG, TIFF, and BMP, and when the note information may include a text, the note information may be converted into a bit map font.

Meta information may include information on a creator who creates each piece of note information and a creating time, and may additionally include information on a conference name and a conference technique.

While a conference is in progress, users may confirm, download, or update pieces of information stored in a virtual conference room by connecting to the server 300 using their own terminal 200. Alternatively, a host user may set a limit on confirmation or download of information and allow only a guest user authorized in advance to download or confirm the information.

Figure 31:
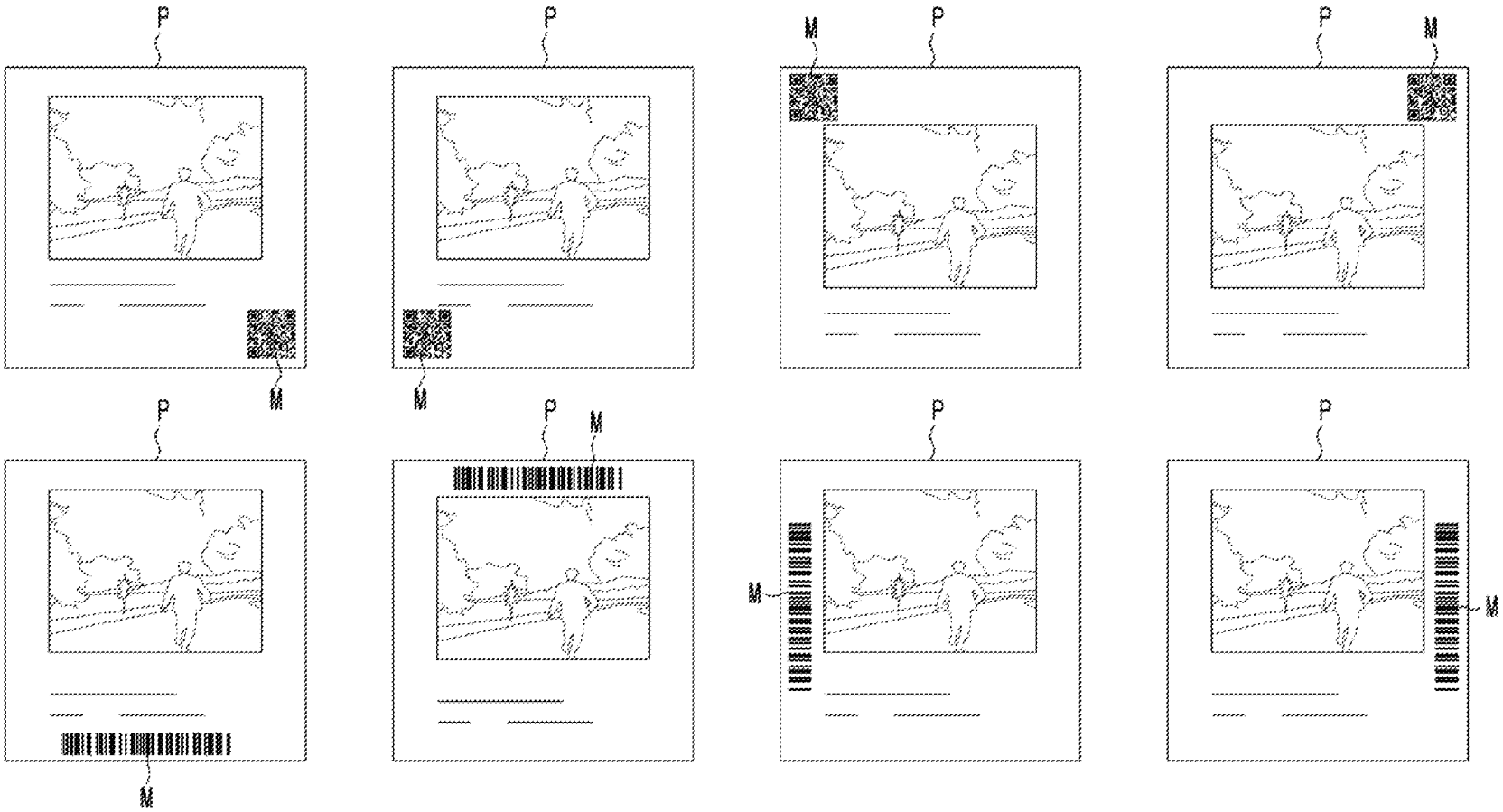
FIG. 31 is a view showing an example in which a printer assigned to the virtual conference room prints a note created by conference attendees with a marker.

FIG. 31 is a view showing an example in which the printer assigned to the virtual conference room prints a note created by conference attendees with a marker.

The control unit 330 of the server 300 may generate a marker which may include address information on a storage space assigned to a virtual conference room, and transmit marker information along with note information to the image forming apparatus 100. That is, print data transmitted to the image forming apparatus 100 may include both the note information and the marker information.

A marker may include a serial number assigned to each conference room and may additionally include information which may distinguish positions in which each piece of the note information is stored. Accordingly, when decoding the information included in the marker, it is possible to know a position in which the note information printed with the marker is stored.

Whenever a new conference is opened, a serial number included in the marker may be reset. For example, when a serial number included in the marker is generated to be a number such as 1234, 1235, or 1236, the serial number may start from 0001 again in another conference newly opened after a conference completion. In this manner, when a new serial number is used for each conference, a size of data belonging to a marker is reduced, and thereby a size of the bar code or the QR code is decreased. As a result, a recognition rate is increased when the capturing unit 260 captures and recognizes the marker as described below.

As illustrated in FIG. 31, the printer 100 may print a note and a marker M together on an adhesive paper P, and the marker M may be printed on either one of four vertexes or one of four corners of the paper P to be distinguished from a text or an image configuring the note.

On the other hand, the note and the marker M are printed on a front side of the paper P which is the opposite side to the adhesive region S. When the marker M is printed on a front side corresponding to the adhesive region S, a situation in which handwriting is not smoothly performed due to an adhesive applied to a rear side when a user directly write on a printed paper P may be prevented in advance.

Figure 32:
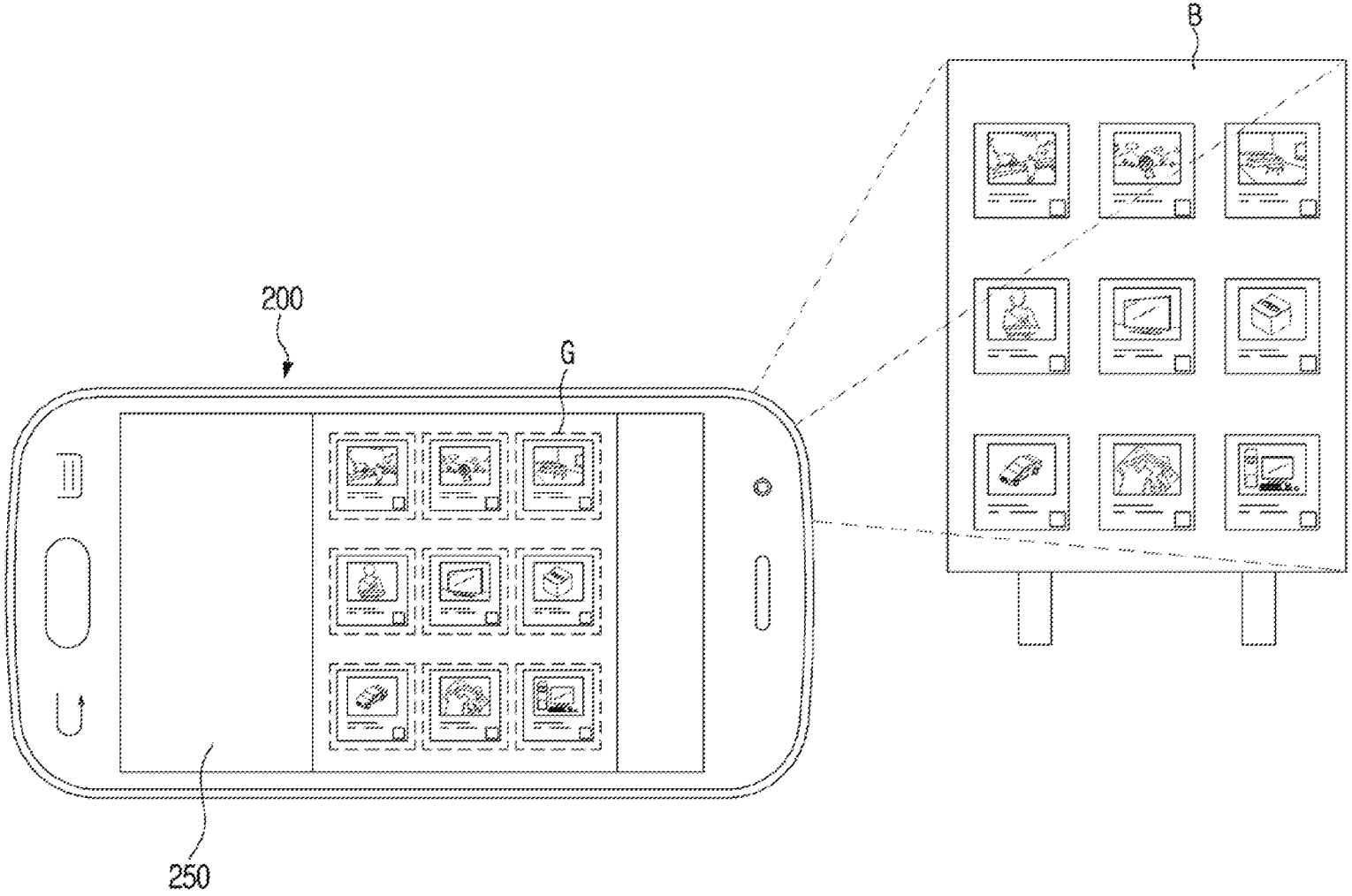
FIGS. 32 and 33 are views respectively showing an example of storing a result of the conference by capturing an attached paper using the terminal.
Figure 33:
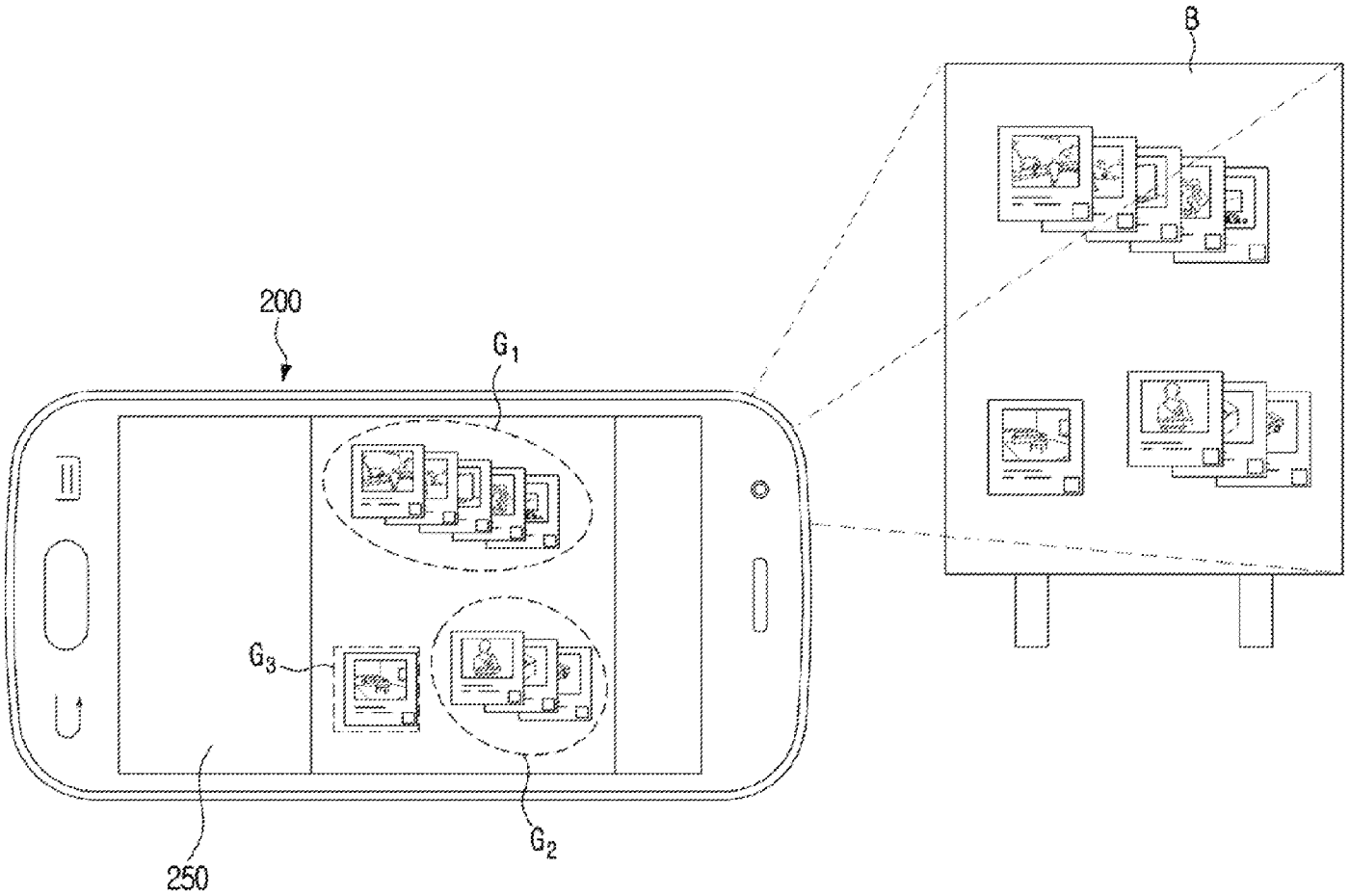

FIGS. 32 and 33 are views respectively showing an example of storing a result of the conference by capturing an attached paper using a terminal.

As described above, a virtual conference room may be generated in a server 300 and a conference may be performed in a real conference room in reality. Conference attendees may share opinions of one another by attaching papers on which each note is printed to a board B. When attaching the papers, the conference attendees may easily distinguish the papers by attaching the papers according to a specific rule. For example, the papers may be attached by color or attached in a presentation order of the conference attendees.

Moreover, when the opinions of the conference attendees need to be arranged to be structured, a correlation of respective opinions may be grasped at a glance by grouping papers on which similar opinions are printed and re-attaching the papers.

For recording a conference result, as illustrated in FIGS. 32 and 33, structured papers may be captured or scanned using the capturing unit 260 provided in the terminal 200. The papers may be captured before being structured (grouped) according to the opinions printed on the papers as illustrated by G in FIG. 32, and may be captured after being structured (grouped) according to the opinions as illustrated by $G_1$ to $G_3$ in FIG. 33.

Marker information may be extracted from an image captured by the capturing unit 260, and recognition of a marker and extraction of the marker information may be performed in the terminal 200 or in the server 300.

Figure 34:
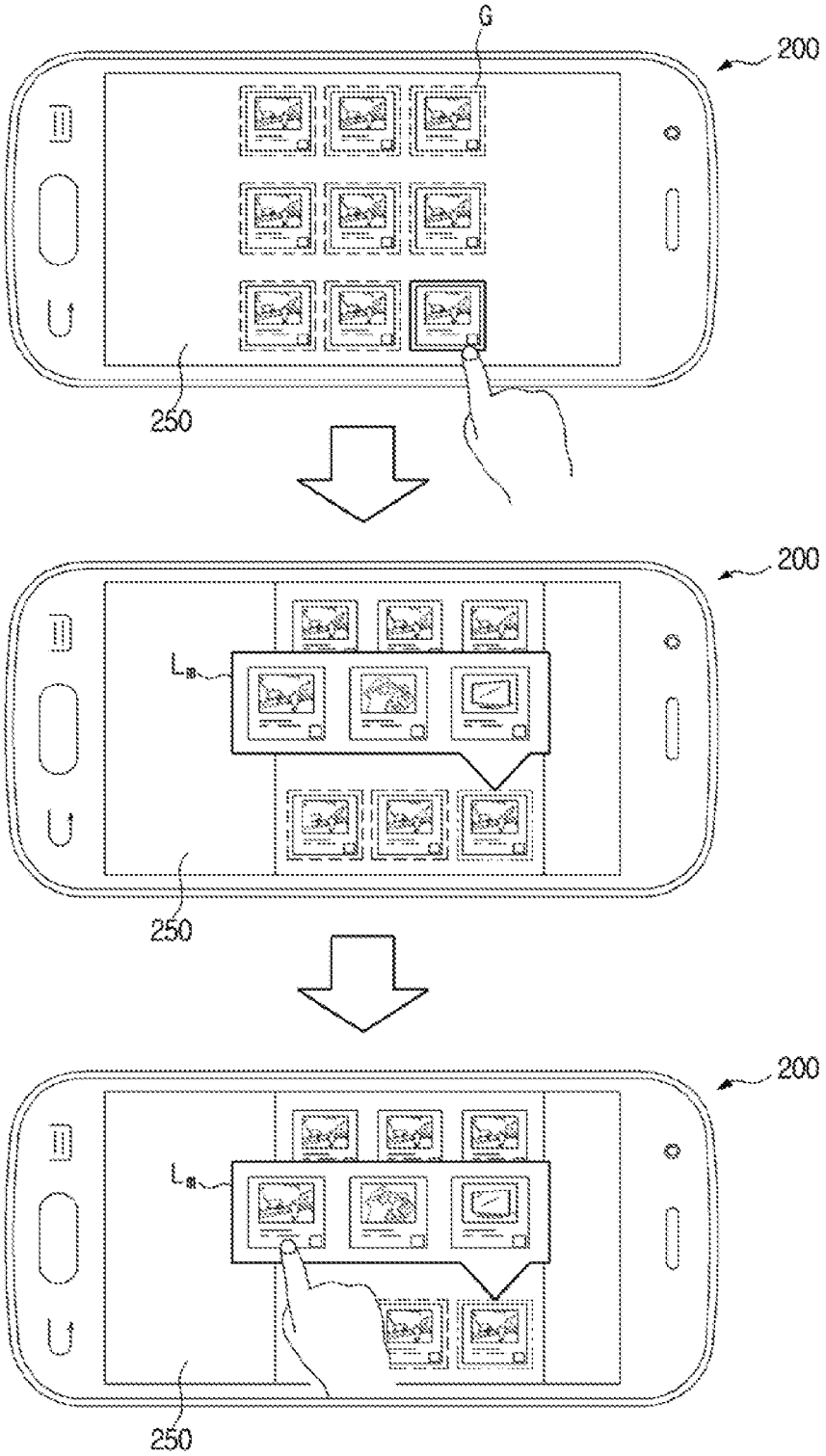
FIG. 34 is a view showing an example of a processing procedure when a portion of the marker is not recognized on a captured image.

FIG. 34 is a view showing an example of a processing procedure when a portion of the marker in a captured image is not recognized.

A portion of a plurality of markers included in a captured image or a scan image may be not recognized in some cases. In this case, as illustrated in FIG. 34, it is possible to differently display a paper on which a marker is recognized and a paper on which a marker is not recognized on the display unit 250 of the terminal 200. When a user selects the paper on which a marker is not recognized, the terminal 200 may apply an image recognition algorithm, and may search for similar candidates by comparing an image or a text printed on the paper on which a marker is not recognized with the original information stored in the server 300. The similar candidates may be displayed in a recommendation list $L_M$, and the user may select a candidate corresponding to the image or the text printed on the paper on which a marker is not recognized in the displayed recommendation list $L_M$.

In this manner, when papers on which opinions of conference attendees and markers are printed are structured and attached, and are re-captured and digitalized, the terminal 200 may determine an address of a server in which note information printed on each paper is stored by extracting marker information from a captured image, and may refer to original information stored in the determined address. Accordingly, the terminal 200, once only the marker information is extracted from the captured image, may acquire original information on a note created by conference attendees even though not recognizing the rest of the contents printed on a paper. Moreover, it is possible to grasp a creator of the original information through the meta information stored along with the original information.

On the other hand, a use of a camera is prohibited by a company in some cases. In this case, since a paper P cannot be captured using the terminal 200, a conference attendee may manually perform grouping using the terminal 200.

Figure 35:
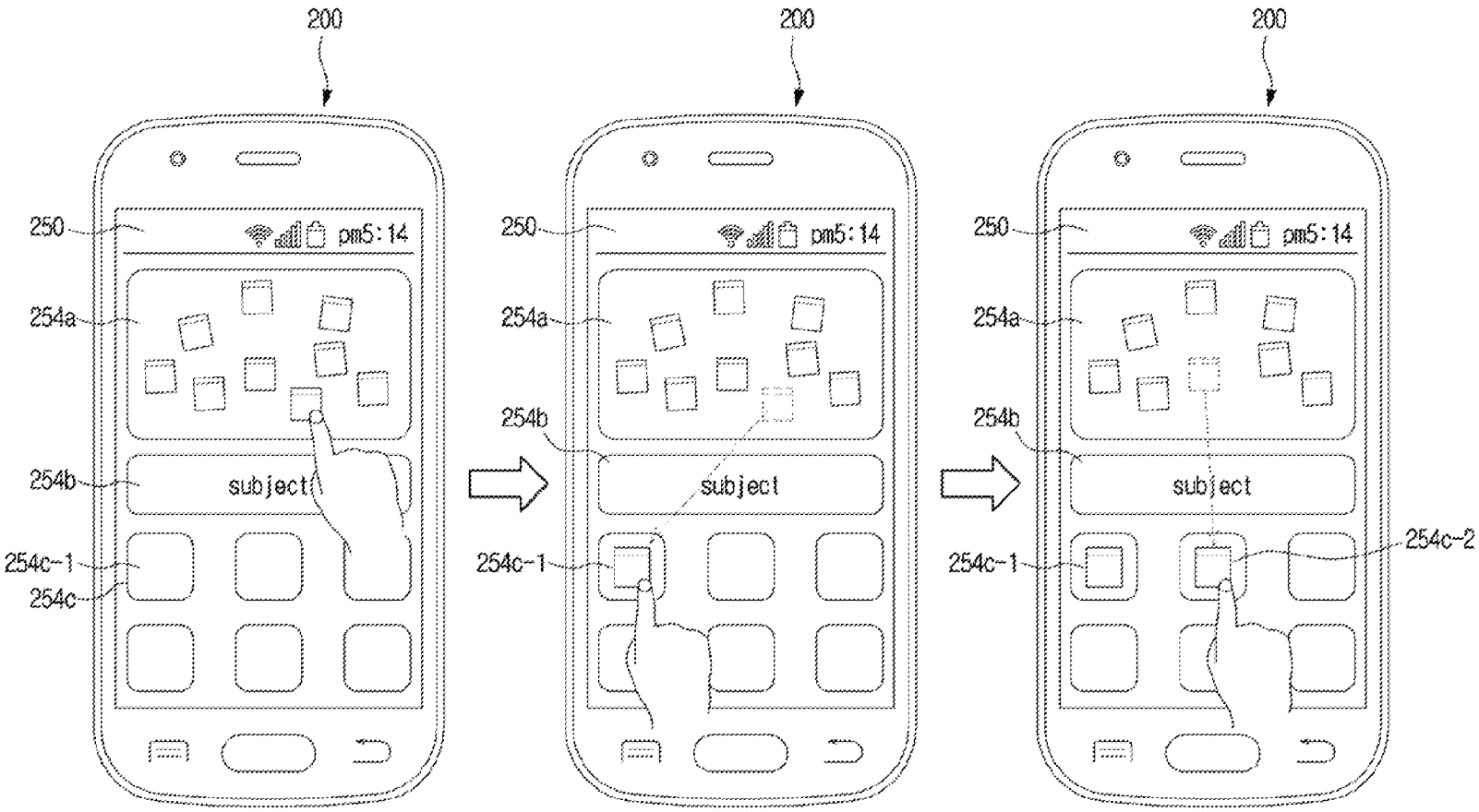
FIGS. 35 and 36 are views respectively showing an example in which a user manually arranges a conference result using the terminal.
Figure 36:
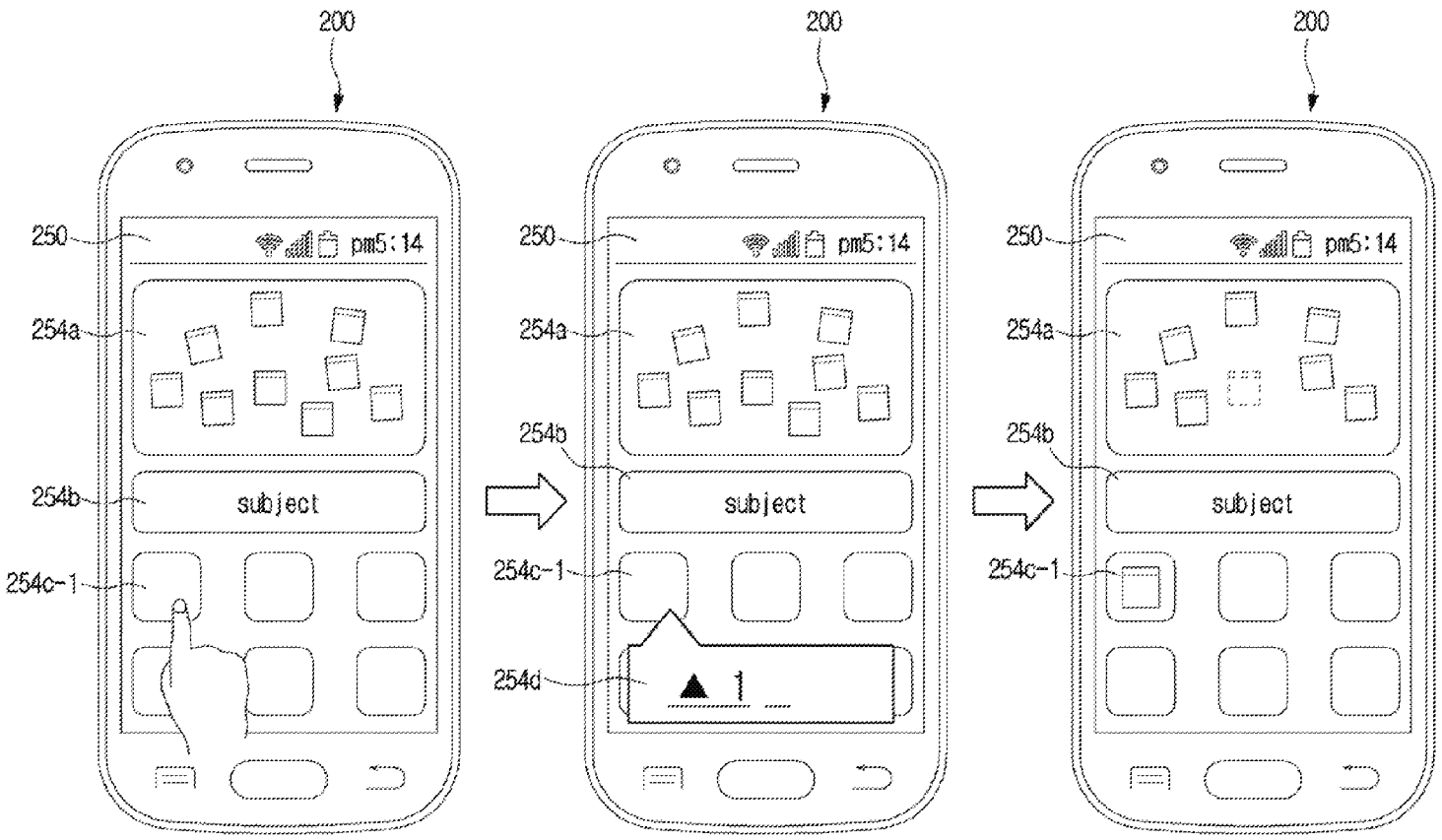

FIGS. 35 and 36 are views of an example in which a user manually arranges a conference result using the terminal.

Referring to FIG. 35, the display unit 250 may display a virtual board 254*a* generated using the note information uploaded to the server 300 by the conference attendees. As described above, original information on a note created by the conference attendees is stored in the server 300, and when a user who is one of the conference attendees requests a generation of the virtual board 254*a*, the server 300 may transmit the original information on a note created by all conference attendees to the terminal 200 of the conference attendee. At this time, notes displayed on the virtual board 254*a* may be sorted according to specific criteria, and, for example, may be sorted by creator.

A screen for manual grouping may be displayed at the bottom of the virtual board 254*a*. For example, a user inputs a subject 254*b* for grouping notes together, and drags a note included in the group from the virtual board 254*a* and drops the note in a blank 254*c* (e.g., blank 254*c*-1, 254*c*-2, etc.), thereby performing a manual grouping.

Alternatively, it is possible to directly search for a note included in the subject 254*b* without dragging a note from the virtual board 254*a*. For example, as illustrated in FIG. 36, when a user selects the blank 254*c*-1, a search box 254*d* for inputting a query is displayed. At this time, a marker may be input as a query; however, a marker herein may not be a bar code or a QR code including an address of a storage space storing the note information described above, but may be a shape, a symbol, a letter, or a combination of numbers which may be easily recognized and input by a user.

Accordingly, the server 300 may give markers which are not overlapped to respective notes. Alternatively, when not using the server 300 as described below, the printer 200 may give a marker or respective terminals 200 may give markers to respective notes. In this case, in order to prevent the markers given by respective terminals 200 from being overlapped with each other, a marker assigned to each user and markers sequentially assigned to a plurality of notes of one user may be used together. Specifically, markers for distinguishing between respective terminals 200 may be assigned by an agreement between the conference attendees, and markers for distinguishing between a plurality of notes generated in the terminal 200 may be given by itself. For example, when ■ is assigned to Hong GilDong, ▲ is assigned to Ryu SoYeon, and ● is assigned to Park SeRi, the terminal 200 of Hong GilDong may give ■1, ■2, and ■3 to respective three notes created by Hong GilDong, the terminal 200 of Ryu SoYeon may give ▲1 and ▲2 to respective two notes created by Ryu SoYeon, and the terminal 200 of Park SeRi may give ●1 or ● to a note created by Park SeRi. Here, the number of notes may be determined by a size of the paper P output from the printer 100.

Markers given according to the example are printed on the paper P along with respective notes, and a user actually attending the conference may see the papers P structured and attached to the board B and perform manual grouping using the terminal 200. Referring to FIG. 36 again, when a user inputs ▲1 into the search box 254*d*, a note to which a marker of ▲1 is assigned may move to the blank 254*c*-1.

Information automatically or manually grouped through capturing may be uploaded to the server 300.

On the other hand, a conference attendee may monitor a conference process using the terminal 200 while the conference is in progress or after the conference is completed. For example, as shown in FIGS. 35 and 36, the display unit 250 may display the virtual board 254*a* to view the created notes at a glance, and may display statistical analysis data of notes created by conference attendees, analysis data of words frequently mentioned in the created note, words connectivity analysis data between structured notes, and the like. Such data or information may be provided from the server 300, or may be generated by the terminal 200 based on the information provided from the server 300. The above-described data are merely examples of data received or generated by the terminal 200, and a type of data may be changed according to the setting of a user.

Figure 37:
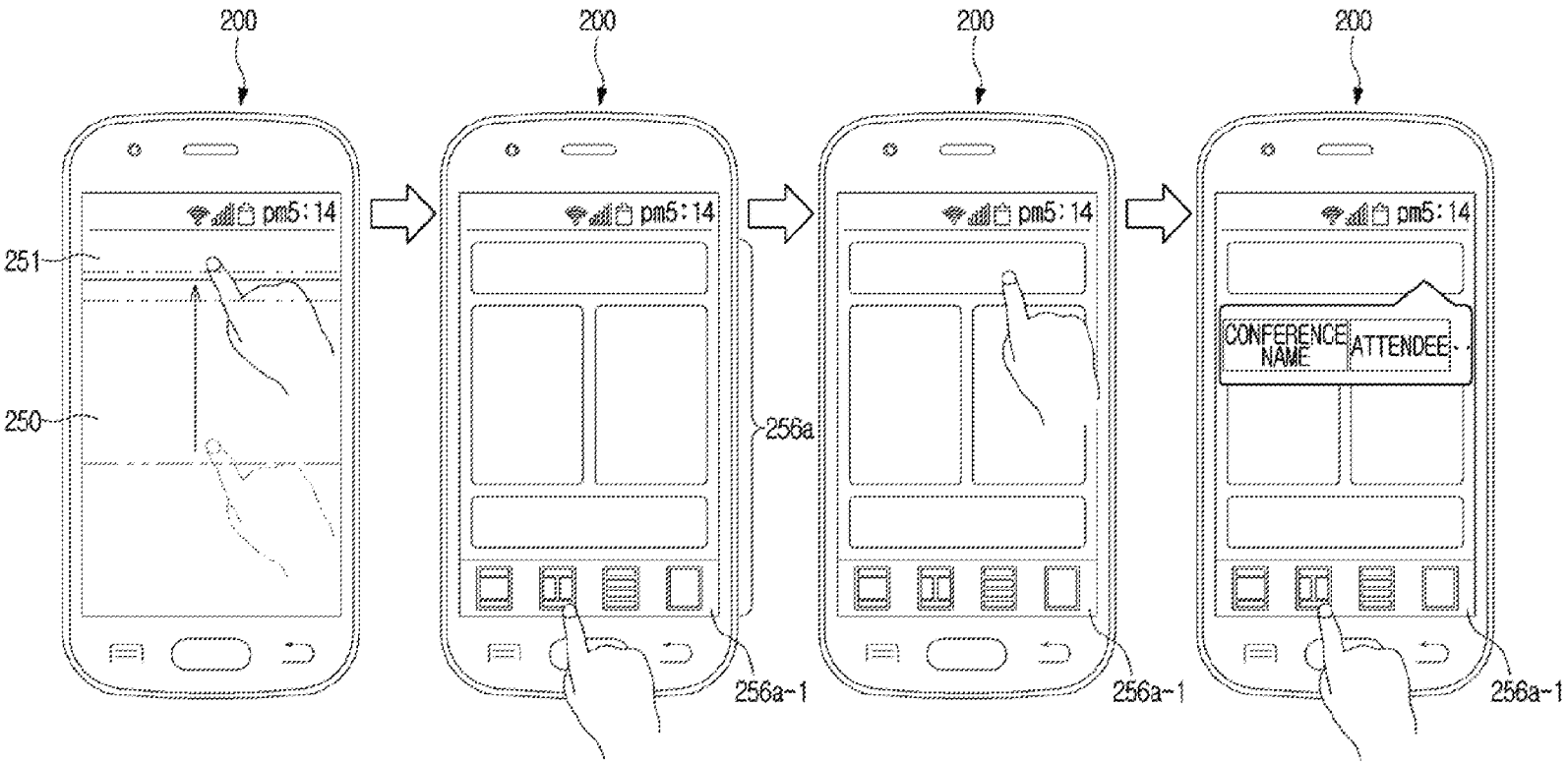
FIG. 37 is a view showing an example of creating a report on the conference result using the terminal.

FIG. 37 is a view showing an example of creating a report on the conference result using the terminal.

A user may create a report on a conference result using the terminal. In this case, another report creating program in addition to the note print program may be used, but a report creating function provided in the note print program is used in the example.

Referring to FIG. 37, when a user drags the note window 251 and moves this upward, a screen 256*a* for selecting a report template is displayed. A list of templates 256*a*-1 may be displayed at the bottom of the screen 256*a* for selecting a template, and a user may select a desired template among the list of templates 256*a*-1.

When a user selects a desired template, the selected template is enlarged and displayed at the top of the screen 256*a* so as to create a report using the selected template. When a user selects a blank of a template, an input menu for inputting contents into the blank is activated. When the input menu is activated, it is possible to input a conference name, an attendee, a conference date/time, a whole note, a structured note, an analysis result, and the like into each blank. The user may simply create a report by inputting desired contents using the activated input menu.

On the other hand, a report may be created by the terminal 200 by downloading pieces of information from the server 300, and may be created by the server 300 having information when a user designates only contents to be input into a report template and respective blanks configuring a template using the terminal 200. A report created by the terminal 200 or a report template generated in the terminal 200 may be registered to the server 300.

Figure 38A:
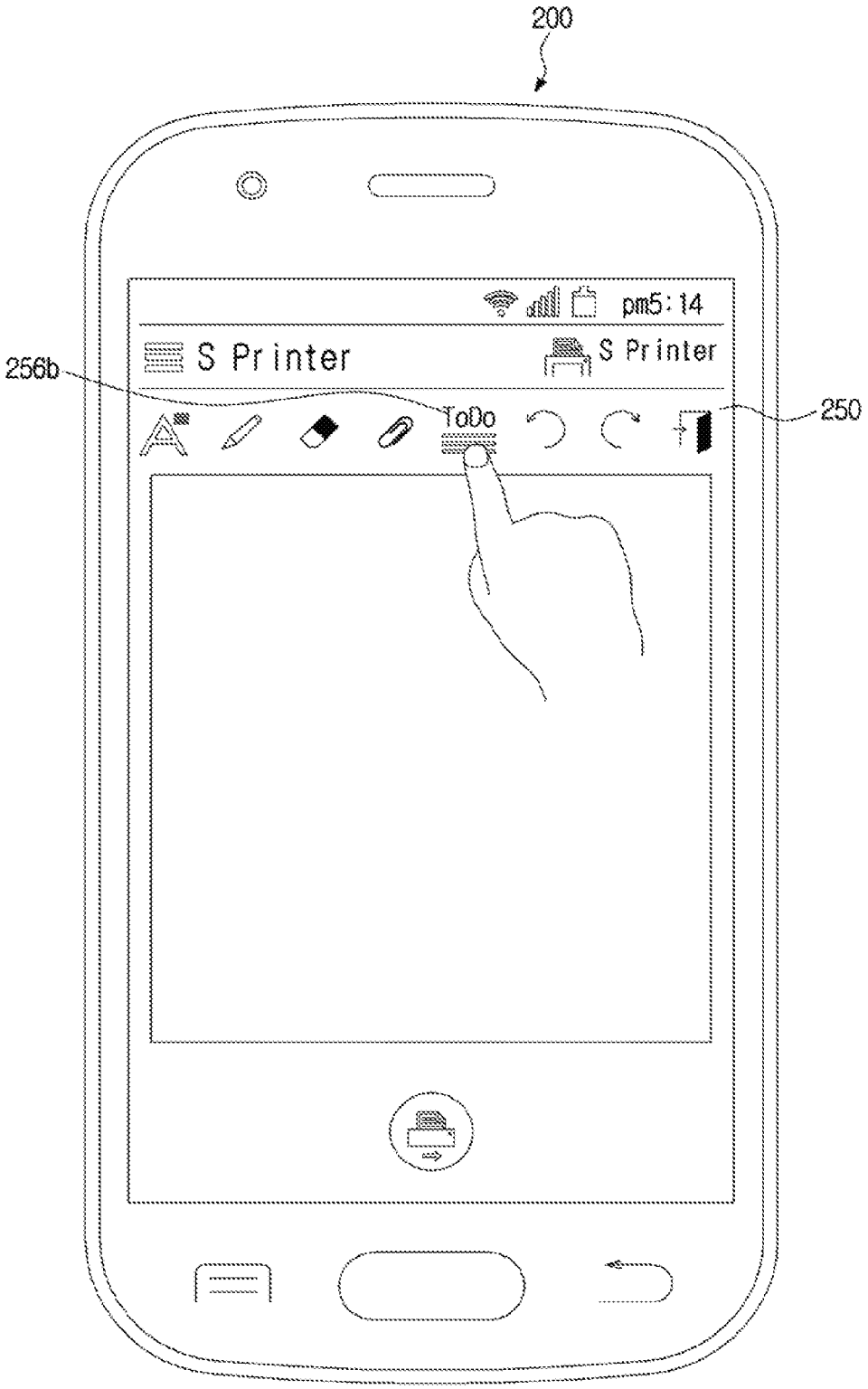
FIGS. 38A to 38C are views respectively showing an example of setting a default template of a printer using the terminal.
Figure 38B:
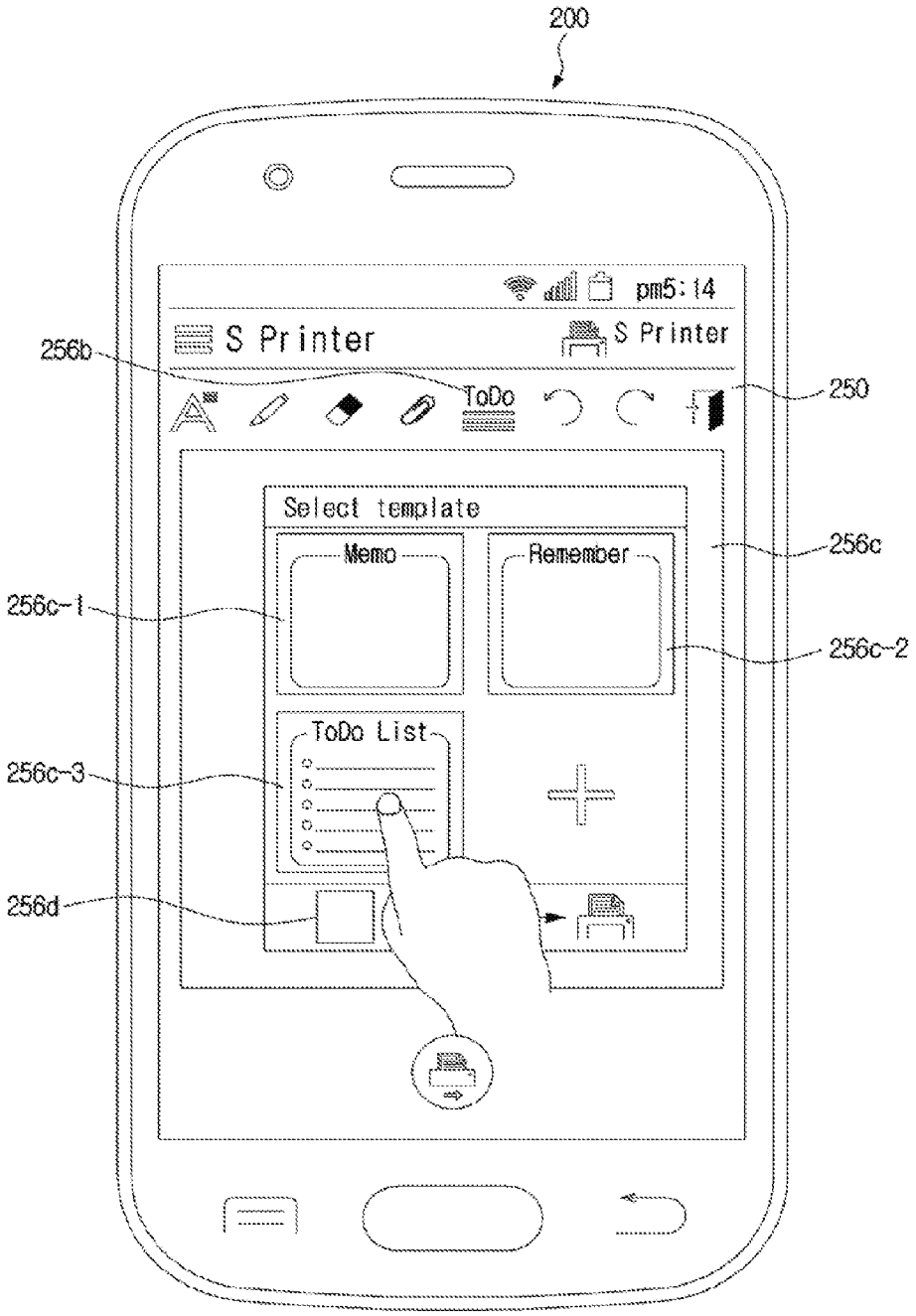
Figure 38C:
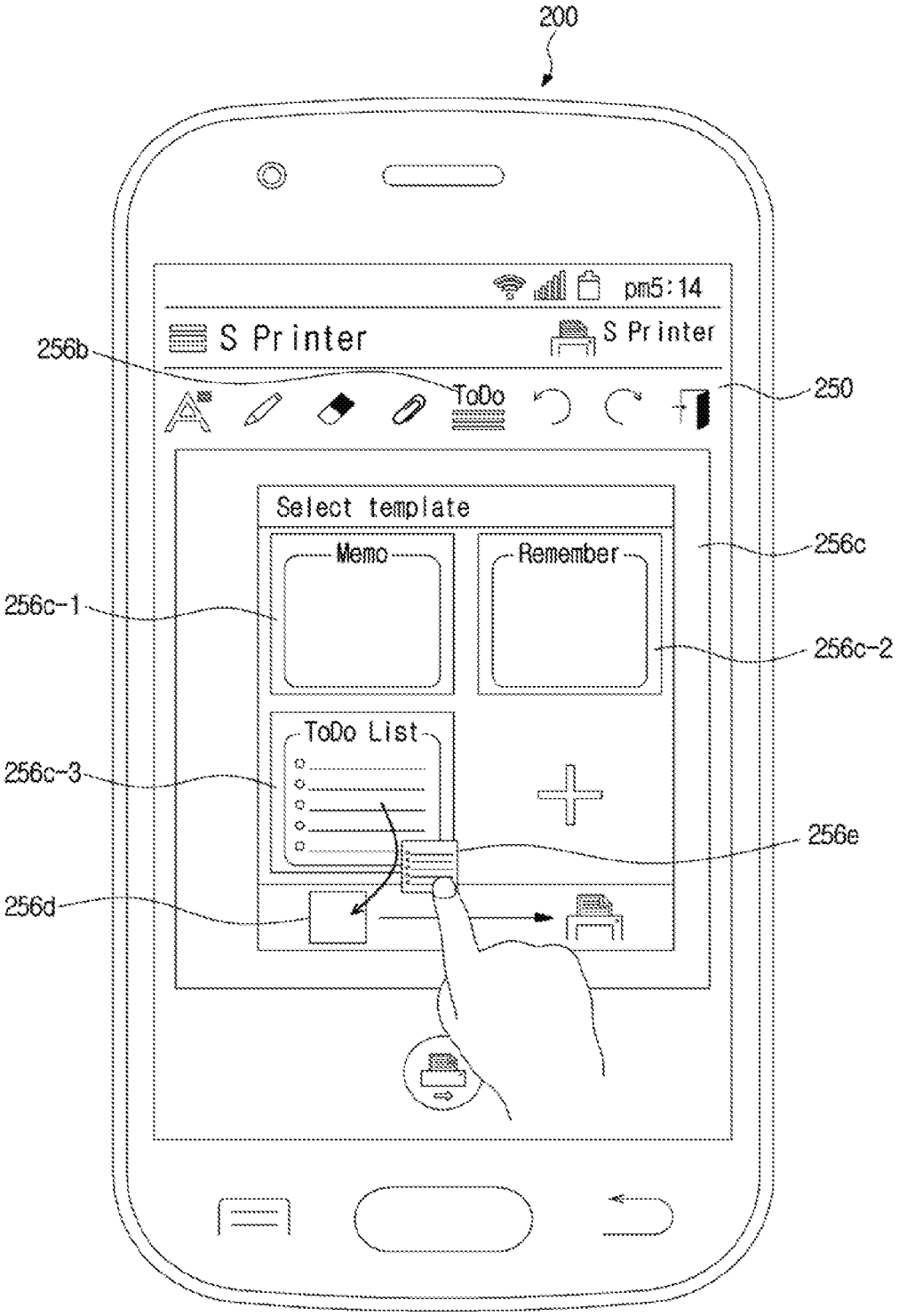

FIGS. 38A to 38C are views respectively showing an example of setting a default template of a printer using the terminal.

As described above, the printer 100 may output the report created by the terminal 200 or the server 300, or may cause a user to manually create a report by outputting a default template set in advance. Alternatively, when contents of a report, that is, contents to be created in a report, are created by the terminal 200 or the server 300 and transmitted to the printer 100, the printer 100 may output a report according to the default template set in advance.

The default template of the printer 100 may be set or changed by a user, and a user may set or change the default template of the printer 100 using the terminal 200.

For example, as illustrated in FIG. 38A, the display unit 250 of the terminal 200 may display a template setting icon 256*b*, and when a user selects the template setting icon 256*b*, a template list 256*c* including an icon corresponding to a template which may be set as a default template may be displayed as illustrated in FIG. 38B.

A plurality of template icons 256*c*-1, 256*c*-2, and 256*c*-3 may be included in the template list 256*c*, and when a user selects one of the plurality of template icons 256*c*-1, 256*c*-2, and 256*c*-3, a template corresponding to the selected template icon may be set as the default template of the printer 100.

In order to guide a selection of a user, the plurality of template icons 256*c*-1, 256*c*-2, and 256*c*-3 may respectively show the configuration of a corresponding template.

A user may simply touch and select a desired template icon; however, it is also possible to apply a drag and drop method of dragging the thumbnail image 256*e* generated by touching a desired template icon longer than a time set in advance to a position of the template setting blank 256*d* and dropping the thumbnail image as illustrated in FIGS. 38B and 38C.

When the thumbnail image 256*e* is dropped in the template setting blank 256*d*, a template corresponding to the thumbnail image 256*e* is set as a default template, and the set default template is downloaded to the printer 100. The printer 100 may output the template set as a default template to be output when outputting a report.

Figure 39:
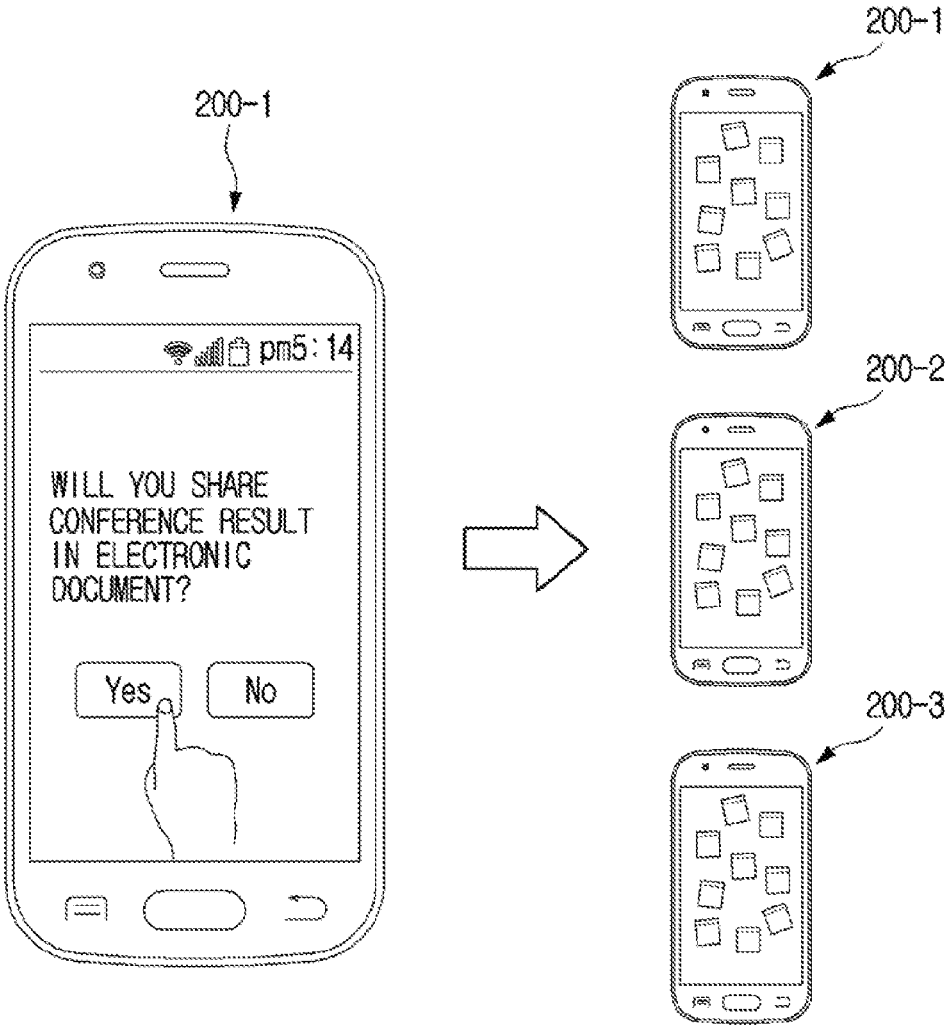
FIGS. 39 and 40 are views respectively showing an example of sharing the conference result when the conference ends.
Figure 40:
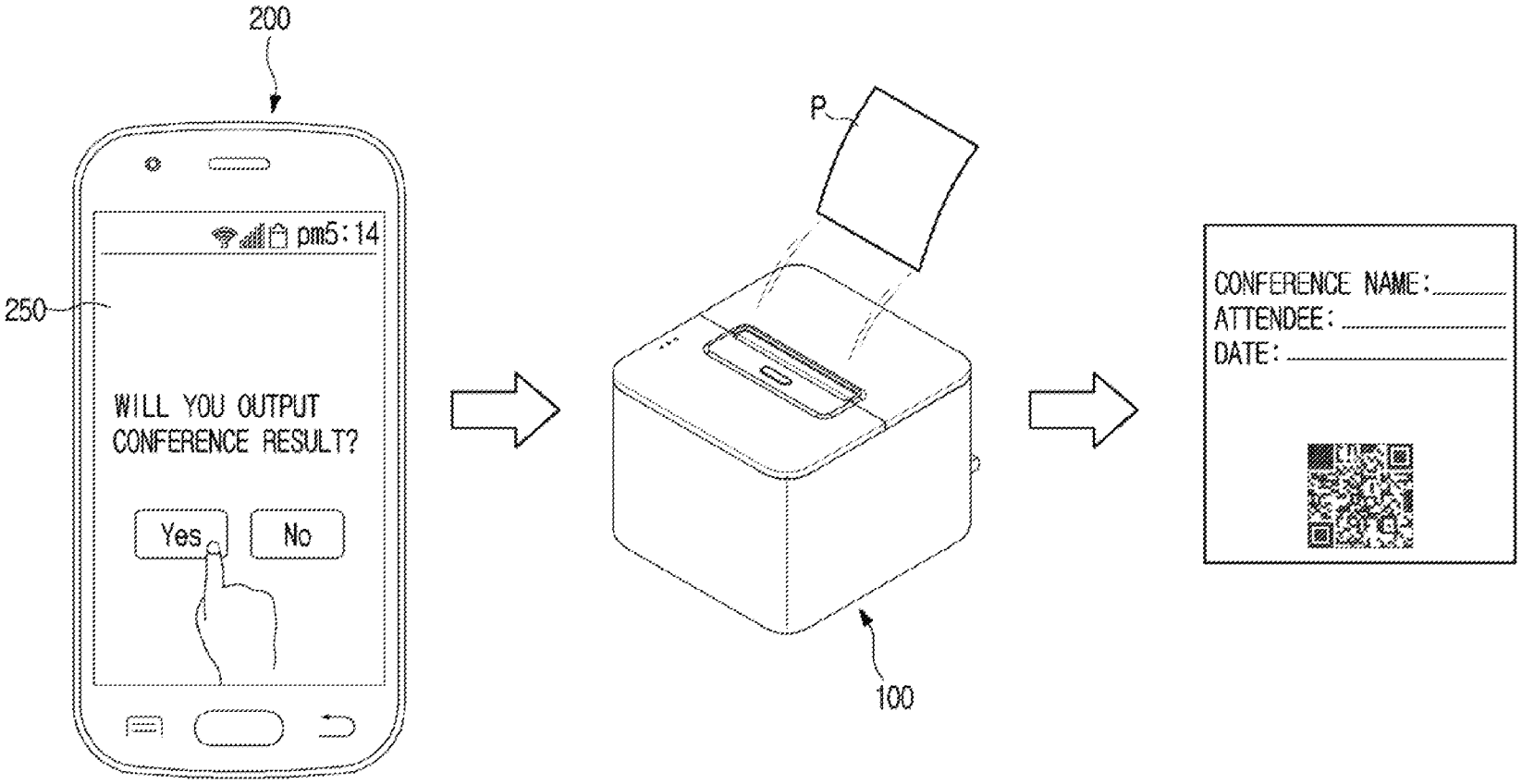

FIGS. 39 and 40 are views respectively showing an example of a method of sharing a conference result when a conference is completed.

When a conference is completed, the host user may input a conference completion command to his/her own terminal 200, and the terminal 200 may transmit the conference completion command to the server 300. When the conference completion command is transmitted, the server 300 may create a report using a registered report template and stored pieces of information.

A report created by the terminal 200 or the server 300 may be provided to all conference attendees. For example, the server 300 may transmit the registered report to the terminals 200 of the conference attendees, or register the reports in a web server which may be accessed by the conference attendees.

In the former case, as illustrated in FIG. 39, a message confirming whether to share the conference result in an electronic document is displayed on a terminal 200-1 of the host user, and when the host user selects a Yes button, a report in an electronic document form may be transmitted to terminals 200-1, 200-2, and 200-3 of the host user and the guest user.

In the latter case, as illustrated in FIG. 40, a message confirming whether to output the conference result is displayed on the terminal 200-1 of the host user, and when the host user selects a Yes button, the printer 100 prints a URL or QR code indicating a web site address to share the report registered in the web server with on the paper P and outputs the paper. The output paper P may be distributed to the conference attendees, and the conference attendees may access the web server in which the report is registered by directly inputting the URL address printed on the paper P to a mobile terminal or a personal computer, or by capturing the QR code.

Figure 41A:
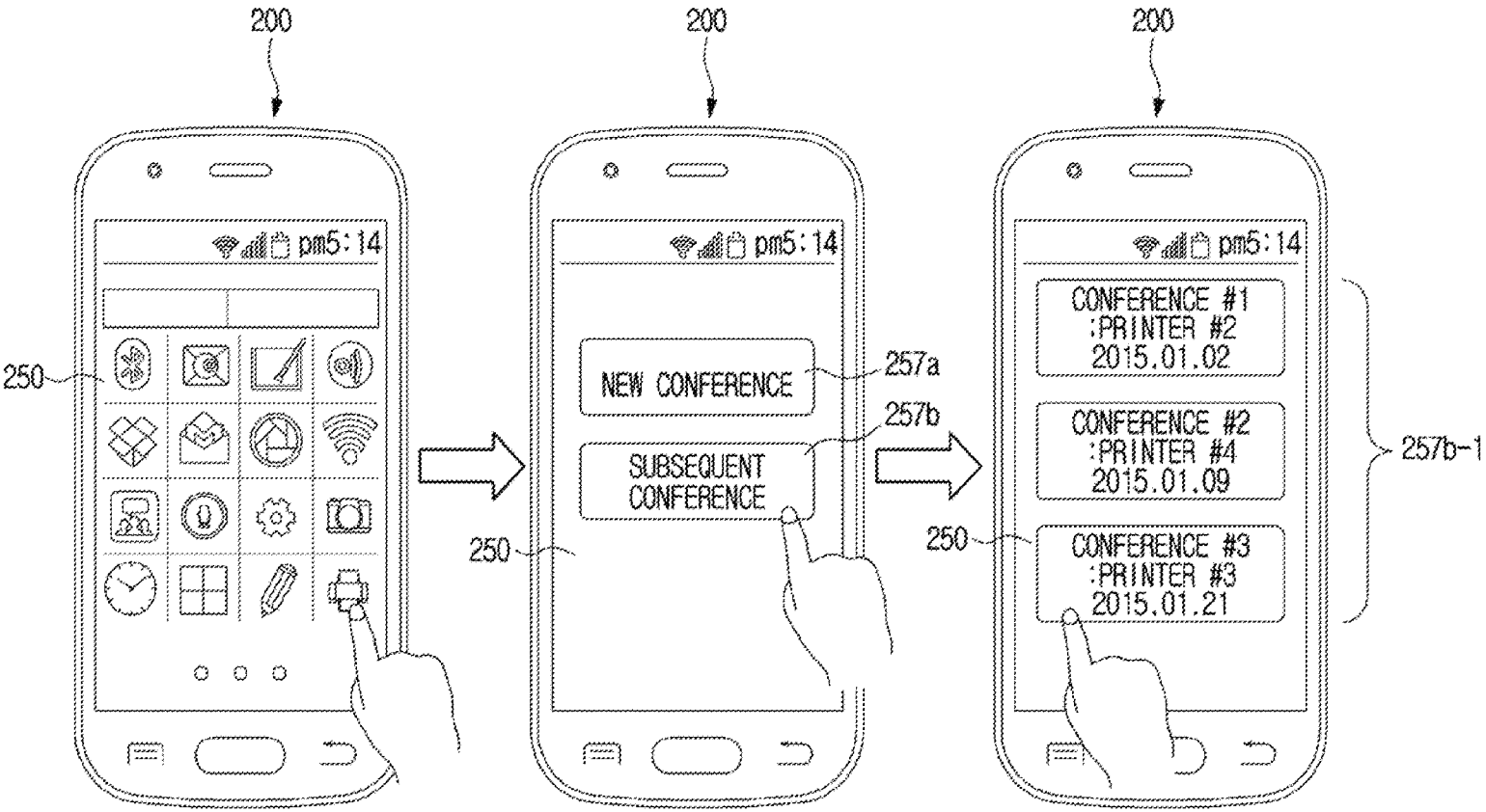
FIGS. 41A and 41B are views respectively showing an example to resume an interrupted conference when the conference is interrupted.
Figure 41B:
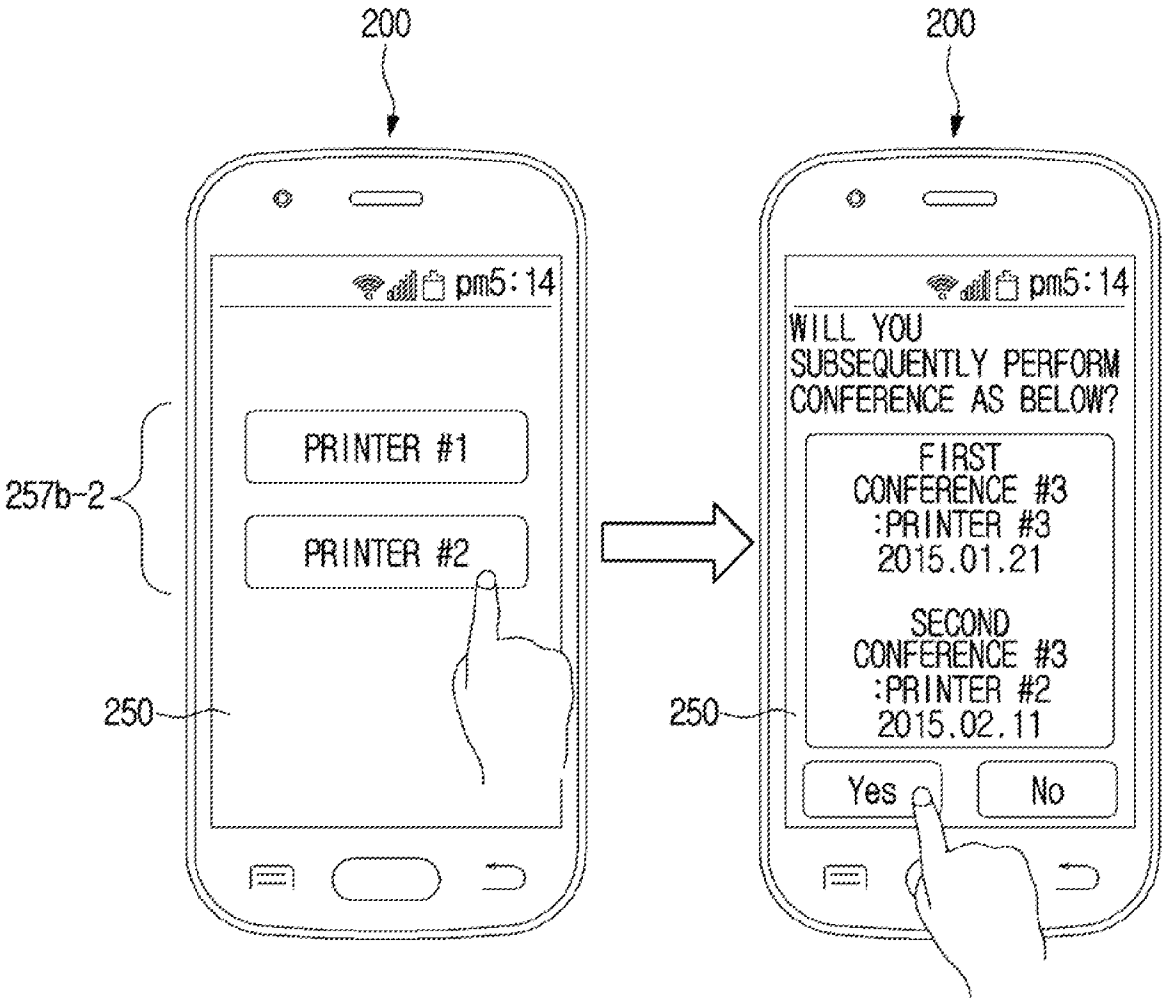

FIGS. 41A and 41B are views respectively showing an example to resume an interrupted conference when the conference is interrupted.

Referring to FIGS. 41A and 41B, when the host user selects an icon 250*a* for executing a note print program installed in the terminal 200, the note print program is executed and the terminal 200 is connected to the server 300.

When there is a conference interrupted before, the display unit 250 may display a new conference button 257*a* and a subsequent conference button 257*b*, and when the host user selects the subsequent conference button 257*b*, a list of conferences 257*b*-1 previously interrupted may be displayed.

When the host user selects a conference to be currently resumed among the list of conferences 257*b*-1 previously interrupted, the terminal 200 may search for available printers for the conference and display a list of printers 257*b*-2 on the display unit 250. When the user selects a desired printer, the display unit 250 may display conference information along with a message confirming whether to finally resume the conference. When the host user selects a Yes button, a virtual conference room is re-generated, and pieces of information collected, used, or generated in a previous conference may be re-used as they are. To this end, the server 300 may not delete pieces of information stored in a storage space assigned to a virtual conference room before the conference completion command is transmitted.

Figure 42:
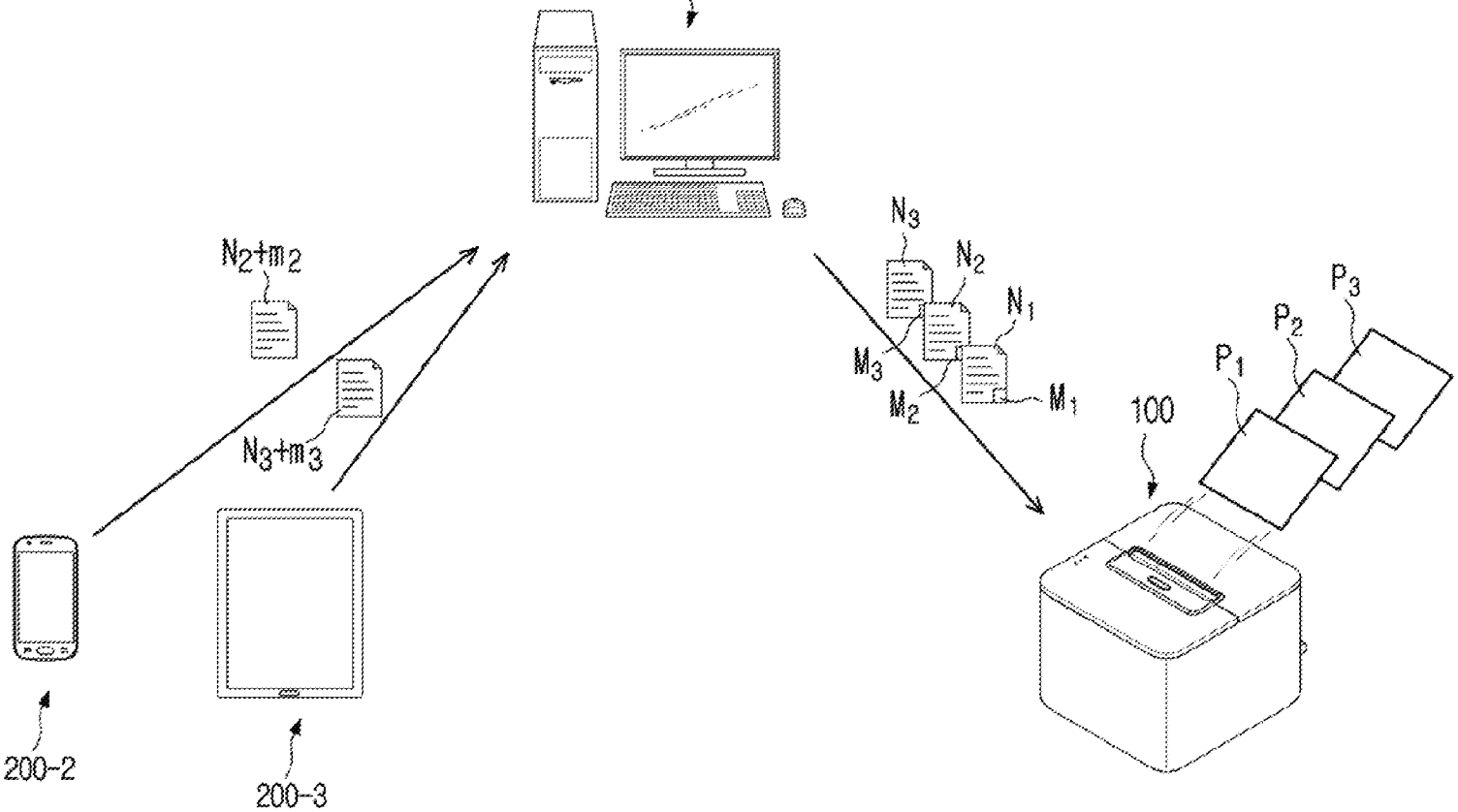
FIG. 42 is an example when the terminal of the host user functions as a server and proceeds with the conference.

FIG. 42 is an example when the terminal of the host user functions as a server and proceeds with the conference.

On one hand, a virtual conference room is generated in the server 300 and pieces of information related to a conference are stored in the server 300 in the example described above. However, it is also possible to proceed with a conference without using the server 300. In this case, as illustrated in FIG. 42, the terminal of the host user is a master device and functions as a server. Accordingly, it is possible to generate a virtual conference room to the storage unit 220 of the terminal 200-1 of the host user and assign a storage space thereto, and guest users 200-2 and 200-3 may transmit note information $N_2$ and $N_3$ to be used in a conference to the terminal 200 of the host user. It is possible to proceed with a conference in the same manner as above by performing operations performed by the server 300 described above in the terminal 200-1 of the host user which is a master device.

Hereinafter, another example of a screen which is displayed to receive note information to be used in a conference from a user will be described referring to FIGS. 43 to 45.

Figure 43:
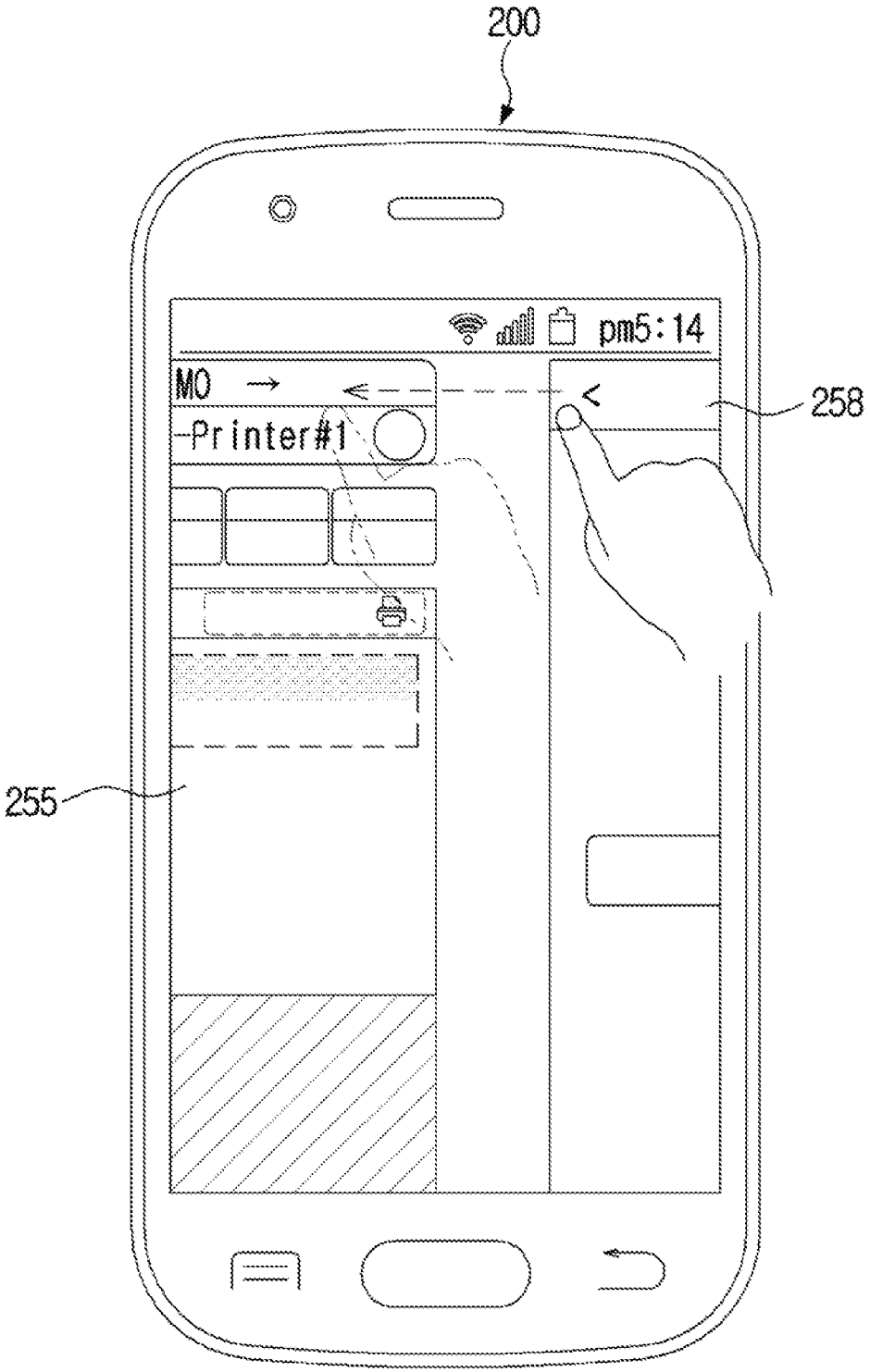
FIG. 43 is a view showing an operation of switching from a memo mode to a conference mode.
Figure 44:
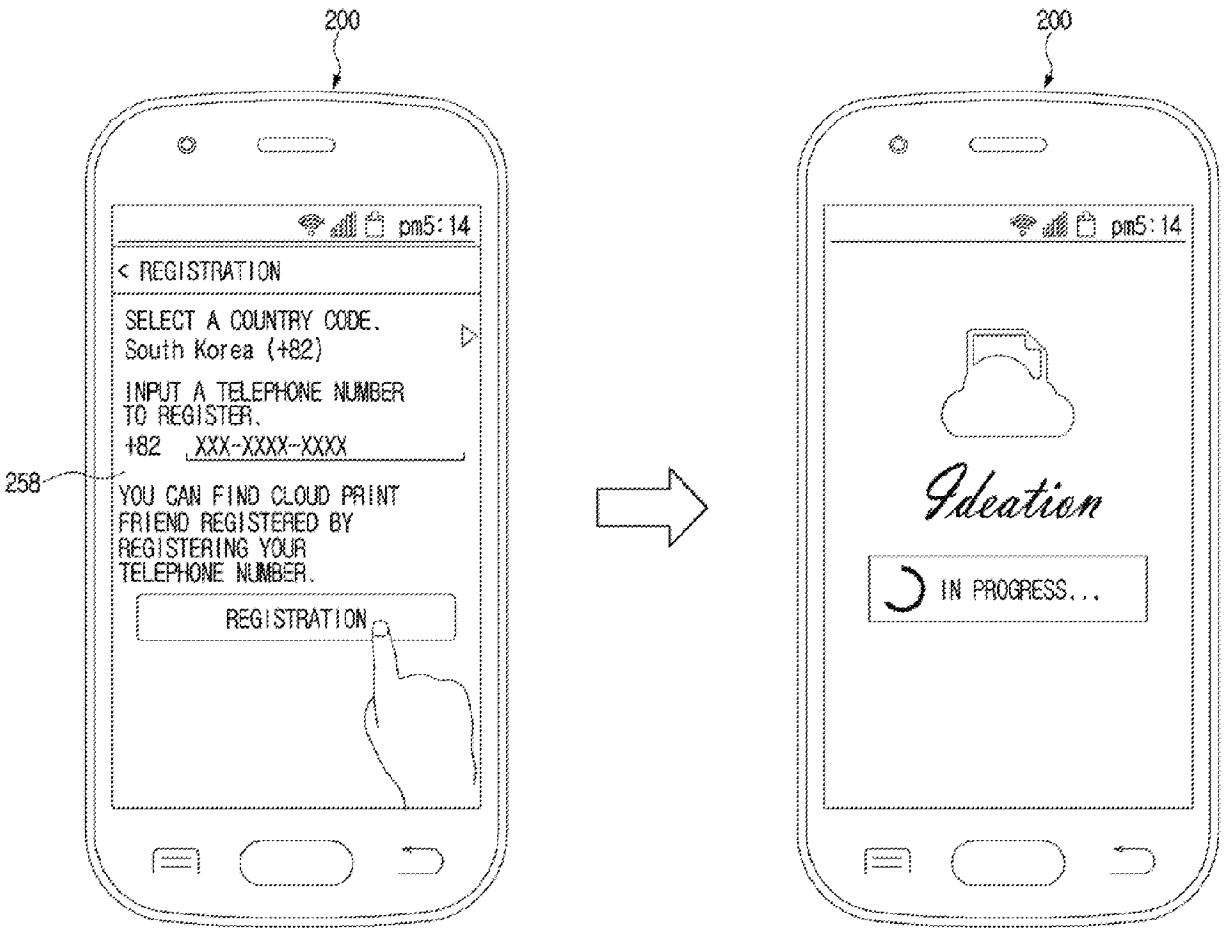
FIG. 44 is a view showing a registration screen when first accessing a conference mode.
Figure 45:
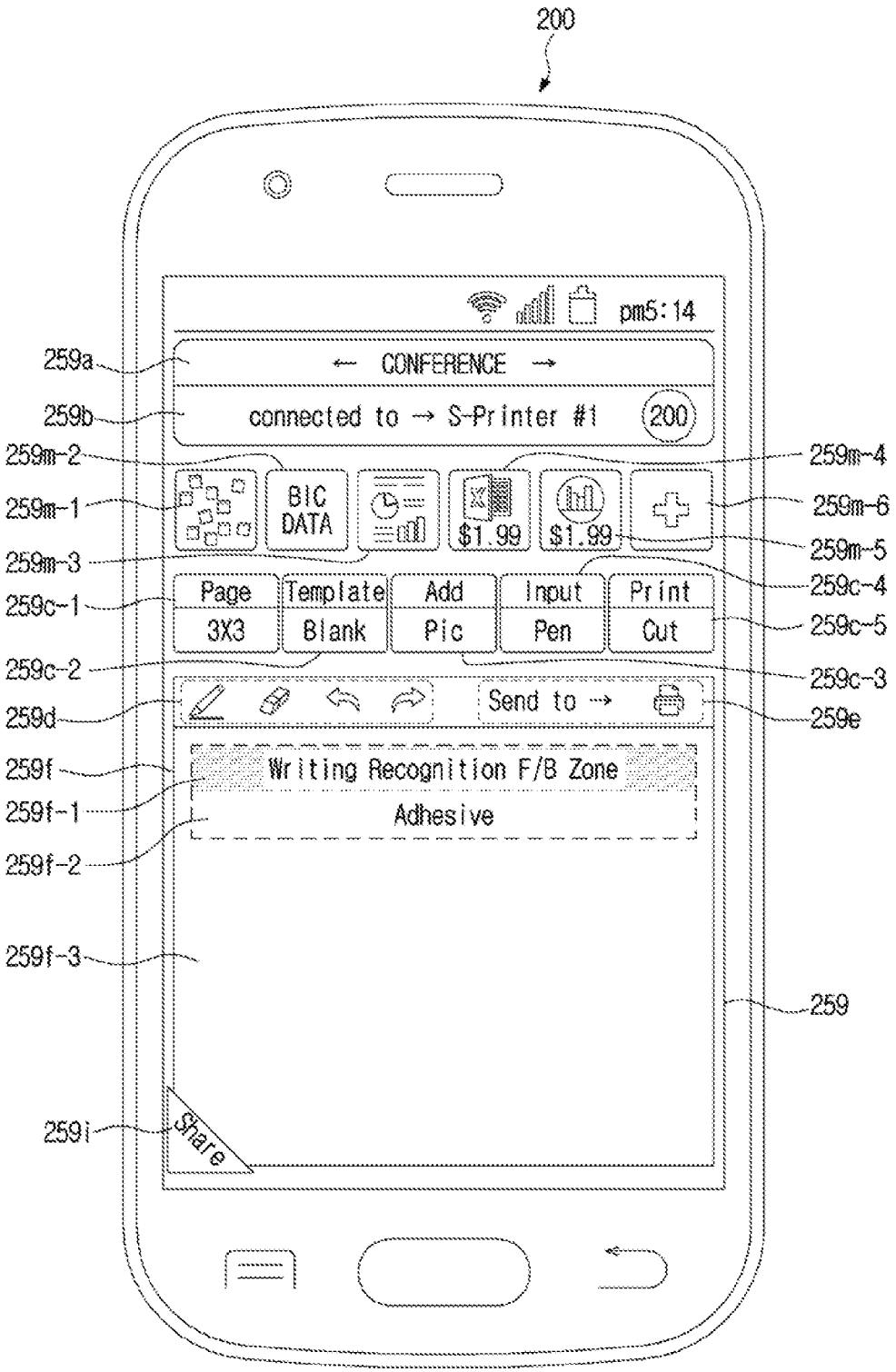
FIG. 45 is a view showing another example of the screen which allows a user to input note information in the conference mode.

FIG. 43 is a view showing an operation of switching from a memo mode to a conference mode, FIG. 44 is a view showing a registration screen when first accessing a conference mode, and FIG. 45 is a view showing another example of the screen which allows a user to input note information in the conference mode.

In the above, another example of the screen displayed on the display unit 250 when the note print program is installed in the terminal 200 and the installed note print program is executed is described referring to FIG. 17.

The memo mode screen 255 shown in FIG. 17 is a screen displayed when a current mode is a memo mode. In the above, a mode conversion may be performed by swipe interaction, and a mode may be converted into a conference mode when a user touches the mode display bar 255*a* and drags it to the left side in the memo mode. It is, of course, possible to drag the mode display bar 255*a* to the right side.

When first converted into the conference mode, a registration screen 258 as illustrated in FIG. 44 is displayed and a user may perform registration by inputting his/her own telephone number. When a mode is converted into the conference mode after the registration, a registration process may be omitted and a conference mode screen may be immediately displayed as illustrated in FIG. 45.

Referring to FIG. 45, a mode display bar 259*a* and a printer setting bar 259*b* may be included in a conference mode screen 259, and a user may convert the conference mode into the memo mode again by swiping the mode display bar 259*a*.

In addition, option selection icons which may be applied to an input of note information for a conference may be further displayed. For example, a page setting icon 259*c*-1, a template setting icon 259*c*-2, an attachment icon 259*c*-3, an input tool setting icon 259*c*-4, and a print setting icon 259*c*-5 may be displayed, and a description of these icons is the same as a description of the memo mode screen of FIG. 17 described above.

A main tool bar 259*d* and a transmission destination selection icon 259*e* used for an input of note information may be displayed, and a position 259*f*-2 of an adhesive region and a feedback 259*f*-1 on a handwriting recognition result are displayed at the top of the note window 259*f* for inputting note information. Similar to the memo mode, a user may input note information to be created into a note region 259*f*-3 using a set input tool. Similar to the memo mode, it is possible to inform a user which point to touch in order to swipe by displaying an execution icon 259*i* at the vertex of the note window 259*f*.

A result confirmation icon 259*m*-1 for executing a function of confirming note information created by conference attendees, a big data icon 259*m*-2 for executing a function of analyzing big data through a global connection, a report icon 259*m*-3 for executing a function of creating a report on a conference result, an excel icon 259*m*-4 for executing a function of arranging the conference result in Excel, and a statistical icon 259*m*-5 for executing a function of statistically analyzing the conference result may be further displayed on the conference mode screen 259.

It is also possible to further display a function addition icon 259*m*-6 so that a user further adds a desired function.

The screen according to the example of FIG. 45 described above is merely an example of a screen displayed to execute the conference mode, and, of course, a screen of various configurations may be displayed in addition to the example.

On the other hand, an image forming apparatus according to another embodiment may be embodied not only to print data on the adhesive paper P and but also to correct the curl of the paper P and output the paper or to allow a printed recording medium to be popped out (discharged) through an outlet. Hereinafter, an operation and a structure of an image forming apparatus according to an embodiment will be described in detail.

Figure 46:
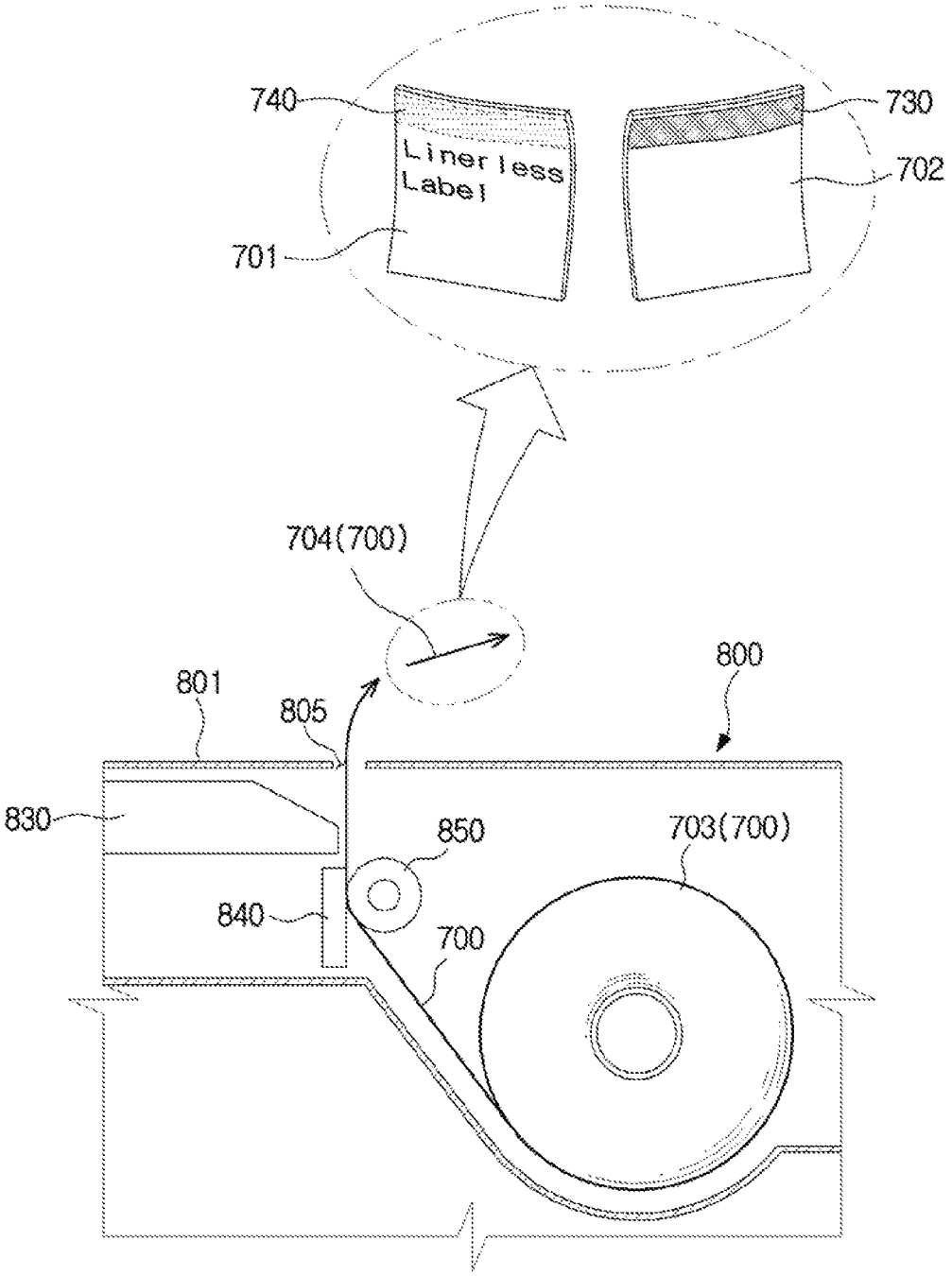
FIG. 46 is a view schematically illustrating a process of performing printing on a recording medium in accordance with an embodiment of the disclosure through the image forming apparatus.

FIG. 46 is a view schematically illustrating a process of performing printing on a recording medium through the image forming apparatus. In an embodiment to be described below, the recording medium refers to a paper, and particularly refers to an adhesive paper.

Referring to FIG. 46, an image forming apparatus 800 and a recording medium 700 according to an embodiment will be described.

An image may be embodied on the recording medium 700 through the image forming apparatus 800. The recording medium 700 may be mounted to the image forming apparatus 800 in a state of being continuously wound in a roll form. The recording medium 700 wound in the roll 703 form may be continuously transferred to a printing unit 840 and 850 of the image forming apparatus 800 while being unwound from the roll 703.

The printing unit 840 and 850 may be configured of a thermal head 840 for performing printing on the recording medium 700 and a platen roller 850 which transfers the recording medium 700 and supports the recording medium 700 by being pressed against the thermal head 840 interposed the recording medium 700 therebetween.

The thermal head 840 has a plurality of heat generating elements and selectively causes some of the plurality of heat generating elements to generate heat. When the thermal head 840 generates heat, the recording medium 700 may perform coloring in response thereto. For example, only a portion of the recording medium 700 which is heated by the thermal head 840 may be changed into black. For this, the recording medium 700 may include a thermal layer (720, thermal layer, FIG. 48).

The continuous recording medium 700 passing through the printing unit 840 and 850 may be cut into a unit recording medium 704 by a cutter 830.

The unit recording medium 704 (the cut recording medium) may be discharged to the outside of the image forming apparatus 800 through an outlet 805. The outlet 805 may be formed in a housing 801 of the image forming apparatus 800.

The recording medium 700 has a front surface 701 and a rear surface 702. An image may be printed on the front surface 701 by the image forming apparatus 800.

An adhesive layer 730 having adhesiveness may be provided on the rear surface 702 of the recording medium 700 to attach the recording medium 700 to a required place. The adhesive layer 730 may have appropriate re-adhesiveness to detach the attached recording medium 700 again and to re-attach the detached recording medium 704.

A release layer 740 may be provided on the front surface 701 of the recording medium 700. The release layer 740 may prevent the front surface 701 and the rear surface 702 of the recording medium 700 from being attached to each other by the adhesive layer 730 in a state in which the recording medium 700 is wound in the roll form, and cause the front surface 701 and the rear surface 702 of the recording medium 700 to be detached from each other well in a process in which the recording medium 700 is unwound.

The release layer 740 may be formed from a releasing agent such as silicon resin, polyvinyl alcohol, paraffin, or wax.

Figure 47:
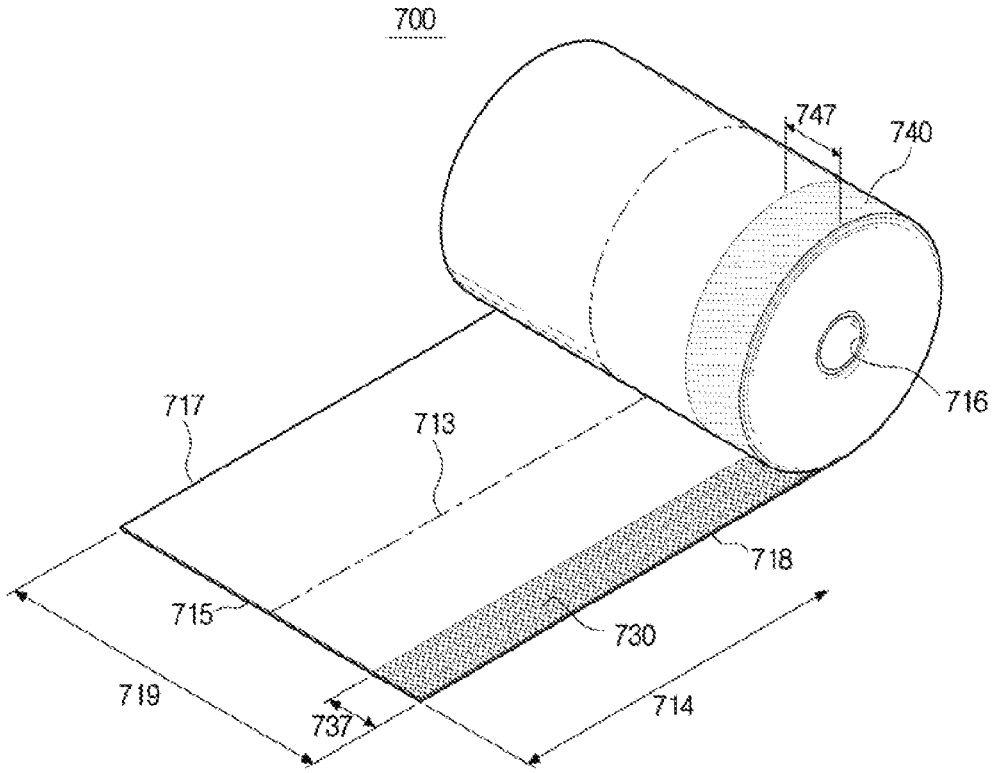
FIG. 47 is a view illustrating a state in which the recording medium in accordance with an embodiment of the disclosure is wound in a roll form.

FIG. 47 is a view illustrating a state in which the recording medium in accordance with an embodiment of the disclosure is wound in the roll form.

Figure 48:
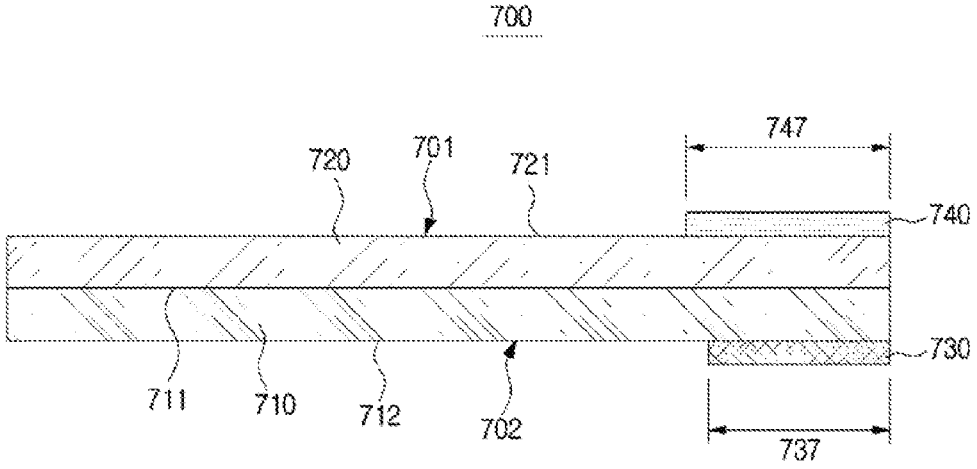
FIG. 48 is a cross-sectional view of the recording medium in accordance with one embodiment of the disclosure.

FIG. 48 is a cross-sectional view of the recording medium in accordance with an embodiment of the disclosure.

Figure 49:
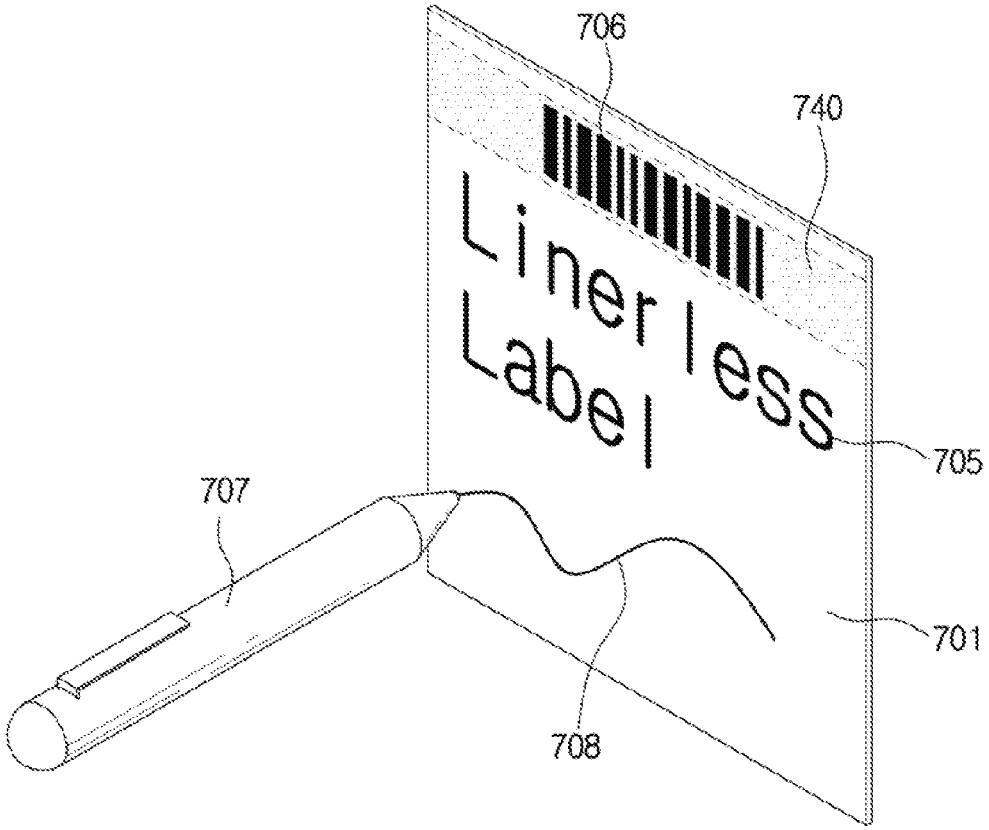
FIG. 49 is a view illustrating an operation of manually performing recording after an image is printed on the recording medium in accordance with an embodiment of the disclosure through the image forming apparatus.
Figure 50:
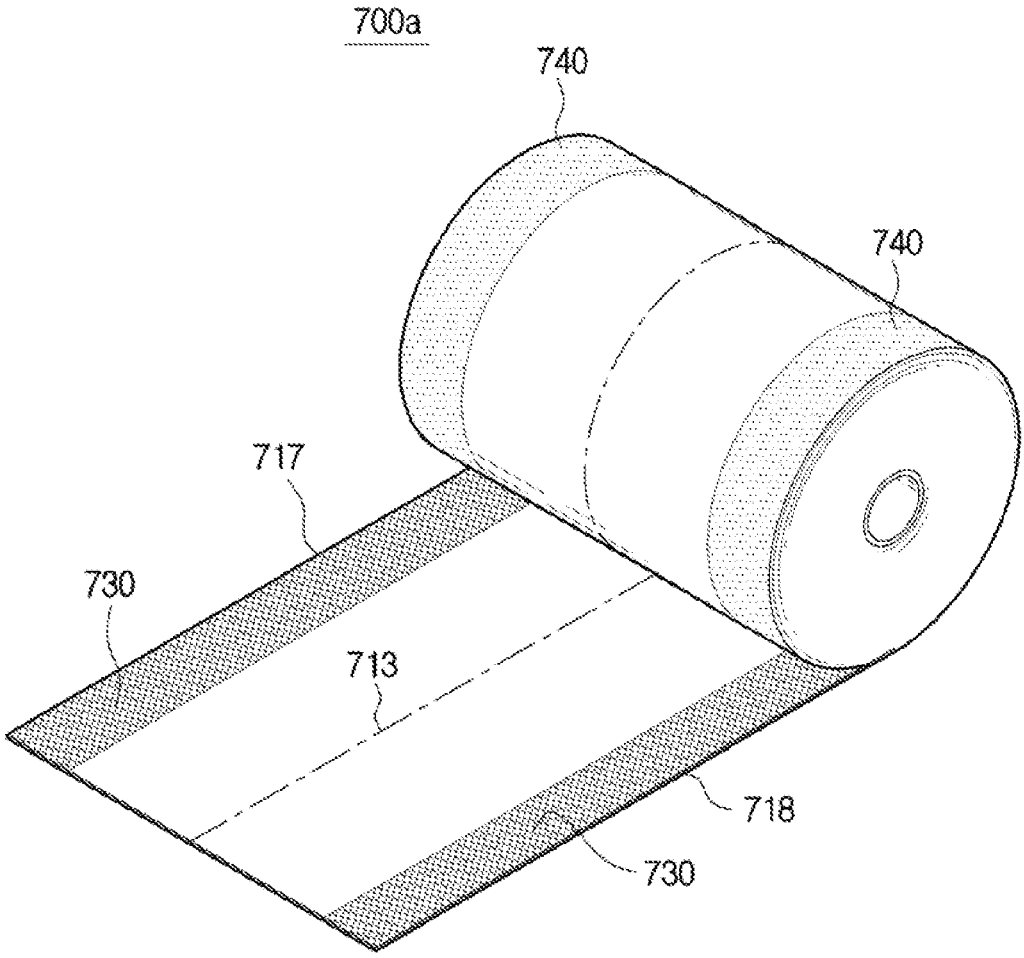
FIG. 50 is a view illustrating a recording medium in accordance with an embodiment of the disclosure.

FIG. 49 is a view illustrating an operation of manually performing a recording after an image is printed on the recording medium in accordance with one embodiment of the disclosure through the image forming apparatus. FIG. 50 is a view illustrating a recording medium according to an embodiment of the disclosure.

As illustrated in FIGS. 47 and 48, the recording medium 700 may include a substrate 710, a thermal layer 720 provided on a front surface 711 of the substrate 710, an adhesive layer 730 provided on a rear surface 712 of the substrate 710, and a release layer 740 provided on a front surface 721 of the thermal layer 720.

The substrate 710 may be various types of paper or plastic as a basic material for a coupling. The substrate 710 is wound in the roll form.

The thermal layer 720 may be formed by applying a thermal agent onto the front surface 711 of the substrate 710. The thermal layer 720 may be provided over an entire region of the substrate 710 on the front surface 711 of the substrate 710. Accordingly, printing may be performed on the entire region of the recording medium 700 by the thermal type image forming apparatus 800.

The adhesive layer 730 may be formed by applying an adhesive onto the rear surface 712 of the substrate 710. The adhesive layer 730 may be provided only in a portion of the substrate 710 on the rear surface 712 of the substrate 710.

For example, the adhesive layer 730 may be provided to have a width 737 smaller than a width 719 of the substrate 710 and to be continuous in an entire section between a front end 715 and a rear end 716 in a length direction 714 of the substrate 710.

The adhesive layer 730 may be provided only on one side based on a center line 713 in the length direction of the substrate 710. The adhesive layer 730 may be provided to be adjacent to a left end 717 ora right end 718 of the substrate 710.

The release layer 740 may be formed by applying a release agent to the front surface 721 of the thermal layer 720. The release layer 740 may be provided only in a portion of the substrate 710.

For example, the release layer 740 may be provided to have a width 747 smaller than the width 719 of the substrate 710 and to be continuous in the entire section between the front end 715 and the rear end 716 in the length direction 714 of the substrate 710.

In order to prevent the adhesive layer 730 from deviating from the release layer 740 even if there is a sorting error when the recording medium 700 is wound in the roll form, the width 747 of the release layer 740 is provided larger than the width 737 of the adhesive layer 730.

The release layer 740 may be provided only on one side on which the adhesive layer 730 is provided based on the center line 713 in the length direction of the substrate 710. The release layer 730 may be provided to be adjacent to the right end 717 or the left end 718 of the substrate 710.

As illustrated in FIG. 49, a user may manually performing a recording 708 using an input apparatus (e.g., a pen) 707 after an image 705 is printed on a front surface 701 of the recording medium. Also, as shown in FIG. 49 and as discussed above, a marker 706 may be printed in the region of the release layer 740, on an opposite side of the adhesive layer 730.

As illustrated in FIG. 50, the adhesive layer 730 of a recording medium 700*a* may be provided on both sides based on the center line 713 in the length direction of the substrate 710. The adhesive layer 730 on the left side is provided to be adjacent to the right end 717 of the substrate 710, and the adhesive layer 730 on the right side is provided to be adjacent to the left end 718 of the substrate 710.

Figure 51:
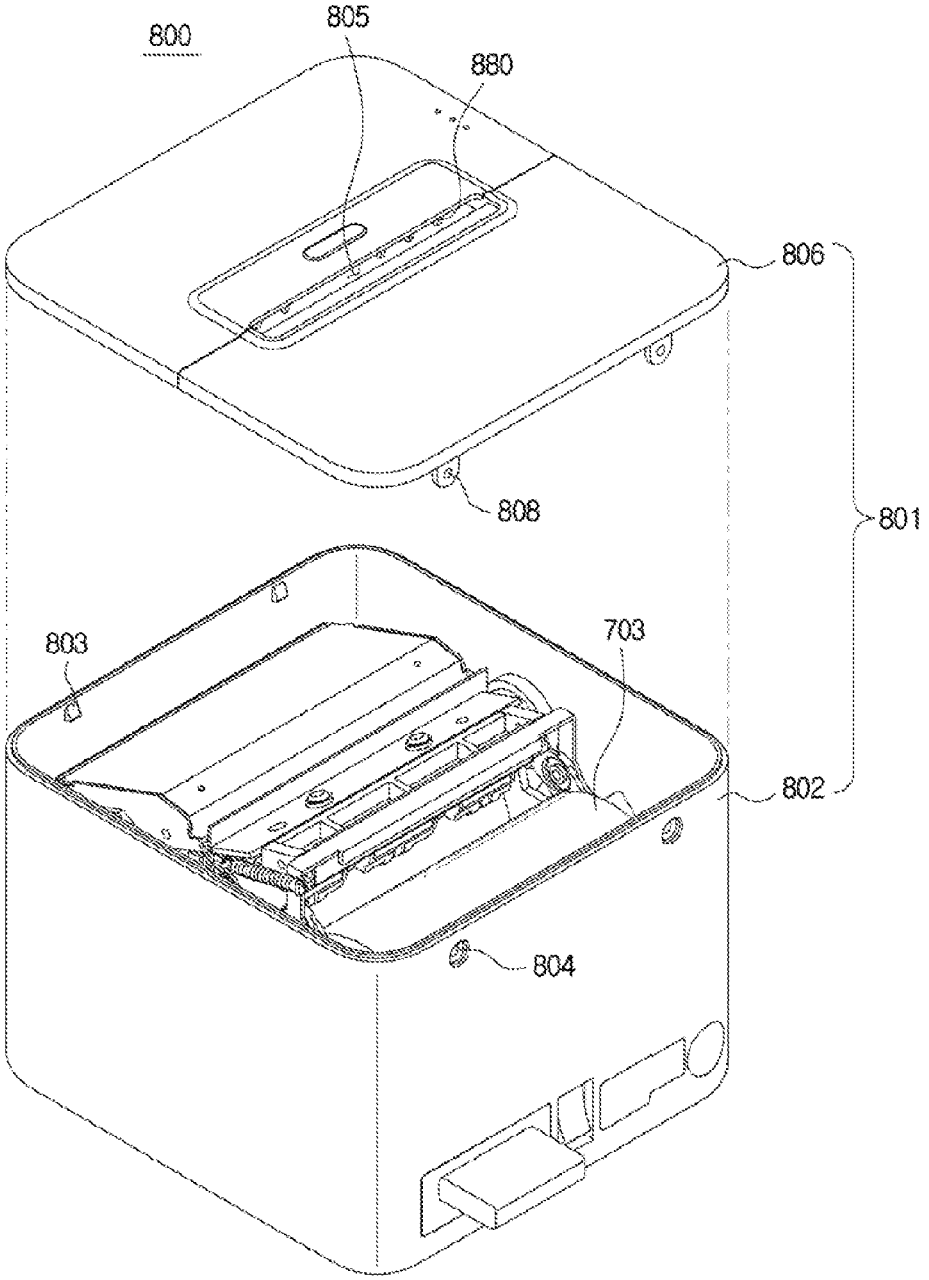
FIG. 51 is a perspective view illustrating an outer appearance of the image forming apparatus in accordance with an embodiment of the disclosure.
Figure 52:
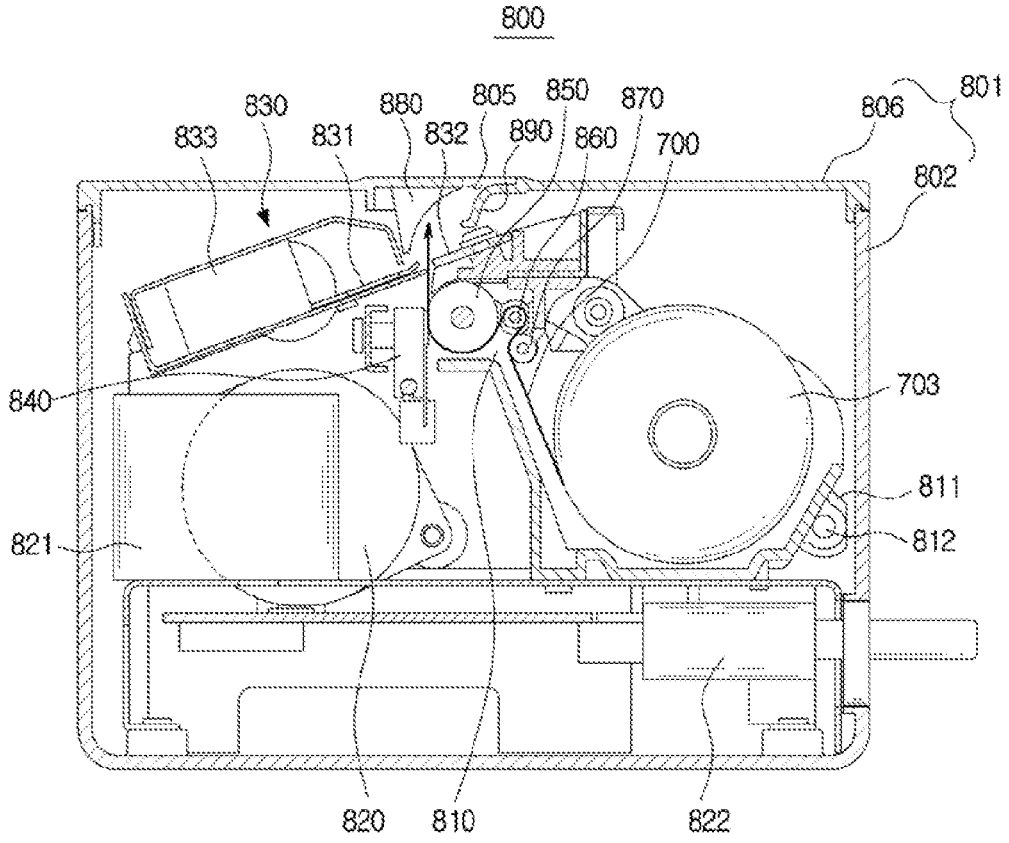
FIG. 52 is a side cross-sectional view illustrating a schematic structure of the image forming apparatus in accordance with an embodiment of the disclosure.
Figure 53:
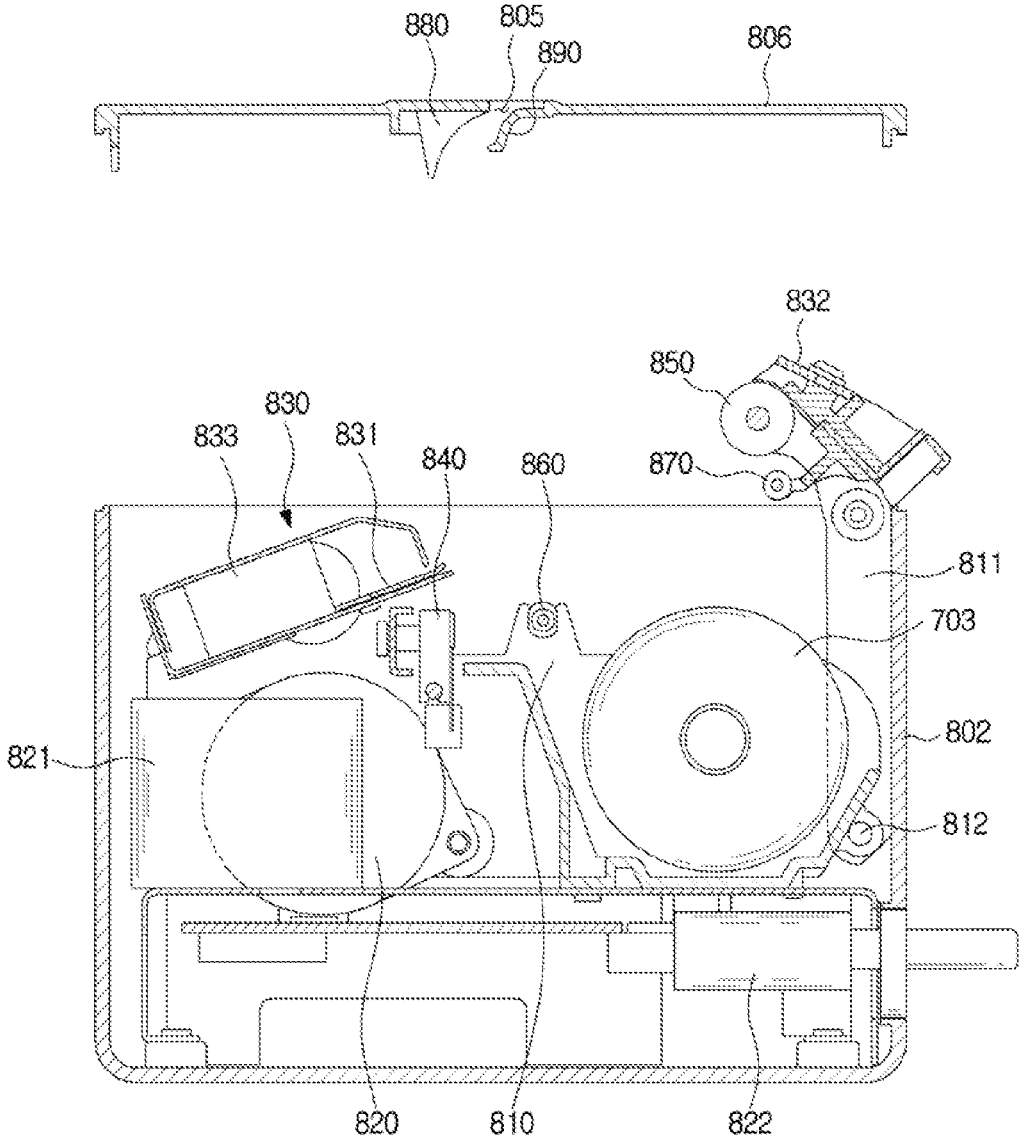
FIG. 53 is a view illustrating a state in which a platen roller and a second de-curl roller of the image forming apparatus in accordance with an embodiment of the disclosure are rotated.
Figure 54:
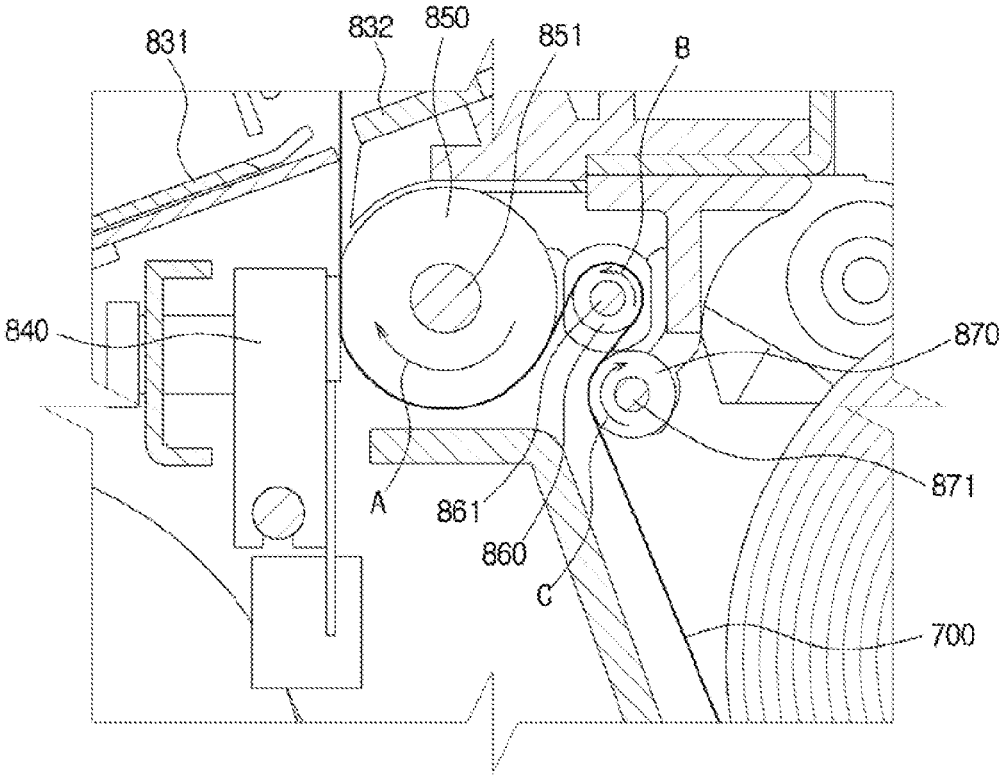
FIG. 54 is a view illustrating an enlarged de-curl unit of the image forming apparatus in accordance with an embodiment of the disclosure.

FIG. 51 is a perspective view illustrating an outer appearance of the image forming apparatus in accordance with an embodiment of the disclosure. FIG. 52 is a side cross-sectional view illustrating a schematic structure of the image forming apparatus in accordance with an embodiment of the disclosure. FIG. 53 is a view illustrating a state in which a platen roller and a second de-curl roller of the image forming apparatus in accordance with an embodiment of the disclosure are rotated. FIG. 54 is a view illustrating an enlarged de-curl unit of the image forming apparatus in accordance with an embodiment of the disclosure.

Referring to FIGS. 51 to 54, a structure and a de-curl unit of an image forming apparatus according to an embodiment will be described.

In the following, it is described that the recording medium 700 described above, that is, a thermal paper having an adhesive layer, is used in the image forming apparatus 800; however, it is not limited thereto. A plain paper may be used in the image forming apparatus 800 of the disclosure.

The image forming apparatus 800 may include the housing 801, the printing unit 840 and 850 which is placed in the housing 801 and performs printing, and a de-curl unit 860 and 870 which corrects the curl of the recording medium 700 and transfers the recording medium to the printing unit 840 and 850.

The housing 801 may have a substantially box shape. The housing 801 may be formed by combining a lower housing 802 and an upper housing 806. The lower housing 802 has a substantially box shape whose upper surface is open, and the upper housing 806 is provided to cover the open upper surface of the lower housing 802.

The lower housing 802 and the upper housing 806 may be detachably combined. The lower housing 802 and the upper housing 806 may be separated from each other to perform an operation when the recording medium 703 is mounted to the inside of the housing 801 or when replacing or repairing parts in the housing 801, and when the operation is completed, the lower housing 802 and the upper housing 806 may be combined again.

For example, each of the lower housing 802 and the upper housing 806 has an elastic combination projection 803 and a combination groove 807, and the elastic combination projection 803 may be inserted into the combination groove 807 (see FIG. 55) to be detachably combined each other. Fastening holes 804 and 808 are formed in the lower housing 802 and the upper housing 806, respectively, and the lower housing 802 and the upper housing 806 may be combined by fastening additional fastening members (not shown) such as screws, bolts, pins, and rivets into the fastening holes 804 and 808.

Alternatively, the lower housing 802 and the upper housing 806 may be openably hinge-combined. That is, the lower housing 802 may be rotatably combined with the upper housing 806.

The outlet 805 from which the recording medium 700 is discharged to the outside of the housing 801 may be formed in the upper housing 806. However, unlike the embodiment, the outlet 806 may be, of course, provided on a side of the lower housing 802.

The printing unit 840 and 850 may include a thermal head 840 having a plurality of heat generating elements and a platen roller 850 which forms a printing nip between the platen roller and the thermal head 840 and supports the recording medium 700 passing through the printing nip.

The thermal head 840 allows an image to be formed on the recording medium 700 by applying heat to the recording medium 700 passing through the printing nip. The thermal head 840 may be configured to have a plurality of heating resistors, an electrode for heating the heating resistors, and a protective layer for protecting the heating resistors and the electrode.

The platen roller 850 may be in close contact with the thermal head 840 and the recording medium 700 interposed therebetween. The platen roller 850 receives a driving force from a transfer motor 820 and rotates about a rotation axis 851. A power transmission unit (not shown) for a power transmission may be provided between the platen roller 850 and the transfer motor 820. The platen roller 850 may transfer the recording medium 700. The platen roller 850 may have a cylindrical shape.

A recording medium mounting unit on which a recording medium is mounted is provided in the housing 801, and the recording medium 700 may be mounted on the recording medium mounting unit in a state of being continuously wound in the roll form 703.

The de-curl unit 860 and 870 is provided on further upstream side in a moving direction of a recording medium than the printing unit 840 and 850, and corrects the curl of the recording medium 700 and transfers the recording medium to the printing unit 840 and 850. The de-curl unit 860 and 870 may be provided on further upstream side in the moving direction of a recording medium than the printing unit 840 and 850. However, the de-curl units may be provided on a downstream side in the moving direction of a recording medium unlike in the embodiment.

The de-curl unit 860 may include a first de-curl roller 860 which corrects the curl of the recording medium 700 by applying a curve in an opposite direction to the curl of the recording medium 700, and a second de-curl roller 870 which increases the curving amount given by the first de-curl roller.

The first de-curl roller 860 may eliminate or reduce the curl of the recording medium 700 by applying a curve in the opposite direction to the curl of the recording medium 700.

For this reason, the recording medium 700 transferring to the printing unit 840 and 850 is improved in flatness, printing accuracy, and quality, and a paper jam phenomenon that the recording medium 700 is blocked in the printing nip may be prevented.

The first de-curl roller 860 may have a cylindrical shape. The first de-curl roller 860 may be provided to idle rotate about the rotation axis 861. That is, the recording medium 700 may start to move when the platen roller 850 is driven, and the first de-curl roller 860 may be rotated by a friction force of the first de-curl roller 860 with the recording medium 700.

The second de-curl roller 870 increases the curving amount given to the recording medium 700 by the first de-curl roller 860. The second de-curl roller 870 applies a tension to the recording medium 700, and increases a contact area between the peripheral surface of the first de-curl roller 860 and the recording medium 700 by changing an angle at which the recording medium 700 enters the first de-curl roller 860.

In this way, the second de-curl roller 870 causes the recording medium 700 to be more strongly curved by the first de-curl roller 860.

The second de-curl roller 870 may have a cylindrical shape. The second de-curl roller 870 may be provided to idle rotate about the rotation axis 871. That is, the recording medium 700 may start to move when the platen roller 850 is driven, and the second de-curl roller 870 may be rotated by a friction force of the second de-curl roller 870 with the recording medium 700.

Operations of the platen roller 850, the first de-curl roller 860, and the second de-curl roller 870 will be described.

As illustrated in FIG. 54, when the transfer motor 820 is driven and the platen roller 850 is rotated in a first direction (A), the recording medium 700 starts to move.

When the recording medium 700 starts to move, the first de-curl roller 860 is rotated in a second direction (B) opposite to the first direction by a friction force between the recording medium 700 and the first de-curl roller, and the curl of the recording medium 700 is corrected by the first de-curl roller 860.

The second de-curl roller 870 is rotated in a first direction (C) by a friction force between the recording medium 700 and the second de-curl roller 870. The second de-curl roller 870 increases a tension applied to the recording medium 700 and increases a contact area between the peripheral surface of the first de-curl roller 860 and the recording medium 700 by changing an angle at which the recording medium 700 enters the first de-curl roller 860, and thereby causing the recording medium 700 to be more efficiently de-curled.

When a recording medium roll 703 rotates in a first direction, the recording medium 700 is continuously unwound from the recording medium roll 703 and moves to a second de-curl roller 870 side.

The platen roller 850 and the second de-curl roller 870 may be provided to be movable with respect to the first de-curl roller 860.

More specifically, the first de-curl roller 860 is provided to be fixed with respect to the housing 800, and the platen roller 850 and the second de-curl roller 870 are provided to be moveable with respect to the housing 800.

The image forming apparatus 800 may include a fixed frame 810, and a rotary frame 811 which is rotatable with respect to the fixed frame 810. The fixed frame 810 forms a frame for fixing various types of components in the housing 800.

The transfer motor 820 for driving the platen roller 850, a power supply device 821 for supplying a power to various types of components, a communication device 822 for communicating with the outside, and the cutter 830 for cutting the recording medium 700 may be combined and supported in the fixed frame 810.

The power supply device 821 may include a circuit device which generates an output power from an input power input from an external power source. The power supply device 821 may include a voltage-controlled semiconductor device or a current-controlled semiconductor device. Alternatively, the power supply device 821 may be a rechargeable battery or a cell.

The communication device 822 may include various types of wired or wireless communication devices for performing communication with the outside. The communication device 822 may include a Bluetooth, a Wi-Fi device, and the like.

The cutter 830 may include a fixed blade 832, a movable blade 831 which is movable with respect to the fixed blade 832, and a cutting motor 833 which provides a driving force to the movable blade 831.

The first de-curl roller 860 may be provided in the fixed frame 810. Accordingly, the first de-curl roller 860 may be fixed to the housing 800.

The rotary frame 811 may be provided to be rotatable about a hinge axis 812 with respect to the fixed frame 810. The rotary frame 811 may rotate in a vertical direction.

The platen roller 850 and the second de-curl roller 870 may be provided in the rotary frame 811. Accordingly, the platen roller 850 and the second de-curl roller 870 may be movable with respect to the housing 800 and the first de-curl roller 860 provided in the housing 800.

The platen roller 850 and the second de-curl roller 870 may rotate about the common hinge axis 812 together.

In the image forming apparatus 800 having a configuration as described above, an operation of mounting the recording medium 700 and causing the recording medium 700 to be caught in the platen roller 850, the first de-curl roller 860 and the second de-curl roller 870 will be described.

When mounting the recording medium 700 in the roll 703 form into the housing 800, the recording medium 700 may be mounted after rotating the rotary frame 811 about an upper side.

After the recording medium roll 703 is mounted, the recording medium 700 is released and caught in the first de-curl roller 860. And then, when the rotary frame 811 is rotated about a lower side again, the recording medium 700 is automatically caught in the platen roller 850 and the second de-curl roller 870.

Wth this configuration, an operation of causing the recording medium to be caught in the platen roller 850, the first de-curl roller 860, and the second de-curl roller 870 may be easily performed.

Figure 55:
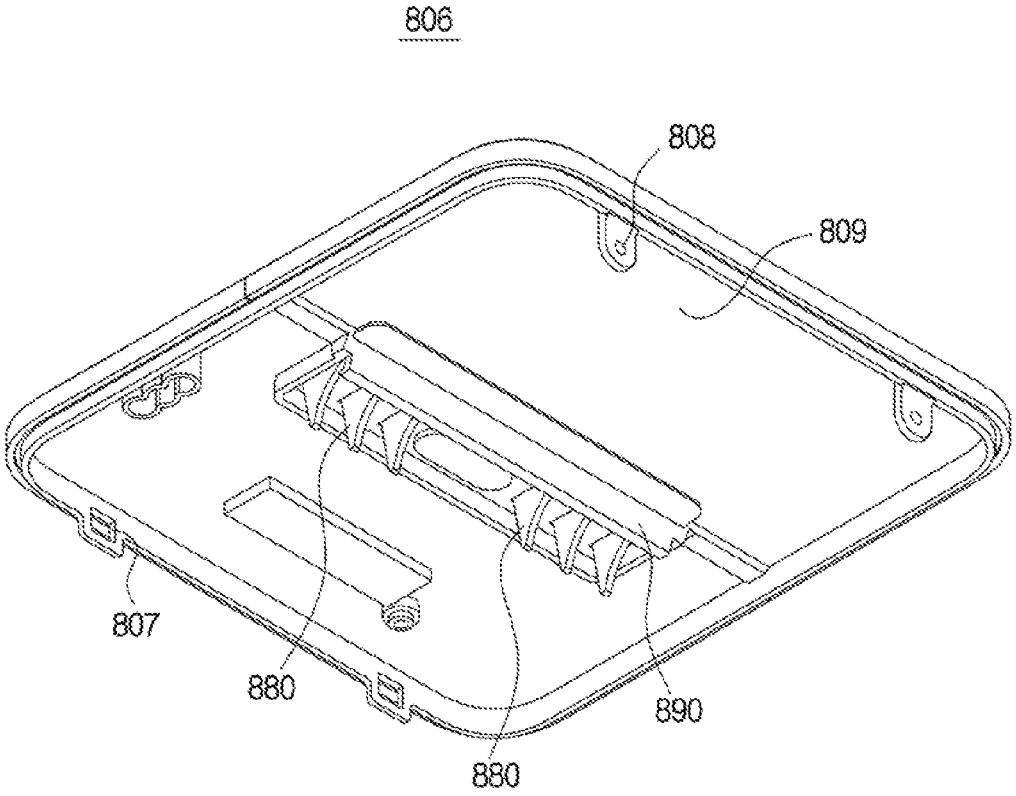
FIG. 55 is a bottom perspective view illustrating a discharge guide unit of the image forming apparatus in accordance with an embodiment of the disclosure.

FIG. 55 is a bottom perspective view illustrating a discharge guide unit of the image forming apparatus in accordance with an embodiment of the disclosure. FIGS. 56 to 59 are views sequentially illustrating a popping operation of the recording medium by the discharge guide unit of the image forming apparatus in accordance with an embodiment of the disclosure.

Referring to FIGS. 55 to 59, a discharge guide unit of the image forming apparatus according to an embodiment of the disclosure will be described.

The image forming apparatus 800 may include a discharge guide unit 880 for discharging the recording medium 700 on which printing is completed in the printing unit 840 and 850 to the outside of the image forming apparatus 800.

The discharge guide unit 880 discharges the recording medium 700 to the outside through the outlet 805. The discharge guide unit 880 discharges a unit recording medium 704 which is formed by cutting the recording medium 700 by the cutter 830 to the outside.

The discharge guide unit 880 may cause the recording medium 700 to be popped out when the recording medium 700 is discharged. That is, the recording medium 700 may be irregularly discharged from the outlet 805 with a certain degree of freedom.

The recording medium 700 may be popped out when the cutter 830 cuts the recording medium 700. The recording medium 700 accumulates an elastic force until a moment when the cutter 830 cuts the recording medium 700, and is popped out by the elastic force at the moment of cutting.

The discharge guide unit 860 may bend the recording medium 700 to accumulate the elastic force from the moment when the recording medium 700 is in contact with the discharge guide unit 880 to the moment when the recording medium 700 is cut.

The discharge guide unit 880 guides a leading end 709 of the recording medium 700 in a direction of the outlet 805.

The discharge guide unit 880 may include a guide surface 881 so as to bend the recording medium 700 while guiding the leading end 709 of the recording medium 700 in the direction of the outlet 805.

The guide surface 881 is preferably formed to be a curved surface. In particular, it is advantageous that the guide surface 881 is provided to be concave toward the recording medium 700.

This is because, when the guide surface 881 is a plane or is provided to be convex toward the recording medium 700, the recording medium 700 slides down the guide surface 881 and the recording medium 700 may not be bent.

The discharge guide unit 880 has a starting point 882 from which the guide surface 881 is started and an end point 883 at which the guide surface 881 ends. The guide surface 881 is continuous in a section between the starting point 882 and the end point 883.

The guide surface 881 may be provided to maintain constant curvature in the section between the starting point 882 and the end point 883; however, it is not limited thereto. The end point 883 of the guide surface 881 may be positioned closer to the outlet 805 than the starting point 882.

The discharge guide unit 880 may be positioned in a moving direction 842 of the recording medium 700, and may be positioned to deviate from the moving direction 842 of the recording medium 700.

That is, the discharge guide unit 880 may be positioned in a direction 842 in which the recording medium 700 is released from the platen roller 850, and the outlet 805 may be positioned to deviate from the direction 842.

However, unlike the embodiment, when paper discharging is not performed by the platen roller 850, and an additional paper-discharging roller is equipped, the discharge guide unit 880 may be positioned in a direction in which the recording medium 700 is released from the paper-discharging roller, and the outlet 805 may be positioned to deviate from the direction.

The discharge guide unit 880 may be provided in an upper portion of the housing 800. More specifically, the discharge guide unit 880 may be formed to be integrated with the upper housing 806. The discharge guide unit 880 is provided to protrude from the bottom surface 809 of the upper housing 806.

The image forming apparatus 800 may further include an auxiliary guide unit 890 which guides a recording medium 704 popped out by the discharge guide unit 880 to the outlet 805 side. The recording medium 704 popped out due to an elastic force may swing and the auxiliary guide unit 890 guides the recording medium 704 to be reliably moved to the outlet 805 side.

The auxiliary guide unit 890 may be formed to protrude from the bottom surface 809 of the upper housing 806. The auxiliary guide unit 890 may form a guide passage 891 for guiding the recording medium 704 between the auxiliary guide unit 890 and the discharge guide unit 880 to the outlet 805.

Referring to FIGS. 56 to 59, a process in which the recording medium 704 is popped out and discharged by the discharge guide unit 880 is described.

Figure 56:
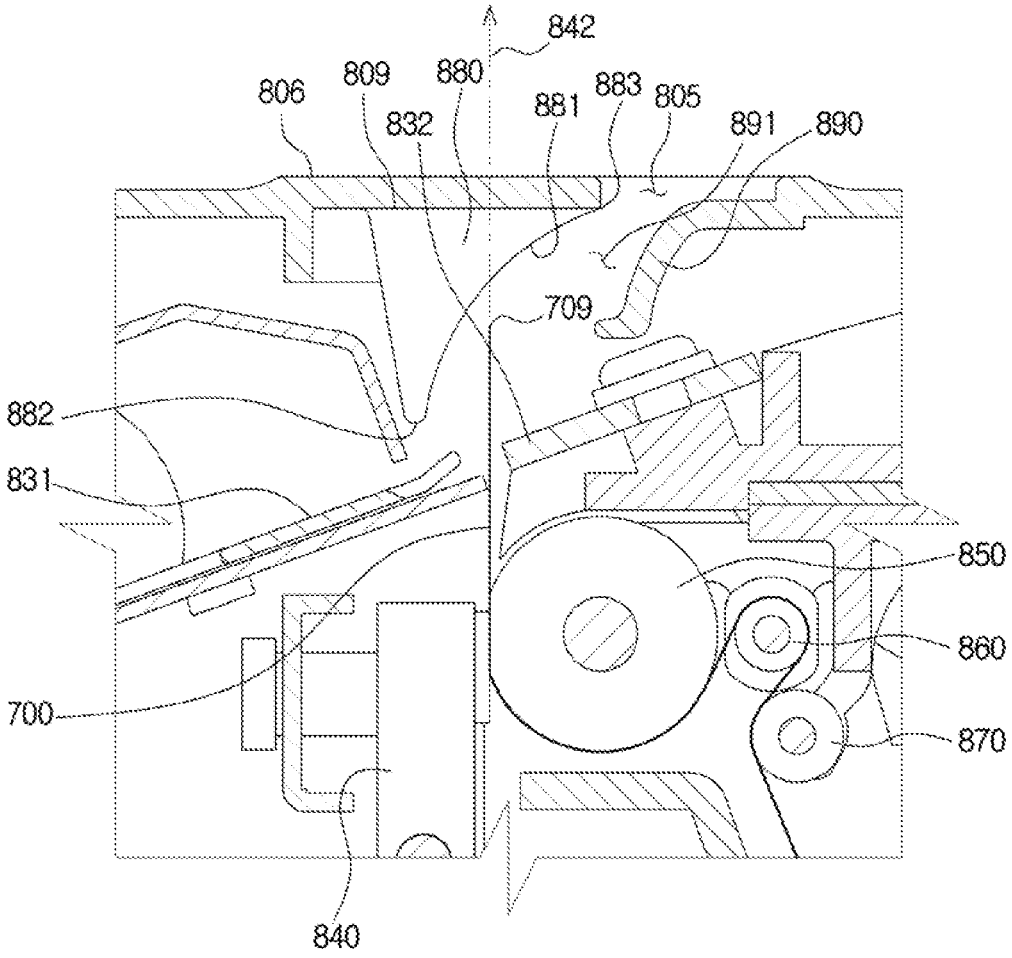
FIGS. 56 to 59 are views sequentially illustrating a popping operation of the recording medium by the discharge guide unit of the image forming apparatus in accordance with an embodiment of the disclosure.

As illustrated in FIG. 56, the recording medium 700 on which printing is completed is transferred to a discharge guide unit 880 side by the platen roller 850.

Figure 57:
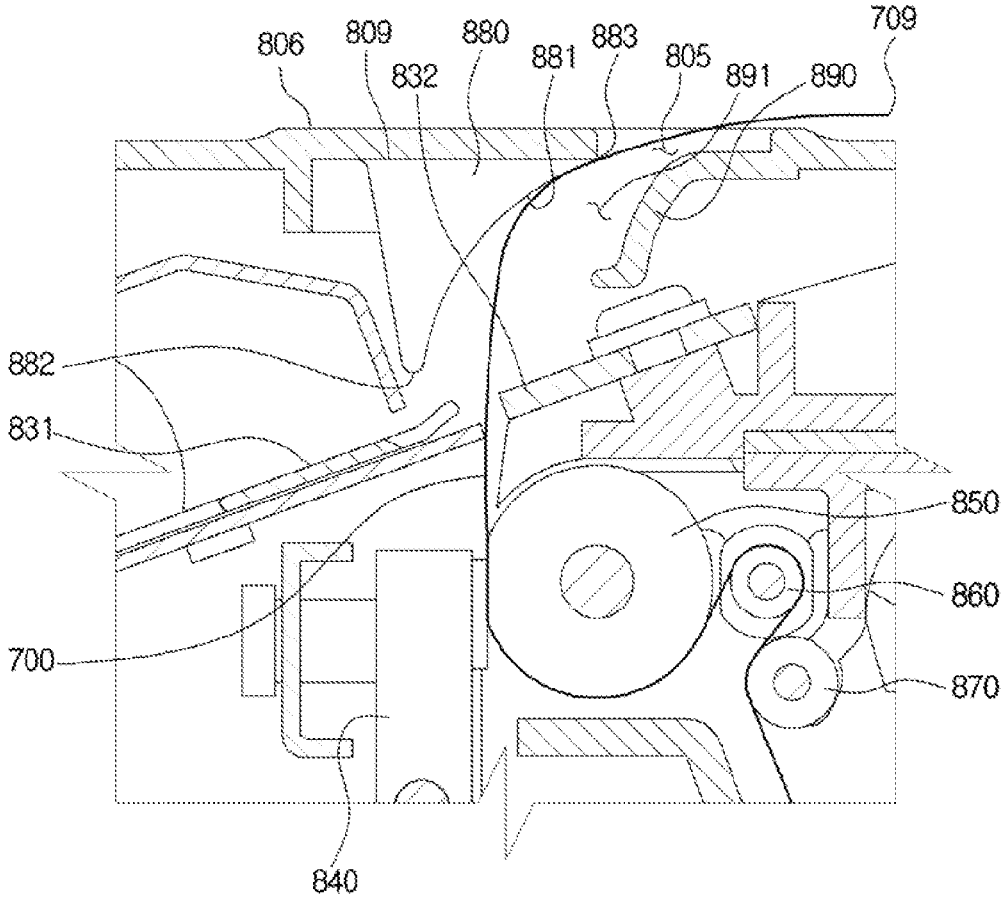

As illustrated in FIG. 57, when the platen roller 850 continuously pushes the recoding medium 700 in a state in which the recording medium 700 is in contact with the guide surface 881 of the discharge guide unit 880, the leading end 709 of the recording medium 700 is guided to the outlet 805 side and the recording medium 700 is bent. An elastic force is accumulated in the recording medium 700 by bending of the recording medium 700.

Figure 58:
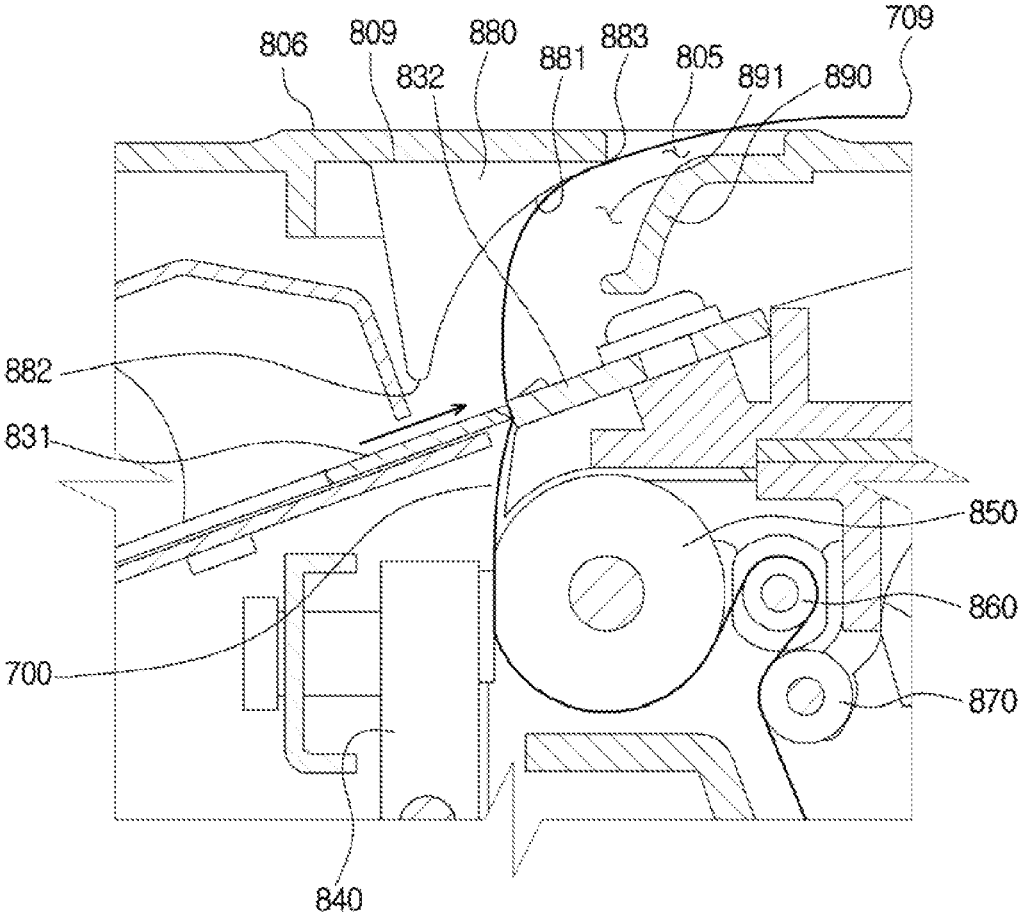

As illustrated in FIG. 58, the cutter 830 cuts the recording medium 700 at a predetermined time at which the recording medium 700 is appropriately bent.

Figure 59:
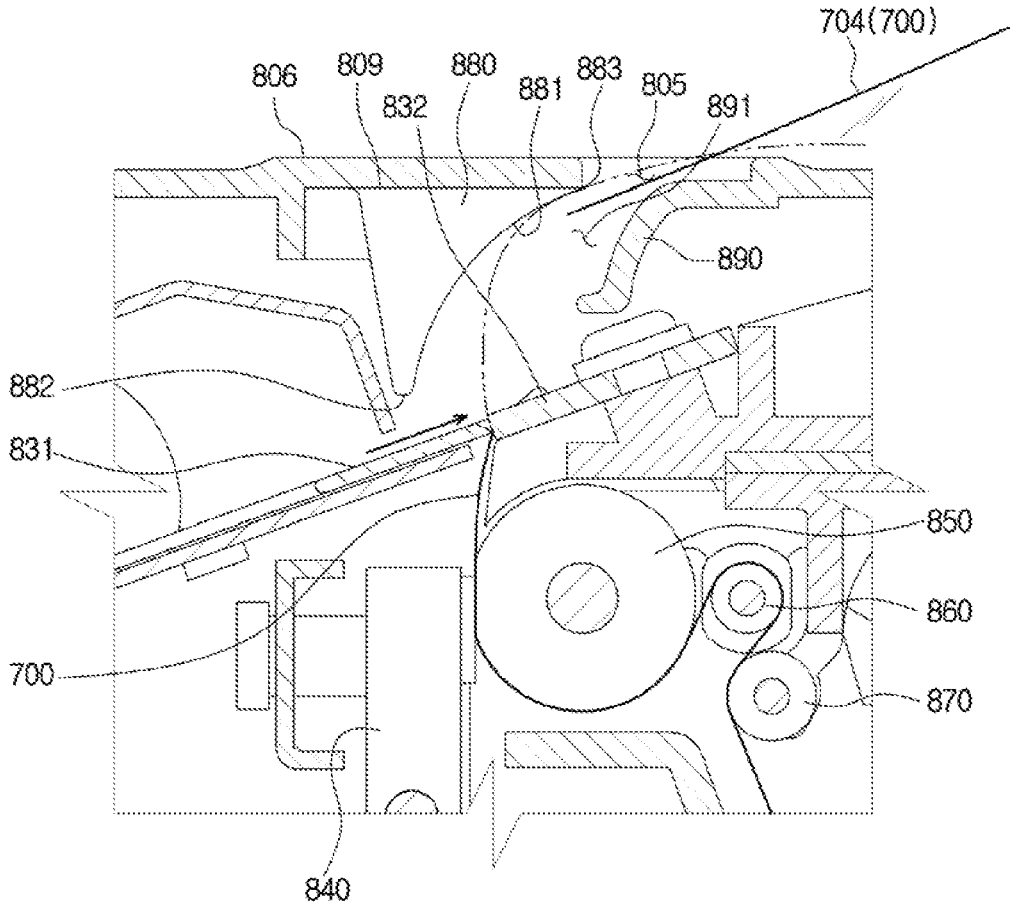

As illustrated in FIG. 59, when the recording medium 700 is cut, the cut unit recording mediums 704 are popped out to the outside and discharged through the outlet 805 by an elastic force to be restored to an original state.

In this manner, the image forming apparatus 800 according to an embodiment causes the recording mediums 704 to be popped out and discharged through the discharge guide unit 880, such that the recording mediums 704 are not stacked at a fixed place in order, but are irregularly discharged with a certain degree of freedom.

Accordingly, when the recording medium 704 having an adhesive layer formed on a surface of the image forming apparatus 800 is used, the recording mediums 704 are stacked at a fixed place in order and a phenomenon of mutual adhesion may be prevented.

Figure 60:
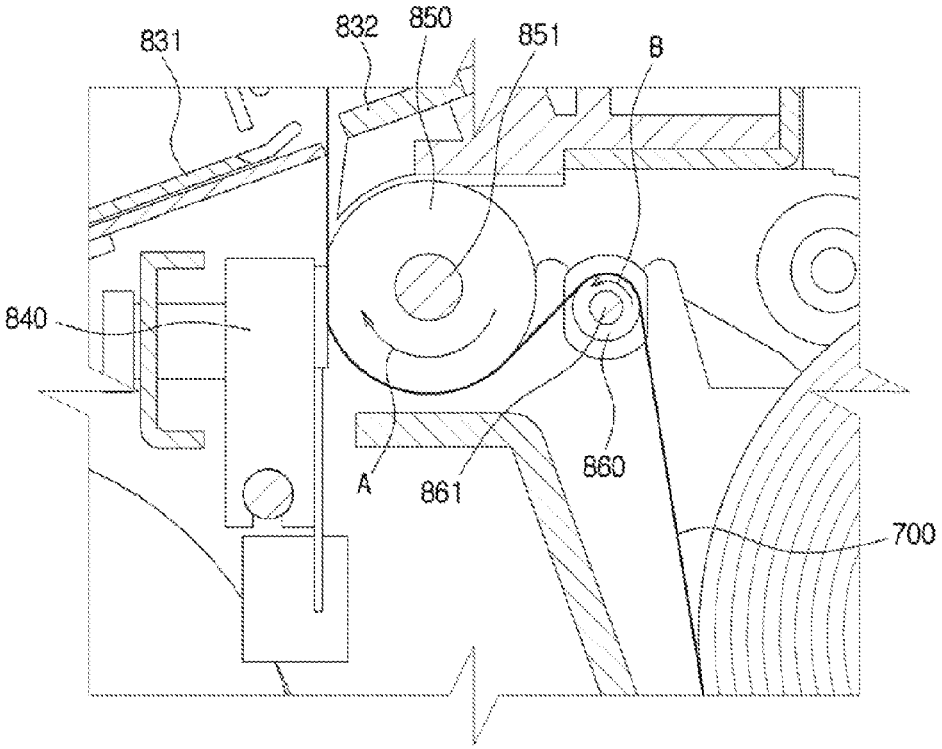
FIGS. 60 to 61 are views respectively describing a de-curl unit of an image forming apparatus in accordance with an embodiment of the disclosure.
Figure 61:
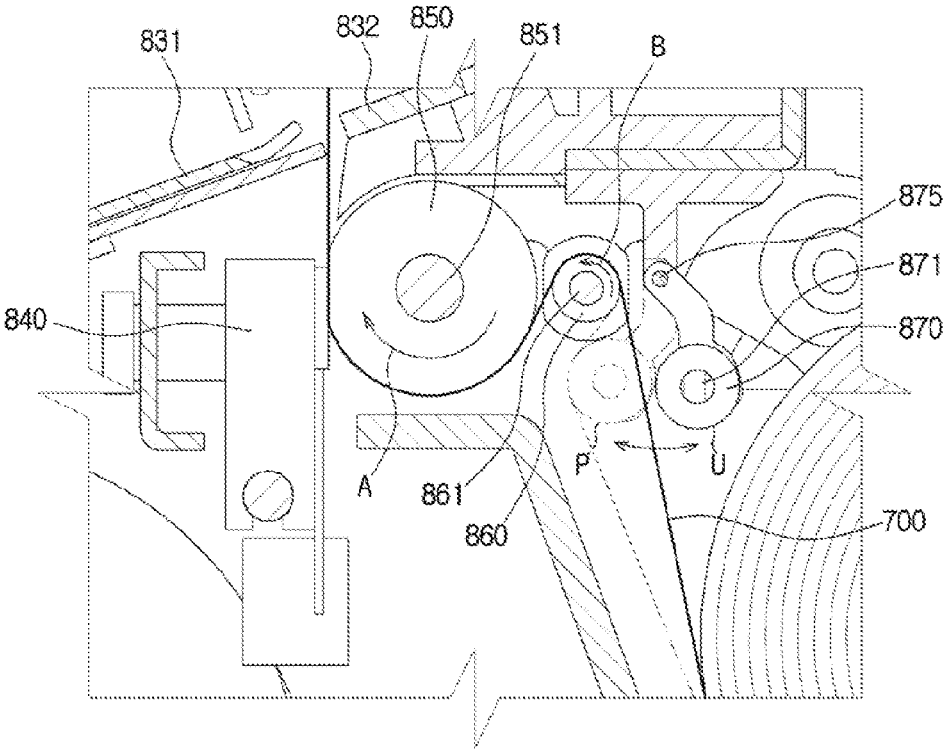

FIGS. 60 to 61 are views respectively describing a de-curl unit of an image forming apparatus in accordance with an embodiment of the disclosure.

The same reference numerals are given to the same configurations as in the embodiment described above and description thereof is omitted, but may be applied equally to the embodiment.

As illustrated in FIG. 60, unlike the above-described embodiment, a de-curl unit of an image forming apparatus may be configured by one de-curl roller 860. That is, the second de-curl roller of the above-described embodiment is not an essential configuration, and when de-curling may be performed only by the one de-curl roller 860, it is not necessary to include the second de-curl roller.

The de-curl roller 860 gives a curve in an opposite direction to the curl of the recording medium 700, thereby correcting, eliminating or reducing, the curl of the recording medium 700.

As illustrated in FIG. 61, the de-curl unit 860 and 870 may include the first de-curl roller 860 for correcting the curl of the recording medium 700 by giving a curve in an opposite direction to the curl of the recording medium 700, and the second de-curl unit 870 which increases a curving amount given by the first de-curl roller 860. At this time, the second de-curl roller 870 may be provided to be movable so as to press the recording medium 700 when the image forming apparatus proceeds with printing, and not to press the recording medium 700 when the image forming apparatus does not proceed with printing.

That is, the second de-curl roller 870 is provided to be movable with respect to the printing unit 840 and 850 and the first de-curl roller 860, and is provided to move to a pressing position P to press the recording medium 700 when the image forming apparatus proceeds with printing, and to move to a non-pressing position U not to press the recording medium 700 when the image forming apparatus does not proceeds with printing.

The second de-curl roller 870 is provided to be movable through various known mechanical structures. For example, the second de-curl roller 870 may be provided to be rotatable about a rotation axis 875 and the image forming apparatus may include an additional driving motor (not shown) which provides a driving force to the second de-curl roller 870.

Figure 62:
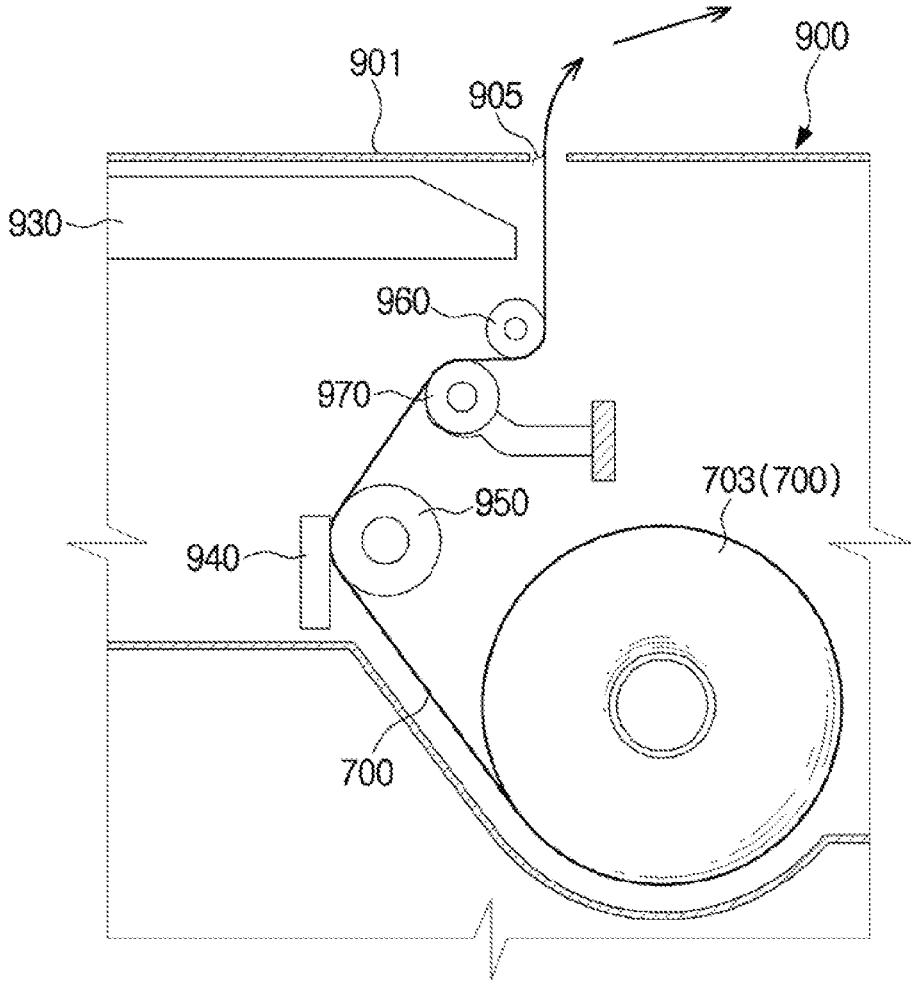
FIGS. 62 to 64 are views respectively describing a de-curl unit of an image forming apparatus in accordance with an embodiment of the disclosure.
Figure 63:
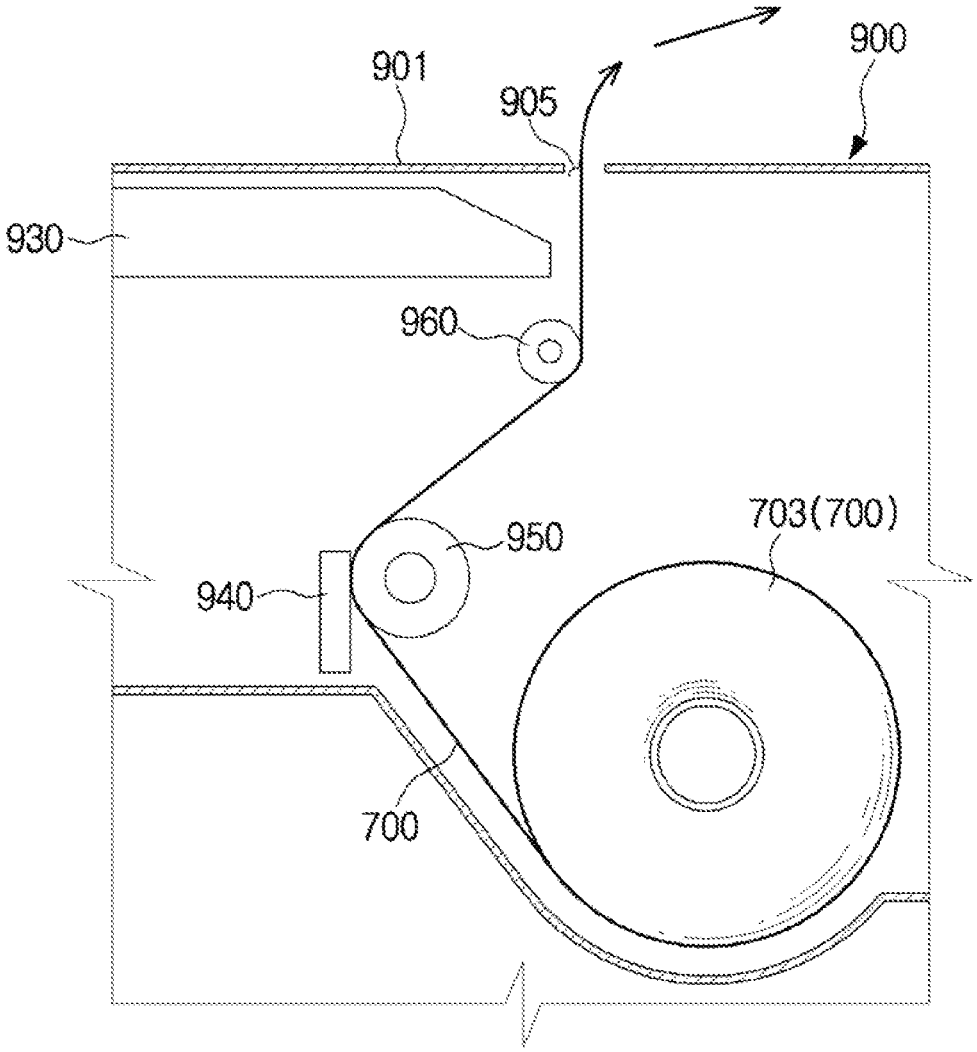
Figure 64:
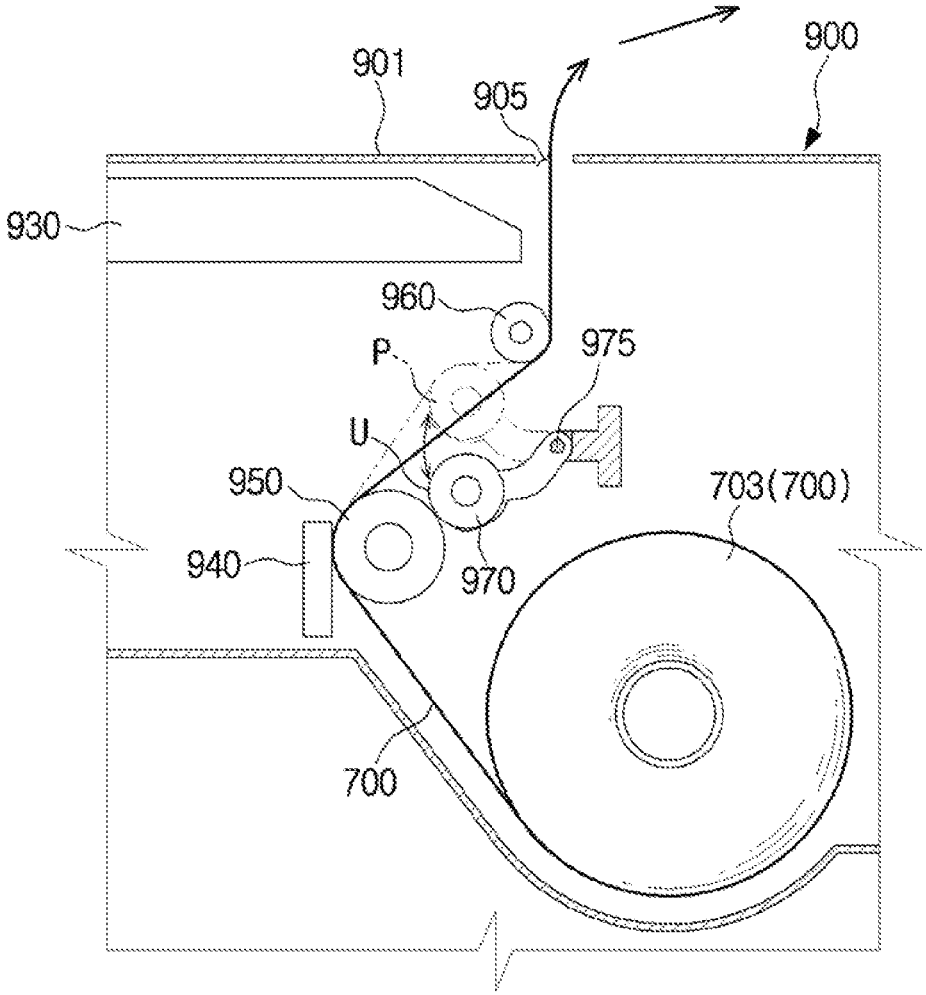

FIGS. 62 to 64 are views respectively describing a de-curl unit of an image forming apparatus in accordance with an embodiment of the disclosure.

The same reference numerals are given to the same configurations as in the embodiment described above and description thereof is omitted, but may be applied equally to the embodiment.

As illustrated in FIG. 62, unlike the above-described embodiment, a de-curl unit 960 and 970 may be on a downstream side in a moving direction of the recording medium 700 rather than on an upstream side.

An image forming apparatus 900 may include a housing 901, a printing unit 940 and 950 which is placed in the housing 901 and performs printing, and a de-curl unit 960 and 970 which corrects the curl of the recording medium 700 and transfers the recording medium to the printing unit 940 and 950.

The printing unit 940 and 950 may include a thermal head 940 which has a plurality of heat generating elements, and a platen roller 950 which forms a printing nip between the platen roller 950 and the thermal head 940 and supports the recording medium 700 passing through the printing nip.

The de-curl unit 960 and 970 corrects the curl of the recording medium 700 transferred through the platen roller 950 and transfers the recording medium to the outlet 905.

The de-curl unit 960 and 970 may include a first de-curl roller 960 which corrects the curl of the recording medium 700 by giving a curve in an opposite direction to the curl of the recording medium 700. The de-curl unit 960 may include a second de-curl roller 970 which increases a curving amount given by the first de-curl roller.

The first de-curl roller 960 may eliminate or reduce the curl of the recording medium 700 by giving a curve in the opposite direction to the curl of the recording medium 700.

As a result, the recoding medium on which printing is performed by the printing unit 940 and 950 is improved in flatness and is discharged to the outlet 905.

The second de-curl roller 970 increases the curving amount given to the recording medium 700 by the first de-curl roller 960. The second de-curl roller 970 gives a tension to the recording medium 700, and increases a contact area between the peripheral surface of the first de-curl roller 960 and the recording medium 700 by changing an angle at which the recording medium 700 enters the first de-curl roller 960.

As a result, the second de-curl roller 970 causes the recording medium 700 to be more strongly curved by the first de-curl roller 960.

The image forming apparatus may have a cutter 930 which is provided between the de-curl unit 960 and 970 and the outlet 905 and cuts the recording medium 700.

As illustrated in FIG. 63, the de-curl unit of the image forming apparatus 900 is configured to have one de-curl roller 960. That is, the second de-curl roller is not an essential configuration, and when de-curling may be performed only by the one de-curl roller 960, it is not necessary to include the second de-curl roller.

The de-curl roller 960 gives a curve in an opposite direction to the curl of the recording medium 700, thereby correcting, eliminating or reducing, the curl of the recording medium 700 and discharging the recording medium to the outlet 905.

As illustrated in FIG. 64, the de-curl unit 960 and 970 may include the first de-curl 960 for correcting the curl of the recording medium 700 by giving a curve in an opposite direction to the curl of the recording medium 700, and the second de-curl unit 970 which increases the curving amount given by the first de-curl roller 960. At this time, the second de-curl roller 970 may be provided to be movable so as to press the recording medium 700 when the image forming apparatus proceeds with printing, and not to press the recording medium 700 when the image forming apparatus does not proceed with printing.

That is, the second de-curl roller 970 may be provided to be movable with respect to the printing unit 940 and 950 and the first de-curl roller 960, and is provided to move to a pressing position P to press the recording medium 700 when the image forming apparatus proceeds with printing and to move to a non-pressing position U not to press the recording medium 700 when the image forming apparatus does not proceeds with printing.

The second de-curl roller 970 may be provided to be movable through various known mechanical structures. For example, the second de-curl roller 970 may be provided to be rotatable about a rotation axis 975 and the image forming apparatus may include an additional driving motor (not shown) which provides a driving force to the second de-curl roller 970.

Of course, the image forming apparatus 100 according to the embodiment described above may be embodied in the image forming apparatus 800 according to the another embodiment, and the recording medium 700 may be also applied to the embodiment described above.

According to the example embodiments so far described, since note input through a terminal is printed on an adhesive paper, contents difficult for a user to directly write may be easily printed on a paper to be stored.

Moreover, the terminal and the image forming apparatus may configure various solutions such as office solutions, conference solutions, and academic solutions. Accordingly, while users proceeding with a private business, a conference, and a study remember important information by attaching a note or maintain a traditional experience of sharing opinions or ideas among the users, it is possible to increase convenience by reducing effort and time consumed to create a note and by printing contents difficult to write by hand.

The embodiments described above may be realized in forms of hardware, software, or a combination of hardware and software. Such arbitrary software, regardless of, for example, whether it may be deleted or re-written, may be optically or magnetically recorded in a volatile or a non-volatile storage device such as a ROM, a memory such as a RAM, a memory chip, a device or an integrated circuit, or a recording medium which is capable of optically and magnetically recording data and readable by a machine (for example, a computer) such as a CD, a DVD, a magnetic disc, or a magnetic tape. The note printing method according to the example embodiments described above may be embodied in a computer or a mobile terminal including a control unit and a memory, and the memory may be an example of the machine- readable storage medium appropriate for storing a program or programs including instructions realizing the embodiments of the disclosure. Accordingly, the note printing method in accordance with one or more embodiments may include one or more programs having a code for realizing devices described in any claim or a method, and a machine-readable (such as a computer) storage medium for storing the program. In addition, the one or more programs may be electronically transferred through any medium such as a communication signal transmitted through a wired or wireless connection, and the disclosure appropriately includes the equivalents.

Moreover, the terminal in accordance with one or more embodiments may receive and store a note print program from a program providing device, e.g., a server, which are connected in a wired or wireless manner. The program providing device may include one or more programs including instruction causing a method of protecting content set in advance to be performed, a memory for storing information for the method of protecting contents, a communication unit for performing a wired or wireless communication, and a control unit for controlling transmission of a program. The program providing device may provide the one or more programs to the terminal in a wired or wireless manner when receiving a request of providing the program from the terminal. In addition, the program providing device may be formed to provide the one or more programs to the terminal in a wired or wireless manner even when there is no request of providing a program from the terminal, for example, when the terminal is positioned in a specific place.

Although example embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. A note printing method for printing note information input to a terminal, the note printing method comprising:

displaying a note window for receiving note information from a user;

receiving the note information;

transmitting the note information and a print request of the note information to an image forming apparatus configured to print the note information on a recording medium with an adhesive layer provided on a first side which is opposite of a second side of the recording medium on which the note information is to be printed; and transmitting identification information of the image forming apparatus to a server configured to generate a virtual conference space based on the identification information of the image forming apparatus.

2. The note printing method according to claim 1, wherein the transmitting of the note information and the print request includes:

connecting the image forming apparatus and the terminal using a Bluetooth communication, and releasing the connection according to completion of printing of the note information or when a reference time is exceeded.

3. The note printing method according to claim 1, wherein the transmitting of the note information and the print request includes:

connecting the image forming apparatus and the terminal using a Bluetooth communication, and releasing the connection when a transmission of print data corresponding to the note information is completed.

4. The note printing method according to claim 1, wherein the transmitting of the note information and the print request includes:

connecting the terminal to a master terminal through a Wi-Fi communication or a Wi-Fi Direct communication, the master terminal being connected to the image forming apparatus using a Bluetooth communication, and transmitting the note information and the print request from the terminal to the image forming apparatus through the master terminal.

5. The note printing method according to claim 1, wherein the transmitting of the note information and the print request includes:

connecting the image forming apparatus and the terminal using a Bluetooth communication, and releasing the connection when printing of the note information is completed.

6. The note printing method according to claim 1, further comprising:

receiving a selection from the user indicating a size of recording medium; and transmitting the selection of the user to the image forming apparatus.

7. The note printing method according to claim 1, further comprising:

receiving a selection of the user indicating a relationship between a position of the adhesive layer applied to the first side of the recording medium and a printing position of the note information; and transmitting the selection of the user to the image forming apparatus.

8. The note printing method according to claim 1, further comprising:

receiving a request to generate the virtual conference space; and transmitting the request to generate the virtual conference space to the server.

9. The note printing method according to claim 8, wherein the receiving of the request to generate the virtual conference space includes:

displaying on a display unit of the terminal a list of available image forming apparatuses;

receiving an input for a selection of the image forming apparatus from the user; and displaying a message on the display unit confirming whether there is a request to generate the virtual conference space using the selected image forming apparatus.

10. The note printing method according to claim 8, wherein the receiving of the request to generate the virtual conference space includes:

displaying on a display unit of the terminal a list of conference attendee candidates and a list of available image forming apparatuses; and receiving an input for a selection of a conference attendee among the list of conference attendee candidates and an input for a selection of an image forming apparatus to be used among the list of available image forming apparatuses.

11. The note printing method according to claim 8, further comprising:

receiving note information from another terminal connected to the virtual conference space; and receiving an input of a relationship between the note information received by the terminal and the note information received from the another terminal.

12. The note printing method according to claim 11, further comprising:

displaying the note information received by the terminal and the note information from the another terminal on a display unit of the terminal.

13. The note printing method according to claim 11, further comprising:

generating a report based on the relationship between the note information received by the terminal and the note information from the another terminal.

14. The note printing method according to claim 11, further comprising:

displaying a screen on the terminal for creating a report.

15. A non-transitory computer-readable storage medium which stores at least one program, wherein the at least one program includes at least one command to perform:

displaying a note window on a display unit for receiving note information from a user, receiving the note information, transmitting the note information and a print request of the note information to an image forming apparatus configured to print the note information on a recording medium with an adhesive layer provided on a first side which is opposite of a second side of the recording medium on which the note information is to be printed, and transmitting identification information of the image forming apparatus to a server configured to generate a virtual conference space based on the identification information of the image forming apparatus.

* * * * *